US009306324B2

(12) United States Patent
Wei

(10) Patent No.: US 9,306,324 B2
(45) Date of Patent: Apr. 5, 2016

(54) COAXIAL CABLE CONNECTOR AND THREADED CONNECTOR

(71) Applicant: EZCONN CORPORATION, Taipei (TW)

(72) Inventor: Kai-Chih Wei, Taipei (TW)

(73) Assignee: EZCONN CORPORATION, Taipei (TW)

( * ) Notice: Subject to any disclaimer, the term of this patent is extended or adjusted under 35 U.S.C. 154(b) by 0 days.

(21) Appl. No.: 14/320,587

(22) Filed: Jun. 30, 2014

(65) Prior Publication Data

US 2015/0180141 A1 Jun. 25, 2015

(30) Foreign Application Priority Data

Dec. 20, 2013 (TW) ..... 102224143 U
Jan. 29, 2014 (TW) ..... 103201941 U

(51) Int. Cl.
*H01R 9/05* (2006.01)
*H01R 13/622* (2006.01)

(52) U.S. Cl.
CPC ..... *H01R 13/622* (2013.01); *H01R 9/0524* (2013.01)

(58) Field of Classification Search
CPC ..... H01R 9/0521; H01R 9/0524; H01R 9/05; H01R 13/622
USPC ..... 439/578–585, 63
See application file for complete search history.

(56) References Cited

U.S. PATENT DOCUMENTS 7,892,024 B1 * 2/2011 Chen ..... H01R 13/65802 439/578

* cited by examiner

*Primary Examiner* — Javaid Nasri

(57) ABSTRACT

An coaxial cable connector is configured to engage with an outer thread of a threaded connector. The coaxial cable connector comprises an inner sleeve, an outer sleeve arranged around the inner sleeve and a nut arranged around the inner sleeve. The nut comprises a metal sheet integral with an inner flange of the nut, wherein the metal sheet is between the inner flange and a cylindrical surface of the inner sleeve. The metal sheet has a fixed side, close to an outer flange of the inner sleeve, fixed to the inner flange of the nut, and a free side, away from the outer flange of the inner sleeve, abutting against the cylindrical surface of the inner sleeve. An empty gap is between the metal sheet and the inner flange. When the nut comprises an inner thread engaging with the outer thread, the outer flange is configured to be between the inner flange and the threaded connector.

20 Claims, 65 Drawing Sheets

COAXIAL CABLE CONNECTOR AND THREADED CONNECTOR

The present application claims priority to TW application No. 102224143, filed on Dec. 20, 2013 and TW application No. 103201941, filed on Jan. 29, 2014, all of which is incorporated herein by reference.

BACKGROUND OF THE DISCLOSURE

1. Field of the Disclosure

The disclosure relates to a coaxial cable connector and threaded connector, and more particularly, to a coaxial cable connector and threaded connector with improved electrical connection.

2. Brief Description of the Related Art

Currently, with regards to signal reception, coaxial cables are a mainstream to be employed for televisions (TV). A cable television may receive signals via a coaxial cable. The coaxial cable may include a screw-on F-type connector to be connected with a cable TV decoder, a video cassette recorder (VCR), a digital hard-disk recorder for a digital versatile disc (DVD), a satellite receiver, a video game, a TV signal distribution splitter or a switch.

The conventional screw-on F-type coaxial cable connector may often not have good ground connection because the F-type coaxial cable connector has a nut, when being screwed with a threaded connector, which may have a loose contact with an inner sleeve of the F-type coaxial cable connector. Even more, the inner sleeve may not contact the threaded connector. Casually pulling the coaxial cable could cause the nut to have a loose contact with the inner sleeve or the threaded connector. Accordingly, the F-type coaxial cable connector and the threaded connector may have unqualified ground connection and electrical signals are also caused to have unqualified properties. The above defects are necessary to be overcome.

SUMMARY OF THE DISCLOSURE

The present invention provides a coaxial cable connector with a metal sheet arranged at a nut thereof, an inner sleeve thereof or an outer sleeve thereof and a threaded connector of an electronic device with a metal sheet. The metal sheet may be integral with the nut, inner sleeve, outer sleeve or threaded connector. The metal sheet is flexible such that the coaxial cable connector has good electrical connection. Thus, unqualified electrical connection may be avoided.

In an example of the present invention, a coaxial cable connector is configured to engage with an outer thread of a threaded connector. The coaxial cable connector comprises an inner sleeve, an outer sleeve arranged around the inner sleeve and a nut arranged around the inner sleeve. When the nut comprises an inner thread engaging with the outer thread, the inner sleeve comprises an outer flange configured to be between an inner flange of the nut and the threaded connector. The inner sleeve comprises a metal sheet integral with a main body of the inner sleeve, wherein the metal sheet of the inner sleeve is between the outer flange of the inner sleeve and the inner flange of the nut and contacts the inner flange of the nut, wherein an empty gap is between the metal sheet of the inner sleeve and the outer flange of the inner sleeve.

In an example of the present invention, a coaxial cable connector is configured to engage with an outer thread of a threaded connector. The coaxial cable connector comprises an inner sleeve, an outer sleeve arranged around the inner sleeve and a nut arranged around the inner sleeve. The inner sleeve comprises a metal sheet integral with a main body of the inner sleeve. An empty gap is between the metal sheet of the inner sleeve and the main body of the inner sleeve. When the nut comprises an inner thread engaging with the outer thread, the inner sleeve comprises an outer flange configured to be between an inner flange of the nut and the threaded connector and the metal sheet of the inner sleeve is configured to contact the threaded connector. In an expanded position, the metal sheet of the inner sleeve inclines to a side away from the main body of the inner sleeve.

In an example of the present invention, a coaxial cable connector is configured to engage with an outer thread of a threaded connector. The coaxial cable connector comprises an inner sleeve, an outer sleeve arranged around the inner sleeve and a nut arranged around the inner sleeve. The nut comprises a metal sheet integral with a main body of the nut, wherein the metal sheet of the nut is between the main body of the nut and the outer sleeve and contacts the outer sleeve. An empty gap is between the metal sheet of the nut and the main body of the nut. When the nut comprises an inner thread engaging with the outer thread of the threaded connector, the inner sleeve comprises an outer flange configured to be between an inner flange of the nut and the threaded connector.

In an example of the present invention, a coaxial cable connector is configured to engage with an outer thread of a threaded connector. The coaxial cable connector comprises an inner sleeve, an outer sleeve arranged around the inner sleeve and a nut arranged around the inner sleeve. The nut comprises a metal sheet integral with an inner flange of the nut, wherein the metal sheet of the nut is between the inner flange of the nut and a cylindrical surface of the inner sleeve. The metal sheet of the nut has a fixed side, close to an outer flange of the inner sleeve, fixed to the inner flange of the nut, and a free side, away from the outer flange of the inner sleeve, abutting against the cylindrical surface of the inner sleeve. An empty gap is between the metal sheet of the nut and the inner flange of the nut. When the nut comprises an inner thread engaging with the outer thread of the threaded connector, the outer flange of the inner sleeve is configured to be between the inner flange of the nut and the threaded connector.

In an example of the present invention, a coaxial cable connector is configured to engage with an outer thread of a threaded connector. The coaxial cable connector comprises an inner sleeve, an outer sleeve arranged around the inner sleeve and a nut arranged around the inner sleeve. The outer sleeve comprises a metal sheet integral with a main body of the outer sleeve, wherein the metal sheet of the outer sleeve is between the main body of the outer sleeve and the nut and contacts the nut. An empty gap is between the metal sheet of the outer sleeve and the main body of the outer sleeve. When the nut comprises an inner thread engaging with the outer thread of the threaded connector, the inner sleeve comprises an outer flange configured to be between an inner flange of the nut and the threaded connector.

In an example of the present invention, a threaded connector is configured to be screwed with a coaxial cable connector. The threaded connector comprises a metal sheet integral with a main body of the threaded connector. An empty gap is between the metal sheet of the threaded connector and the main body of the threaded connector. When the threaded connector has an outer thread engaging with an inner thread of a nut of the coaxial cable connector, the metal sheet of the threaded connector is configured to contact an inner sleeve of the coaxial cable connector, wherein the inner sleeve comprises an outer flange configured to be between an inner flange of the nut and the metal sheet of the threaded connector.

In an expanded position, the metal sheet of the threaded connector inclines to a side away from the main body of the inner sleeve.

These, as well as other components, steps, features, benefits, and advantages of the present disclosure, will now become clear from a review of the following detailed description of illustrative embodiments, the accompanying drawings, and the claims.

BRIEF DESCRIPTION OF THE DRAWINGS

The drawings disclose illustrative embodiments of the present disclosure. They do not set forth all embodiments. Other embodiments may be used in addition or instead. Details that may be apparent or unnecessary may be omitted to save space or for more effective illustration. Conversely, some embodiments may be practiced without all of the details that are disclosed. When the same reference number or reference indicator appears in different drawings, it may refer to the same or like components or steps.

Aspects of the disclosure may be more fully understood from the following description when read together with the accompanying drawings, which are to be regarded as illustrative in nature, and not as limiting. The drawings are not necessarily to scale, emphasis instead being placed on the principles of the disclosure. In the drawings:

FIG. 5*i* is a front view showing positions of bending lines relative to the outer sleeve with two metal sheets before bent along the bending lines in accordance with the fourth embodiment of the present invention;

FIG. 6*l* is a cross-sectional view showing another coaxial cable connector assembled with the nut of FIG. 6*d* in accordance with the fifth embodiment of the present invention;

FIG. 7*l* is a front view showing another type of nut without any ring portion but with four bends in accordance with the sixth embodiment of the present invention;

Figure 1:
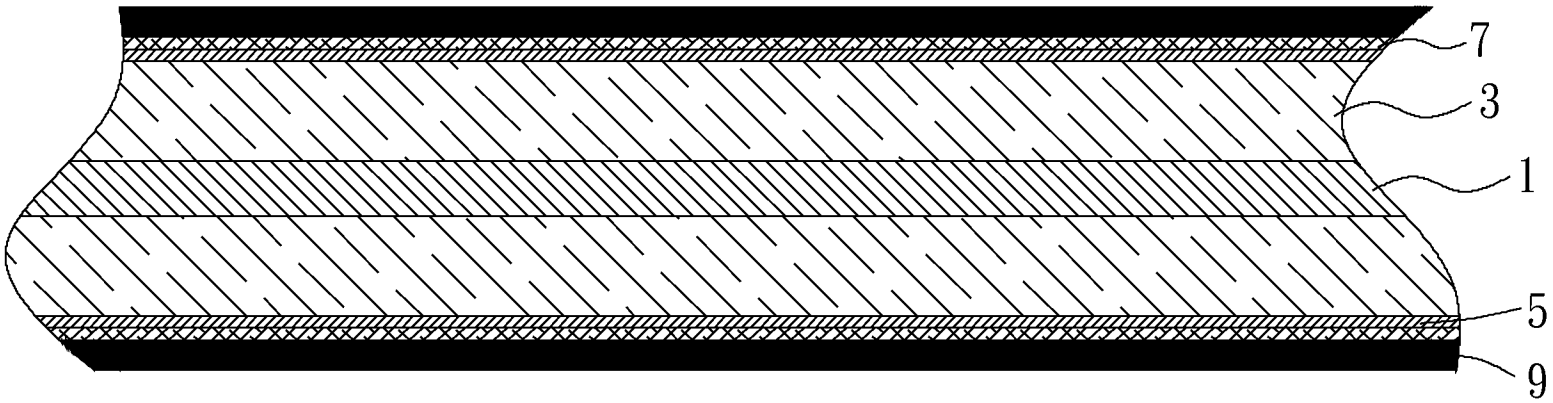
FIG. 1 is a cross-sectional view showing a coaxial cable in accordance with an embodiment of the present invention.

While certain embodiments are depicted in the drawings, one skilled in the art will appreciate that the embodiments depicted are illustrative and that variations of those shown, as well as other embodiments described herein, may be envisioned and practiced within the scope of the present disclosure.

DETAILED DESCRIPTION OF THE INVENTION

Illustrative embodiments are now described. Other embodiments may be used in addition or instead. Details that may be apparent or unnecessary may be omitted to save space or for a more effective presentation. Conversely, some embodiments may be practiced without all of the details that are disclosed.

The present invention provides a coaxial cable connector, wherein a cross-sectional view showing a coaxial cable is in FIG. 1. Referring to FIG. 1, the coaxial cable includes a metal wire 1, an insulating layer 3 enclosing the metal wire 1, a thin metal film 5 enclosing the insulating layer 3, a metal braided film 7 enclosing the thin metal film 5 and a plastic jacket 9 enclosing the metal braided film 7. The metal wire 1 may be made of copper, iron, silver, nickel, tin, gold, a copper-gold alloy, a copper-tin alloy, a copper-nickel alloy or an electrically conductive polymer or a non-metallic conductor. The thin metal film 5 may be made of an aluminum-containing layer, copper-containing layer or another electrically conductive layer, such as aluminum or copper foil. The thin metal film 5 has an electrical shielding effect to avoid signal interference. The metal braided film 7 may be one of various types of braid, such as double-layered braid, triple-layered braid or quad-layered braid. The metal braided film 7 may be made of aluminum, an aluminum alloy, copper or a copper alloy.

The present invention provides multiple embodiments with features that may be combined, mentioned in sequence as below:

First Embodiment

Figure 2A:
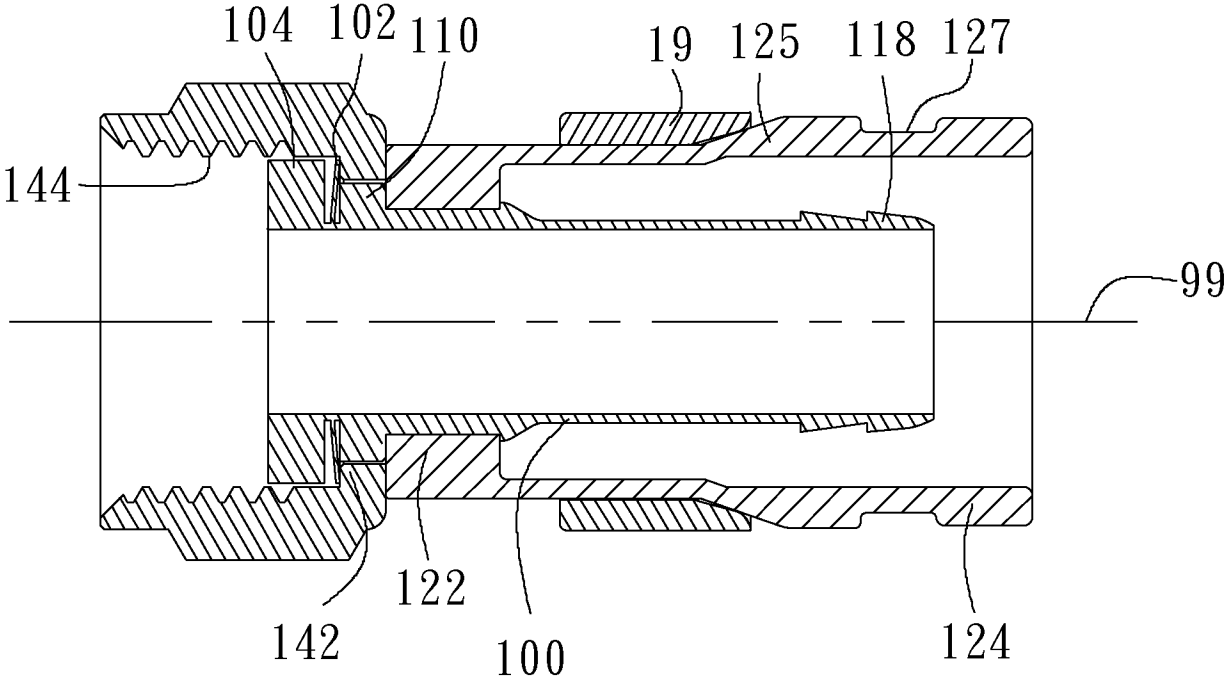
FIG. 2*a* is a cross-sectional view showing a coaxial cable connector in accordance with a first embodiment of the present invention.
Figure 2B:
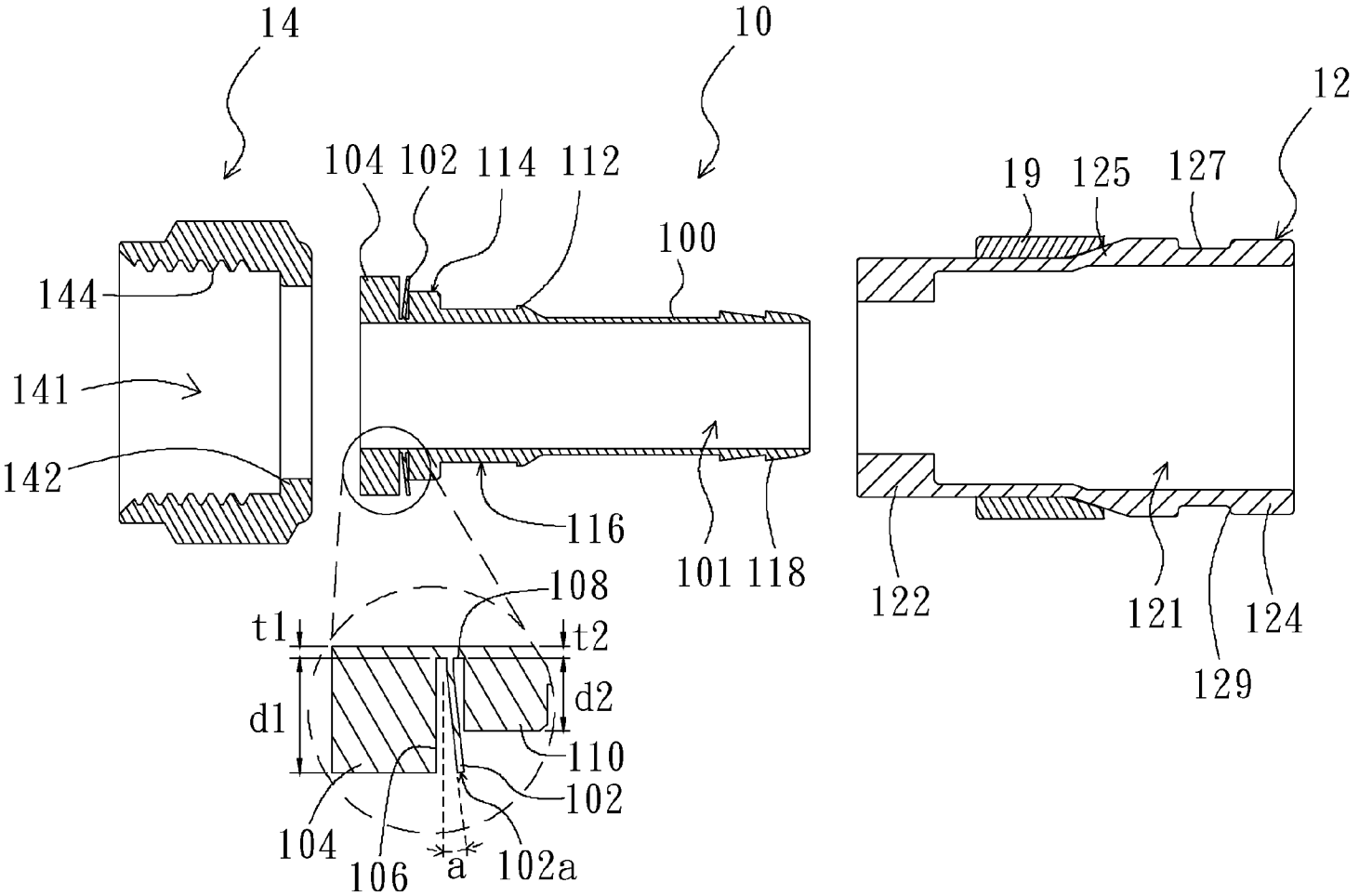
FIG. 2*b* is a cross-sectional exploded view showing the coaxial cable connector in accordance with the first embodiment of the present invention.
Figure 2C:
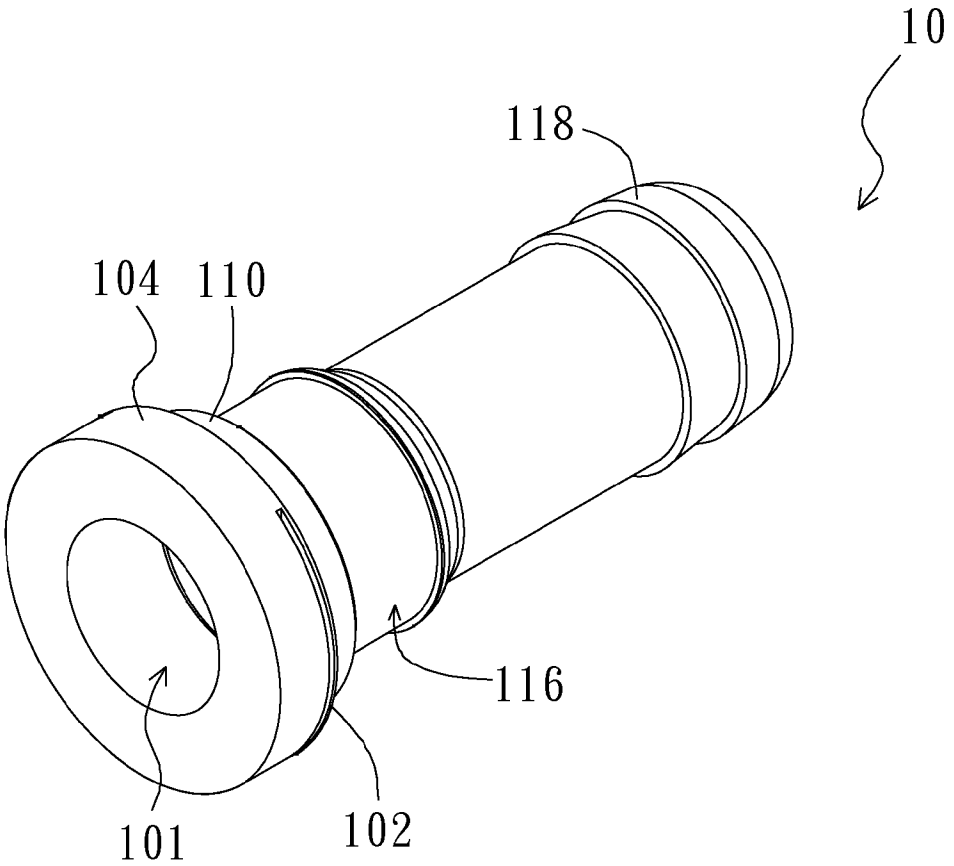
FIG. 2*c* is a perspective view showing an inner sleeve in accordance with the first embodiment of the present invention.
Figure 2E:
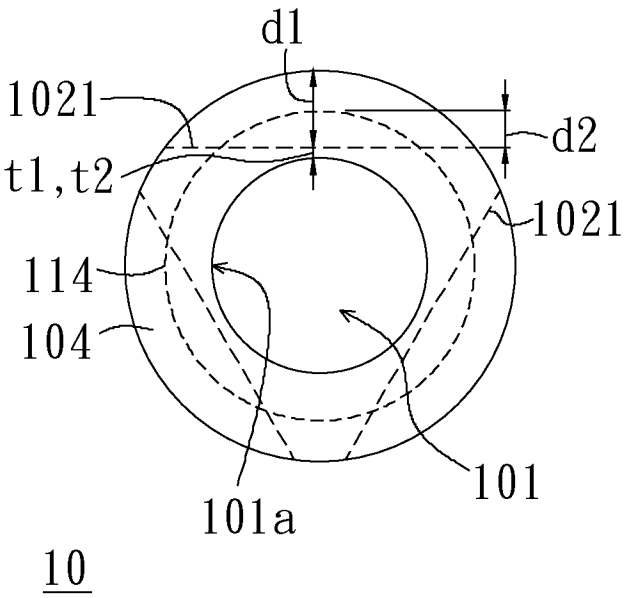
FIGS. 2*d* and 2*e* are front views showing positions of bending lines relative to inner sleeves with various numbers of metal sheets in accordance with the first embodiment of the present invention.
Figure 2D:
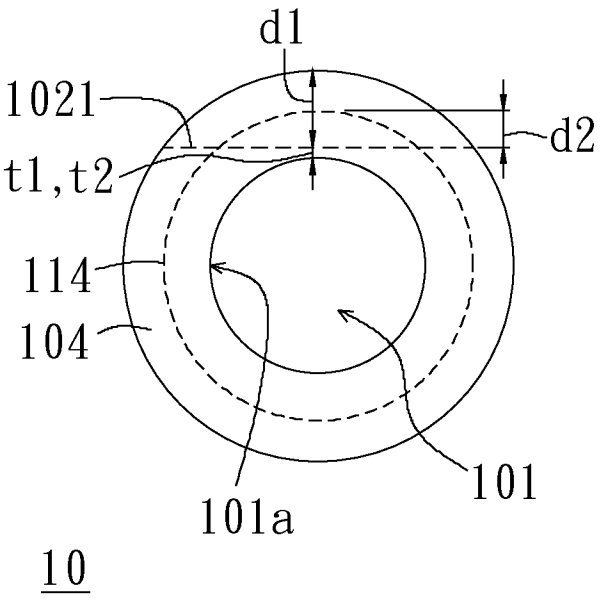

FIG. 2*a* is a cross-sectional view showing a coaxial cable connector in accordance with a first embodiment of the present invention. FIG. 2*b* is a cross-sectional exploded view showing the coaxial cable connector in accordance with the first embodiment of the present invention. FIG. 2*c* is a perspective view showing an inner sleeve in accordance with the first embodiment of the present invention. FIG. 2*i* is a front view showing positions of bending lines of two metal sheets relative to the inner sleeve in accordance with the first embodiment of the present invention. Referring to FIGS. 2*a*, 2*b*, 2*c* and 2*i*, the coaxial cable connector includes an inner sleeve 10, an outer sleeve 12, a nut 14 and a metal ring 19 coaxially arranged with respect to an axis 99 of the inner sleeve 10. Either one of the inner sleeve 10, nut 14 and metal ring 19 may be made of an electrically conductive material, such as copper, iron, silver, nickel, tin, gold, a copper-gold alloy, a copper-tin alloy, a copper-nickel alloy or an electrically conductive polymer or a non-metallic conductor. An antirust metal layer that is an electrically conductive material, such as copper, iron, silver, nickel, tin, gold, a copper-gold alloy, a copper-tin alloy, a copper-nickel alloy, an electrically conductive polymer or a non-metallic material, may be coated, electroplated or electroless plated on a surface of the inner sleeve 10, nut 14 and metal ring 19. The outer sleeve 12 may be made of a plastic material or an organic polymer. Alternatively, the outer sleeve 12 may be made of a metallic material, such as copper, iron, silver, nickel, tin, gold, a copper-gold alloy, a copper-tin alloy or a copper-nickel alloy, an electrically conductive polymer or a non-metallic material.

Referring to FIGS. 2*a*, 2*b*, 2*c* and 2*i*, the inner sleeve 10 includes a main body 100 and two metal sheets 102 integral with the main body 100. The inner sleeve may include a first outer flange 104 protruding annularly in radial outward directions and a second outer flange 110 protruding annularly in radial outward directions. A blade may be used to cut into the inner sleeve 10 from the first outer flange 104 so as to form two first empty gaps 106 in the first outer flange 104 and symmetrically at opposite sides of the first outer flange 104 with respect to the axis 99 of the inner sleeve 10 and form the two metal sheets 102 at a rear side of the first outer flange 104. Each of the two first empty gaps 106 is between a front portion of the first outer flange 104 and a corresponding one of the two metal sheets 102. Each of the two first empty gaps 106 may have a bottom connecting two opposite sidewalls of said each of the two first empty gaps 106 and extending in a corresponding longitudinal direction.

Referring to FIGS. 2*a*, 2*b*, 2*c* and 2*i*, a blade may be used to cut into the inner sleeve 10 from the second outer flange 110 at its border to the first outer flange 104 so as to form two second empty gaps 108 in the second outer flange 110 at the border between the first outer flange 104 and the second outer flange 110. Each of the two second empty gaps 108 may have a bottom connecting two opposite sidewalls of said each of the two first empty gaps 108 and extending in the corresponding longitudinal direction. Thereby, the two first empty gaps 106 are at front sides of the two metal sheets 102 respectively and the two second empty gaps 108 are at rear sides of the two metal sheets 102 respectively. A wall between the bottom of each of the first empty gaps 106 and an annular surface 101*a* of a hole 101 extending through the inner sleeve 10 in an axial direction of the inner sleeve 10 has a first minimum thickness t1, perpendicular to the axis 99 of the inner sleeve 10, substantially equal to a second minimum thickness t2, perpendicular to the axis 99 of the inner sleeve 10, of a wall between the bottom of each of the second empty gaps 108 and the annular surface 101*a* of the hole 101, wherein each of the first and second minimum thicknesses may range from 0.1 mm to 3 mm, and more particularly, range from 0.1 mm to 1 mm. Alternatively, the first minimum thickness t1 may be greater than the second minimum thickness t2. Alternatively, the first minimum thickness t1 may be less than the second minimum thickness t2. Each of the metal sheets 102 may have a bottom extending in the corresponding longitudinal direction and joining the maim body 100. Each of the two metal sheets 102 is bent along a corresponding bending line 1021, i.e. at the bottom of said each of the two metal sheets 102, to a side far away from the front portion of the first outer flange 104, i.e. to the second outer flange 110. Accordingly, each of the metal sheets 102 inclines to the side far away from the front portion of the first outer flange 104, i.e. to the second outer flange 110. Either of the metal sheets 102 may have an arcuate outer periphery 102*a* with a radian ranging from 30 degrees to 150 degrees with respect to the axis 99 of the inner sleeve 10. Each of the metal sheets 102 extends in a first plane at an acute angle a to a second plane normal to the axis 99 of the inner sleeve 10. The acute angle a may range from 5 degrees to 80 degrees, and more particularly ranging from 10 degrees to 40 degrees, ranging from 15 degrees to 60 degrees, or ranging from 20 degrees to 80 degrees, for example.

Referring to FIGS. 2*a*, 2*b*, 2*c* and 2*i*, each of the two metal sheets 102 may have a thickness between 0.1 and 3 mm, and more particularly between 0.1 and 1.5 mm, between 0.3 and 2 mm, or between 0.5 and 3 mm, for example. Each of the first empty gaps 106 may become gradually wide from the bottom of said each of the first empty gaps 106 out away from a diameter of the inner sleeve 10 parallel to the corresponding longitudinal direction, and each of the second empty gaps 108 may become gradually narrow from the bottom of said each of the second empty gaps 108 out away from a diameter of the inner sleeve 10 parallel to the corresponding longitudinal direction. Cut by a plane having the axis 99 of the inner sleeve 10 extending thereon and being normal to the corresponding longitudinal direction, each of the first empty gaps 106 may have a first axial spacing distance between the arcuate outer periphery 102*a* of the corresponding metal sheet 102 and the front portion of the first outer flange 104 of the inner sleeve 10 may be greater than a first width of said each of the two first empty gaps 106 at its bottom, wherein the first width may be between 0.1 mm and 2 mm, and more particularly between 0.1 mm and 1 mm, between 0.3 and 1.5 mm or between 0.5 and 2 mm, for example, and the first axial spacing distance may be between 0.1 mm and 2 mm, and more particularly between 0.1 mm and 1 mm, between 0.3 and 1.5 mm or between 0.5 and 2 mm, for example. Cut by the plane, each of the second empty gaps 108 may have a second axial spacing distance between the corresponding metal sheet 102 and an arcuate outer periphery of the second outer flange 110 of the inner sleeve 10 may be less than a second width of said each of the two second empty gaps 108 at its bottom, wherein the second width may be between 0.1 mm and 2 mm, and more particularly between 0.1 mm and 1 mm, between 0.3 and 1.5 mm or between 0.5 and 2 mm, for example, and the second axial spacing distance may be between 0.1 mm and 2 mm, and more particularly between 0.1 mm and 1 mm, between 0.3 and 1.5 mm or between 0.5 and 2 mm, for example. Alternatively, each of the metal sheets 102 may contact the outer periphery of the second outer flange 110. Cut by the plane, each of the first empty gaps 106 may have a maximum depth d1 between 0.5 and 2 mm for example. Cut by the plane, each of the second empty gaps 108 may have a maximum depth d2 between 0.25 and 1 mm for example. Cut by the plane, a radial distance between the arcuate outer periphery 102*a* of each of the two metal sheets 102 and the axis 99 of the inner sleeve 10 may be substantially equal to or less than that between a cylindrical outer periphery of the front portion of the first outer flange 104 and the axis 99 of the inner sleeve 10 and greater than that between a cylindrical outer periphery of the second outer flange 110 and the axis 99 of the inner sleeve 10.

In this embodiment, the number of the metal sheets 102 of the inner sleeve 10 is two for illustration. Alternatively, the inner sleeve 10 may include any number, such as one or three, of metal sheets 102 integral with the main body 100. FIGS. 2*d* and 2*e* are front views showing positions of bending lines relative to inner sleeves with various numbers of metal sheets in accordance with the first embodiment of the present invention. For example, the inner sleeve 10 may include one metal sheet 102 integral with the main body 100, as illustrated in FIG. 2*d*. The inner sleeve 10 may include three metal sheets 102 integral with the main body 100, as illustrated in FIG. 2*e*.

Each of the three metal sheets 102 in FIG. 2*e* may have the bottom extending in a corresponding longitudinal direction and joining the maim body 100 and may have the same feature as illustration for one of the two metal sheets 102 in FIGS. 2*a*, 2*b*, 2*c* and 2*i*. Referring to FIGS. 2*b* and 2*e*, each of the three metal sheets 102 may be bent along the bending line 1021, i.e. at the bottom of said each of the three metal sheets 102, to the side far away from the front portion of the outer flange 104, i.e. to the second outer flange 110, with the acute angle a.

The metal sheet 102 in FIG. 2*d* may have the bottom extending in a longitudinal direction and joining the maim body 100 and may have the same feature as illustration for one of the two metal sheets 102 in FIGS. 2*a*, 2*b*, 2*c* and 2*i*. Referring to FIGS. 2*b* and 2*d*, the metal sheet 102 may be bent along the bending line 1021, i.e. at the bottom of the metal sheet 102, to the side far away from the front portion of the outer flange 104, i.e. to the second outer flange 110, with the acute angle a.

Figure 2F:
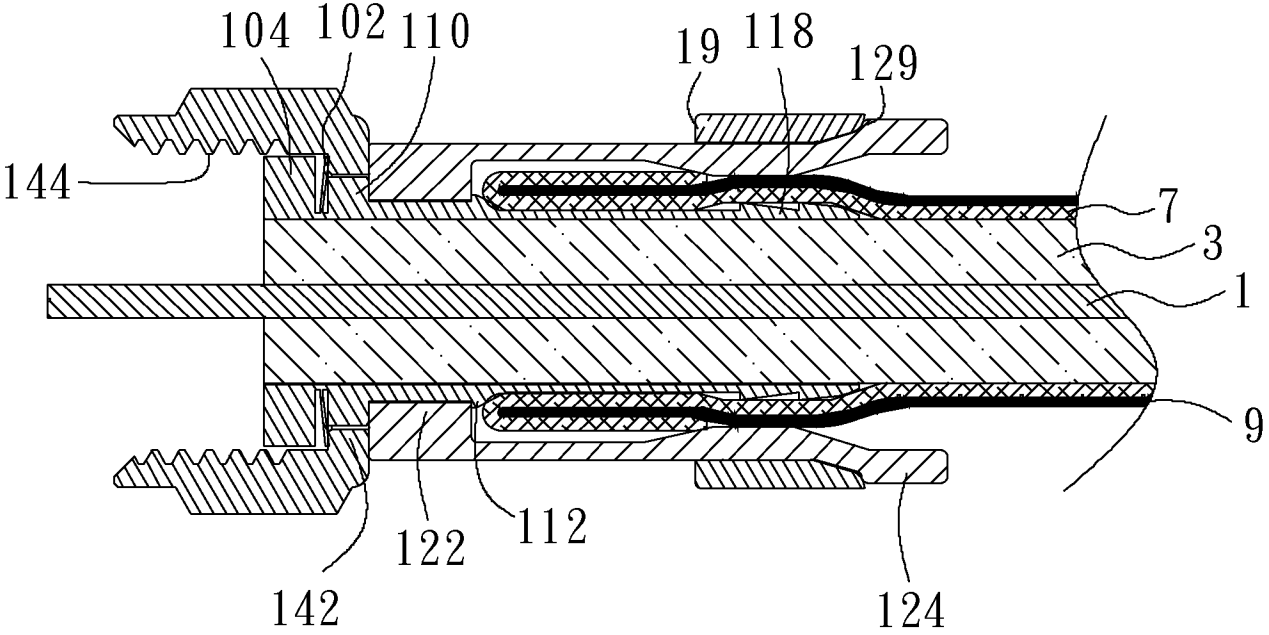
FIG. 2*f* is a cross-sectional view showing the coaxial cable connector assembled with a coaxial cable in accordance with the first embodiment of the present invention.

Referring to FIGS. 2*a* and 2*f*, the outer sleeve 124 includes a rear extension portion 124 with an inner diameter greater than an outer diameter of a rear extension portion 118 of the main body 100 of the inner sleeve 10 so as to from an annular space between the rear extension portions 118 and 124 for receiving the plastic jacket 9 and metal braided film 7 of the coaxial cable illustrated in FIG. 1. A hole 141 in the nut 14 is configured to receive a threaded connector 500 of an electronic device. The nut 14 is formed with an inner thread 144 configured to engage with an outer thread 502 of the threaded connector 500 shown in FIGS. 2*g* and 2*h*. The nut 14 includes an outer hexagonal section configured to engage with a wrench or a similar tool for locking the coaxial cable connector to the threaded connector 500. Alternatively, the nut 14 may be a square nut, circular nut or wing nut.

Referring to FIGS. 2*a*-2*f* and 2*i*, each of the metal sheets 102 may be made of an electrically conductive material, such as copper, iron, silver, nickel, tin, gold, a copper-gold alloy, a copper-tin alloy, a copper-nickel alloy or an electrically conductive polymer or a non-metallic conductor. An antirust metal layer that is an electrically conductive material, such as copper, iron, silver, nickel, tin, gold, a copper-gold alloy, a copper-tin alloy, a copper-nickel alloy, an electrically conductive polymer or a non-metallic material, may be coated, electroplated or electroless plated on a surface of said each of the metal sheets 102.

Referring to FIGS. 2*a*-2*e*, for assembling the coaxial cable connector, the metal ring 19 may be first arranged around the outer sleeve 12. The metal ring 19 has an inner cone surface at a rear side thereof and has an inner diameter gradually increasing in a rearward direction, wherein a first slope angle between the inner cone surface and an axis of the metal ring 19, collinear with the axis 99 of the inner sleeve 10, may range from 5 degrees to 45 degrees. Before the coaxial cable connector is assembled with the coaxial cable, the outer sleeve 12 includes an annular deformable portion 125 with an outer cone surface engaging with and abutting against the inner cone surface of the metal ring 19, wherein a second slope angle between the outer cone surface and an axis of the outer sleeve 12, collinear with the axis of the metal ring 19 and the axis 99 of the inner sleeve 10, may range from 5 degrees to 45 degrees and may be substantially equal to the first slope angle. A trench 127 is annularly formed in the outer sleeve 12 and at a rear side of the deformable portion 126 such that the deformable portion 126 is easily deformed.

Referring to FIG. 2*a*, for assembling the coaxial cable connector, the inner sleeve 10 may have the rear extension portion 118 to be first inserted from a front end of the nut 14 into the hole 141 in the nut 14 until the two metal sheets 102 may abut against and contact an inner flange 142 of the nut 14 and the inner flange 142 of the nut 14 may be arranged around a cylindrical surface 114 of the second outer flange 110 of the inner sleeve 10, wherein the inner flange 142 protrudes annularly in radial inward directions. After the nut 14 is assembled with the inner sleeve 10, the inner sleeve 10 may have the rear extension portion 118 to be inserted from a front end of the outer sleeve 12 into a hole 121 in the outer sleeve 12 assembled with the metal ring 19 until the outer sleeve 12 has an inner flange 122, protruding annularly in radial inward directions, engaging with a trench 116 annularly formed in the inner sleeve 10 and between the second outer flange 110 of the inner sleeve 10 and a third outer flange 112 of the inner sleeve 10, wherein the third outer flange 112 protrudes annularly in radial outward directions. Thereby, the inner flange 142 of the nut 14 may be arranged between the metal sheets 102 and the outer sleeve 12 in an axial direction so as to restrict the nut 14 not to move in the axial direction around the inner sleeve 10, but the nut 14 may rotate around the inner sleeve 10. Furthermore, each of the metal sheets 102 may abut against and contact the inner flange 142 of the nut 14 with the acute angle a between said each of the metal sheets 102 and a radial direction perpendicular to the axis 99 of the inner sleeve 10 so as to electrically connect the inner sleeve 10 to the nut 14 for ground connection even when the coaxial cable connector is not fully locked to the threaded connector 500 shown in FIG. 2*g*.

FIG. 2*f* is a cross-sectional view showing the coaxial cable connector assembled with a coaxial cable in accordance with the first embodiment of the present invention. Referring to FIG. 2*f*, for assembling the coaxial cable as illustrated in FIG. 1 with the axial cable connector, the metal braided film 7 has a front portion folded back over an outer surface of the plastic jacket 9. Next, the coaxial cable has the metal wire 1, insulating layer 3 and thin metal film 5 to be inserted from a back end of the inner sleeve 10 into the hole 101 in the inner sleeve 10 and the folded front portion of the metal braided film 7 and the plastic jacket 9 are inserted from a back end of the outer sleeve 12 into the annular space between the rear extension portion 118 of the inner sleeve 10 and the rear extension portion 124 of the outer sleeve 124. The metal wire 1 extends through the hole 101 in the inner sleeve 10 and to a space, surrounded by the inner thread 144 of the nut 14, outside the hole 101. Next, the metal ring 19 may move backwards in the axial direction around the outer sleeve 12 such that the deformable portion 125 of the outer sleeve 12 may deform in radial inward directions to press the plastic jacket 9 of the coaxial cable with the outer sleeve 12 having a deformed cone surface, which was at a bottom of the trench 127 before the outer sleeve 12 is deformed, engaging with and abutting against the inner cone surface of the metal ring 19, wherein a third slope angle between the deformed cone surface and the axis of the outer sleeve 12 may range from 5 degrees to 45 degrees and may be substantially equal to the first slope angle. Thereby, the coaxial cable may be fixed with the coaxial cable connector. At this time, the metal ring 19 has a rear end abutting against a step 129 of the outer sleeve 12, which was at a rear wall of the trench 127 before the deformable portion 125 is deformed in the radial inward directions.

Figure 2G:
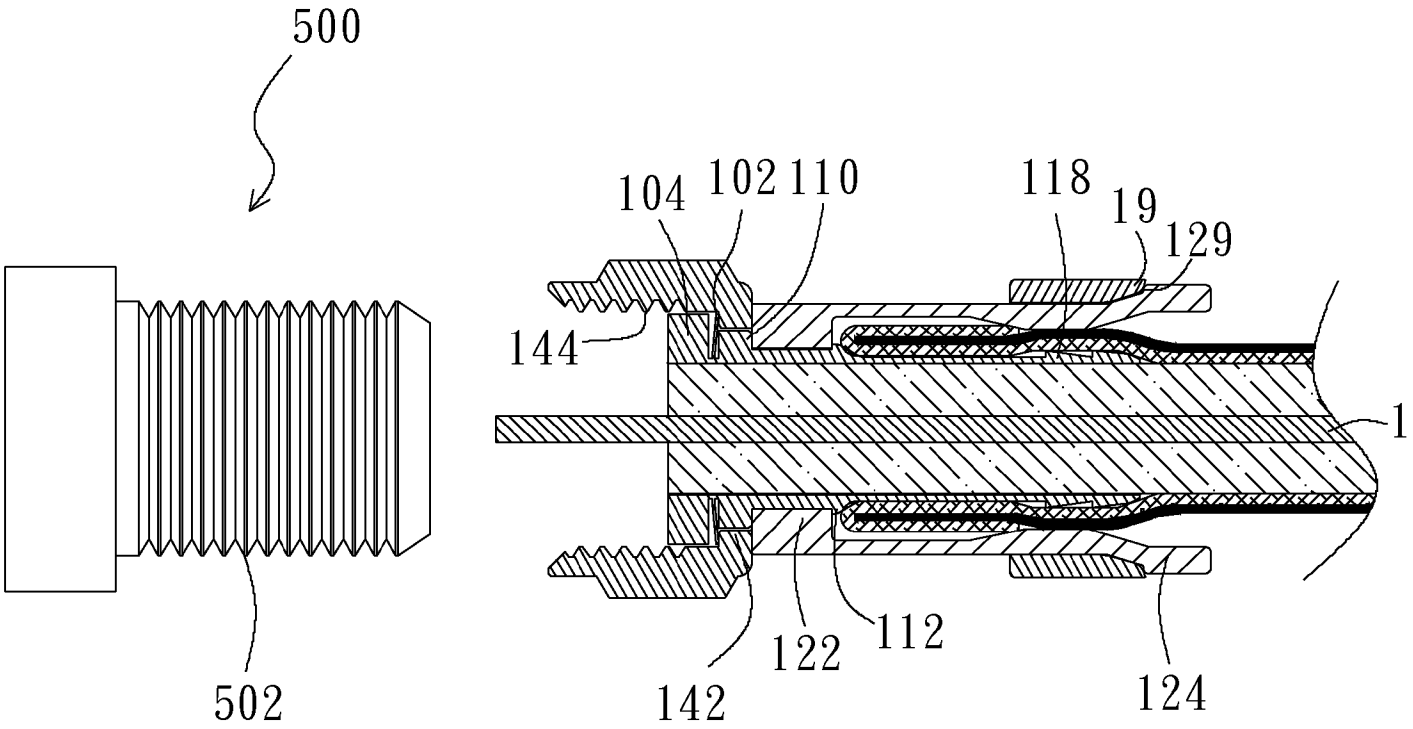
FIGS. 2*g* and 2*h* are cross-sectional views showing the coaxial cable connector before and after assembled with a threaded connector in accordance with the first embodiment of the present invention.
Figure 2H:
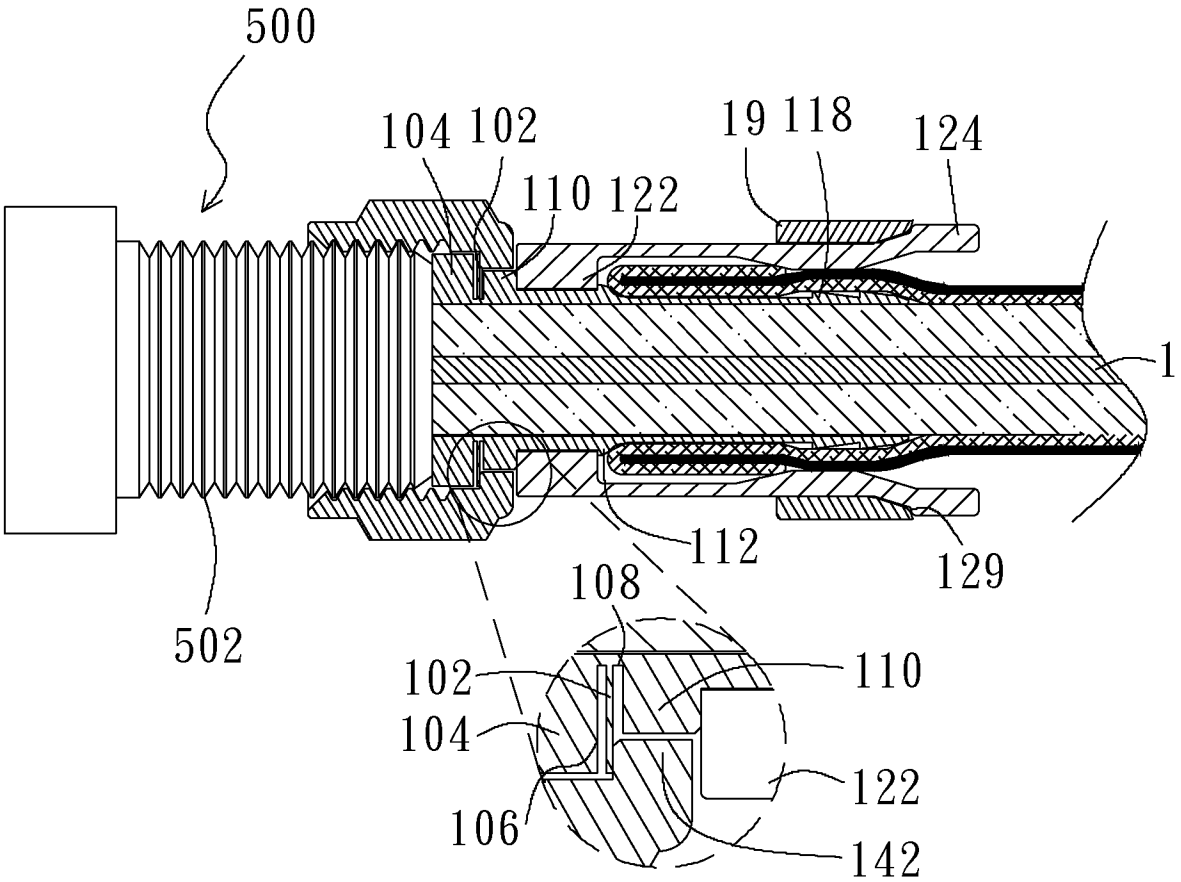
Figure 2I:
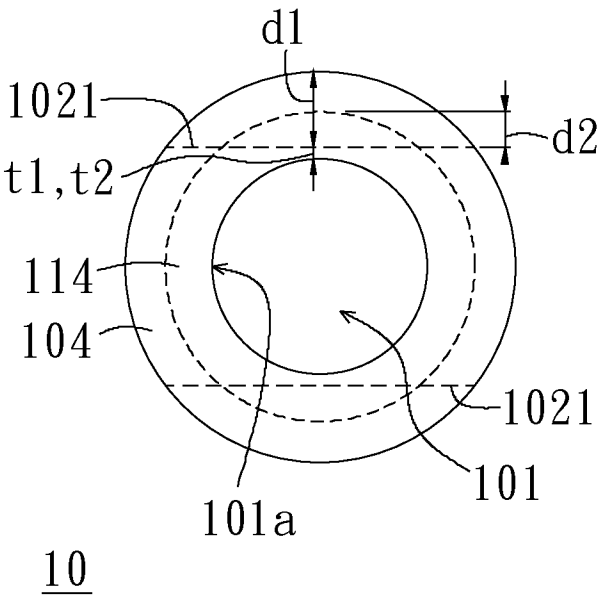
FIG. 2*i* is a front view showing positions of bending lines relative to the inner sleeve with two metal sheets in accordance with the first embodiment of the present invention.

FIGS. 2*g* and 2*h* are cross-sectional views showing the coaxial cable connector before and after assembled with a threaded connector in accordance with the first embodiment of the present invention. Referring to FIGS. 2*g* and 2*h*, the coaxial cable connector may be locked to the treaded connector 500 mounted on an electronic device or an adapter, such as a T-shaped or F-shaped adaptor, for connecting the coaxial cable to another coaxial cable. The coaxial cable fixed with the coaxial cable connector may have the metal wire 1 to be inserted into a hole in the threaded connector 500 and the nut 14 has the inner thread 144 engaging with the outer thread 502 of the threaded connector 500 so as to be screwed on the threaded connector 500. When the nut 14 is being screwed on the threaded connector 500, the first outer flange 104 of the inner sleeve 10 may move to the threaded connector 500 in the axial direction. Before the first outer flange 104 of the inner sleeve 10 contacts the threaded connector 500, the metal sheets 102 may press the inner flange 142 of the nut 14 such that the nut 14 abuts against the outer sleeve 12. After the first outer flange 104 of the inner sleeve 10 contacts the threaded connector 500, the nut 14 may continue to be screwed on the threaded connector 500 such that each of the metal sheets 102 may be bent by the inner flange 142 of the nut 14 with the angle a becoming gradually small and the nut 14 does not contact the outer sleeve 12. When the nut 14 is fully locked to the threaded connector 500, the angle a may be substantially 0 degrees or each of the metal sheets 102 may even incline to the front portion of the first outer flange 104, and the inner flange 142 of the nut 14 may abut against and contact the first outer flange 104 of the inner sleeve 10. Thereby, the metal sheets 102 may always contact the inner flange 142 of the nut 14 so as to provide good electrical or ground connection between the inner sleeve 10 and the nut 14. Even when the coaxial cable is casually pulled such that the nut 14 is not fully locked to the threaded connector 500, good electrical or ground connection between the inner sleeve 10 and the nut 14 may still be provided by the metal sheets 102. Accordingly, the coaxial cable connector may transmit signals with improved quality.

Second Embodiment

Figure 3A:
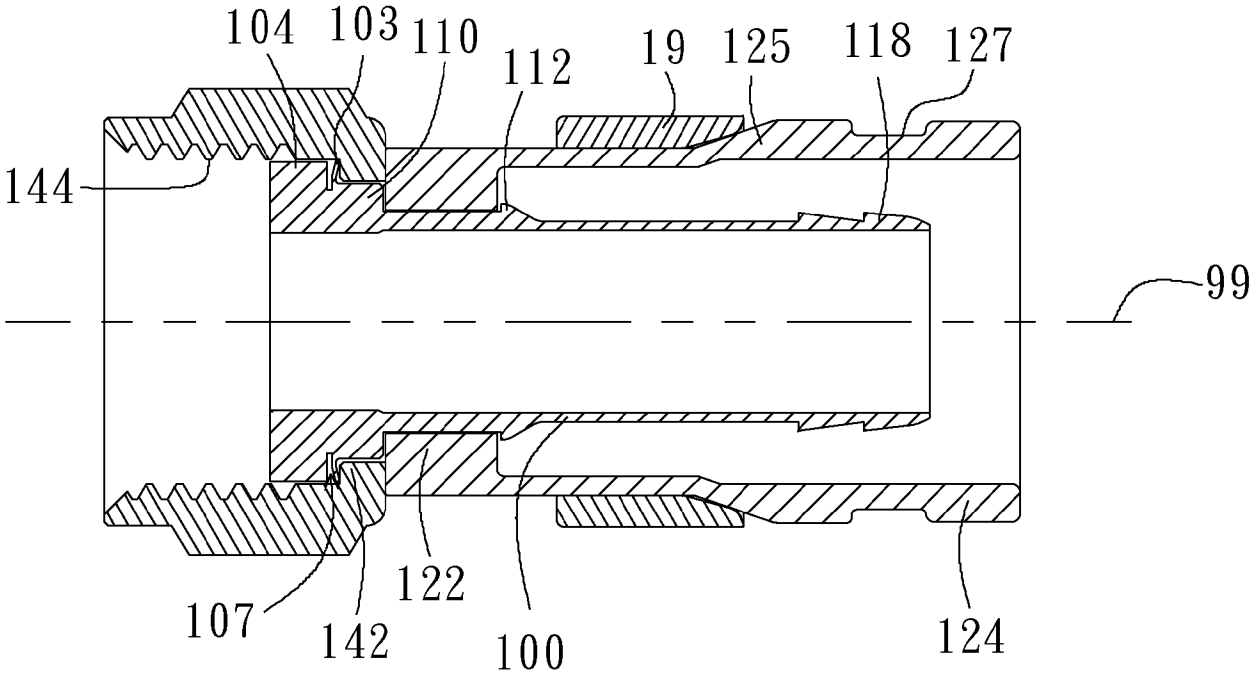
FIG. 3*a* is a cross-sectional view showing a coaxial cable connector in accordance with a second embodiment of the present invention.
Figure 3B:
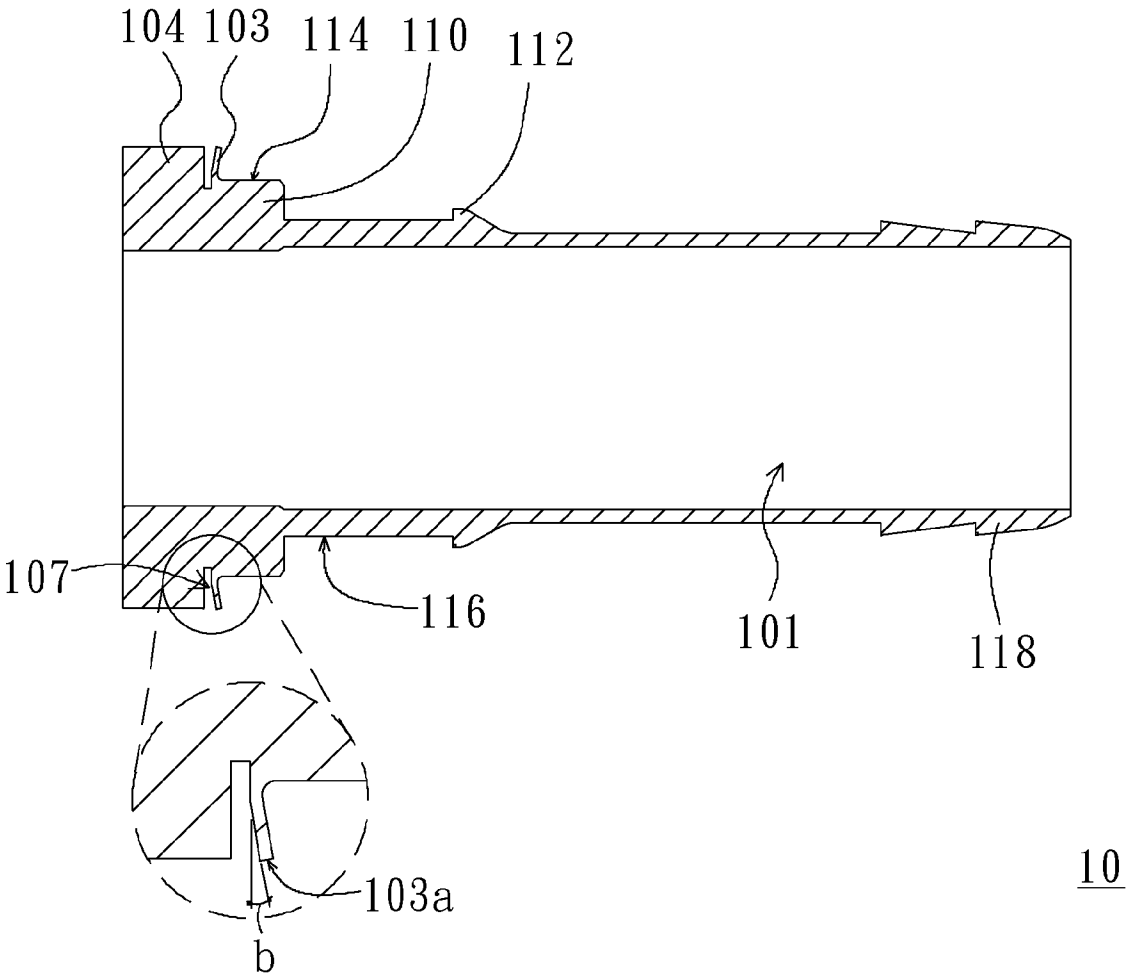
FIG. 3*b* is a cross-sectional view showing an inner sleeve in accordance with the second embodiment of the present invention.
Figure 3D:
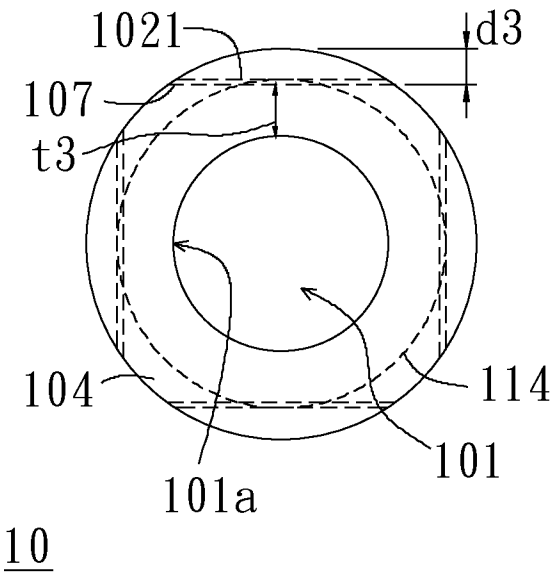
FIGS. 3*c* and 3*d* are front views showing positions of bending lines relative to inner sleeves with various numbers of metal sheets in accordance with the second embodiment of the present invention.
Figure 3C:
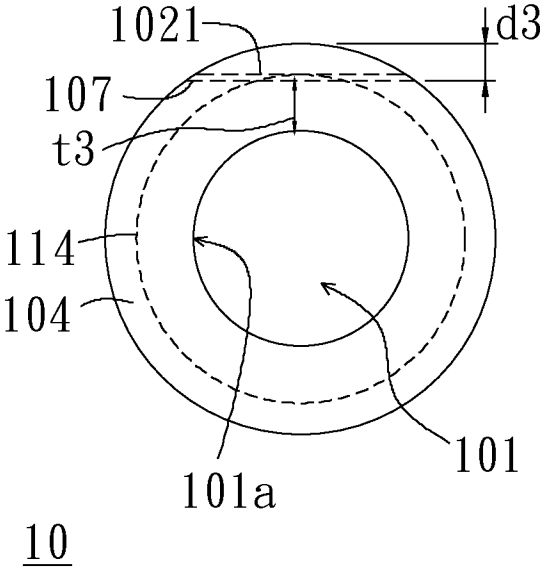

FIG. 3*a* is a cross-sectional view showing a coaxial cable connector in accordance with a second embodiment of the present invention. FIG. 3*b* is a cross-sectional view showing an inner sleeve in accordance with the second embodiment of the present invention. FIG. 3*f* is a front view showing positions of bending lines of two metal sheets relative to the inner sleeve in accordance with the second embodiment of the present invention. Elements in the second embodiment having the same reference number as those in the first embodiment may refer to those illustrated in the first embodiment. Referring to FIGS. 3*a*, 3*b* and 3*f*, the difference between the first and second embodiments is that the inner sleeve 10 in the second embodiment has no second empty gaps 108 illustrated in the first embodiment in the second outer flange 110 at the border between the first outer flange 104 and the second outer flange 110. A blade may be used to cut into the inner sleeve 10 from the first outer flange 104 so as to form two empty gaps 107 in the first outer flange 104 and symmetrically at opposite sides of the first outer flange 104 with respect to the axis 99 of the inner sleeve 10 and form the two metal sheets 103 at a rear side of the first outer flange 104. Thereby, the inner sleeve 10 may include the two metal sheets 103 integral with the main body 100 of the inner sleeve 10. Each of the two metal sheets 103 may have a bottom extending in a corresponding longitudinal direction and joining the maim body 100. Each of the two empty gaps 107 may have a bottom connecting two opposite sidewalls of said each of the two first empty gaps 107 and extending in the corresponding longitudinal direction. Each of the two metal sheets 103 may have a thickness between 0.1 and 3 mm, and more particularly between 0.1 and 1.5 mm, between 0.3 and 2 mm, or between 0.5 and 3 mm, for example. Each of the two metal sheets 103 may have an arcuate outer periphery 103*a* with a radian ranging from 30 degrees to 135 degrees for example with respect to the axis 99 of the inner sleeve 10.

Referring to FIGS. 3*a* and 3*b*, each of the two metal sheets 103 may be bent along a corresponding bending line, tangent to the cylindrical surface 114 of the second outer flange 110, to the side far away from the front portion of the outer flange 104. Accordingly, each of the two empty gaps 107 may become gradually wide from the bottom of said each of the two empty gaps 107 out away from a diameter of the inner sleeve 10 parallel to the corresponding longitudinal direction. Cut by a plane having the axis 99 of the inner sleeve 10 extending thereon and being normal to the corresponding longitudinal direction, each of the two empty gaps 107 may have an axial distance between the arcuate outer periphery 103*a* of the corresponding metal sheet 103 and the front portion of the first outer flange 104 of the inner sleeve 10 may be greater than a width of said each of the two empty gaps 107 at its bottom, wherein the width may be between 0.1 mm and 2 mm, and more particularly between 0.1 mm and 1 mm, between 0.3 and 1.5 mm or between 0.5 and 2 mm, for example, and the axial distance may be between 0.1 mm and 2 mm, and more particularly between 0.1 mm and 1 mm, between 0.3 and 1.5 mm or between 0.5 and 2 mm, for example. Cut by the plane, each of the two empty gaps 107 may have a depth d3, perpendicular to the axis 99 of the inner sleeve 10, between 0.25 and 1 mm for example. Accordingly, each of the metal sheets 103 may incline to the side far away from the front portion of the first outer flange 104. Cut by the plane, an angle b between each of the metal sheets 103 and a radial direction perpendicular to the axis 99 of the inner sleeve 10 is an acute angle ranging from 5 degrees to 80 degrees, and more particularly ranging from 10 degrees to 40 degrees, ranging from 15 degrees to 60 degrees, or ranging from 20 degrees to 80 degrees, for example. A wall between the bottom of each of the empty gaps 107 and the annular surface 101*a* of the hole 101 passing through the inner sleeve 10 in an axial direction has an minimum thickness t3, perpendicular to the axis 99 of the inner sleeve 10, may range from 0.1 mm to 3 mm, and more particularly, range from 0.1 mm to 1 mm. A radial distance between the arcuate outer periphery 103*a* of each of the two metal sheets 103 and the axis 99 of the inner sleeve 10 may be substantially equal to or less than that between the cylindrical outer periphery of the front portion of the first outer flange 104 and the axis 99 of the inner sleeve 10 and greater than that between a cylindrical outer periphery of the second outer flange 110 and the axis 99 of the inner sleeve 10.

In this embodiment, the number of the metal sheets 103 of the inner sleeve 10 is two for illustration. Alternatively, the inner sleeve 10 may include any number, such as one, three or four, of metal sheets 103 integral with the main body 100. FIGS. 3*c* and 3*d* are front views showing positions of bending lines relative to inner sleeves with various numbers of metal sheets in accordance with the second embodiment of the present invention. For example, the inner sleeve 10 may include one metal sheet 103 integral with the main body 100, as illustrated in FIG. 3*c*. The inner sleeve 10 may include four metal sheets 103 integral with the main body 100, as illustrated in FIG. 3*d*.

Each of the four metal sheets 103 in FIG. 3*d* may have the bottom extending in a corresponding longitudinal direction and joining the maim body 100 and may have the same feature as illustration for one of the two metal sheets 103 in FIGS. 3*a*, 3*b* and 3*f*. Referring to FIGS. 3*b* and 3*d*, each of the four metal sheets 103 may be bent along the bending line 1021, tangent to the cylindrical surface 114 of the second outer flange 110, to the side far away from the front portion of the outer flange 104 with the acute angle b.

The metal sheet 103 in FIG. 3*c* may have the bottom extending in a longitudinal direction and joining the maim body 100 and may have the same feature as illustration for one of the two metal sheets 103 in FIGS. 3*a*, 3*b* and 3*f*. Referring to FIGS. 3*b* and 3*c*, the metal sheet 103 may be bent along the bending line 1021, tangent to the cylindrical surface 114 of the second outer flange 110, to the side far away from the front portion of the outer flange 104 with the acute angle b.

Referring to FIGS. 3*a*-2*d* and 3*f*, each of the metal sheets 103 may be made of an electrically conductive material, such as copper, iron, silver, nickel, tin, gold, a copper-gold alloy, a copper-tin alloy, a copper-nickel alloy or an electrically conductive polymer or a non-metallic conductor. An antirust metal layer that is an electrically conductive material, such as copper, iron, silver, nickel, tin, gold, a copper-gold alloy, a copper-tin alloy, a copper-nickel alloy, an electrically conductive polymer or a non-metallic material, may be coated, electroplated or electroless plated on a surface of said each of the metal sheets 103.

The method of assembling the coaxial cable connector may be referred to that in accordance with the first embodiment. After assembling the coaxial cable connector, each of the metal sheets 103 may abut against and contact the inner flange 142 of the nut 14 with the acute angle b between said each of the metal sheets 103 and a radial direction perpendicular to the axis 99 of the inner sleeve 10 so as to electrically connect the inner sleeve 10 to the nut 14 for ground connection even when the coaxial cable connector is not fully locked to the threaded connector 500 shown in FIG. 3*e*. The inner flange 142 of the nut 14 may be arranged between the metal sheets 103 and the outer sleeve 12 in an axial direction so as to restrict the nut 14 not to move in the axial direction around the inner sleeve 10, but the nut 14 may rotate around the inner sleeve 10.

Figure 3E:
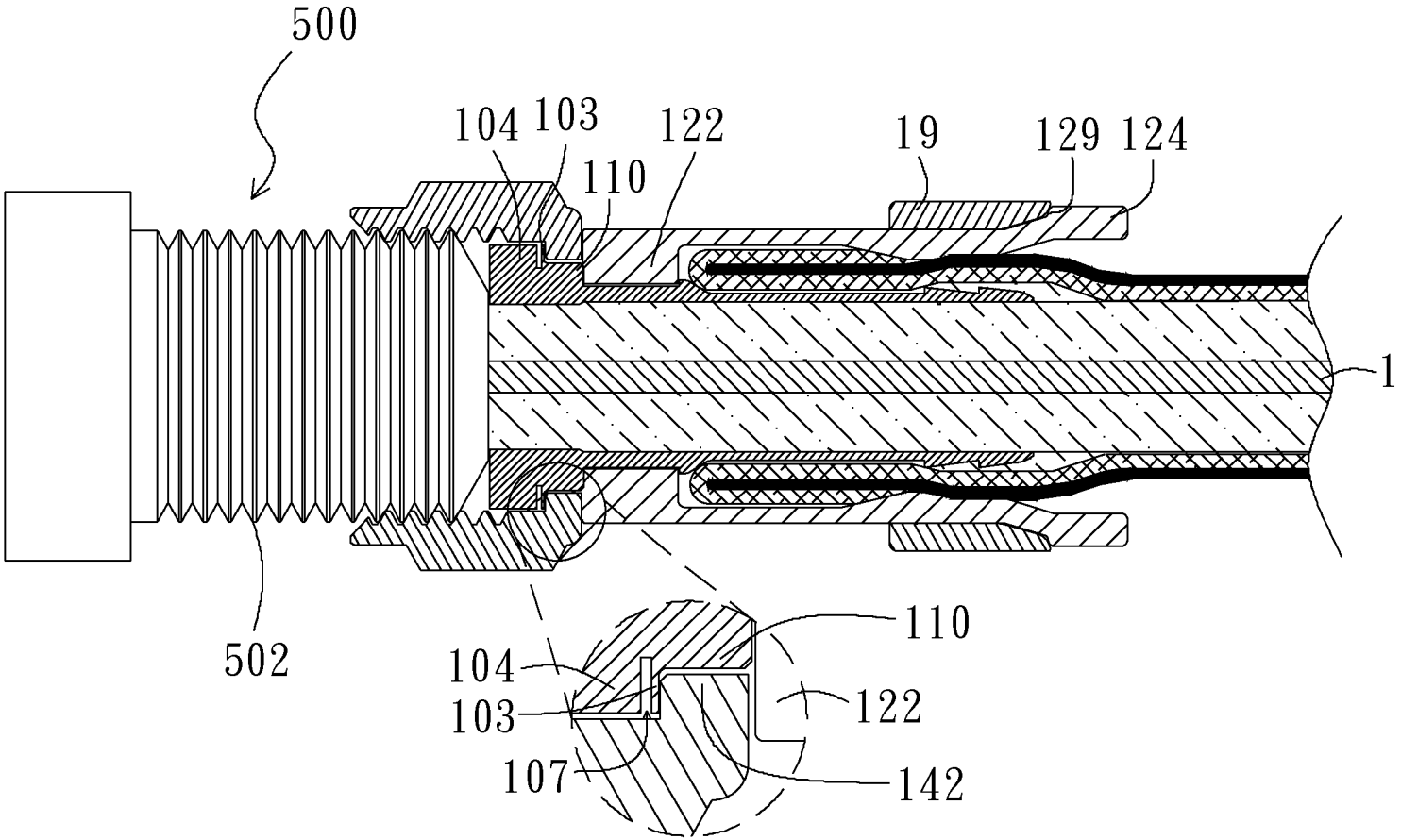
FIG. 3*e* is a cross-sectional view showing the coaxial cable connector assembled with a threaded connector in accordance with the second embodiment of the present invention.
Figure 3F:
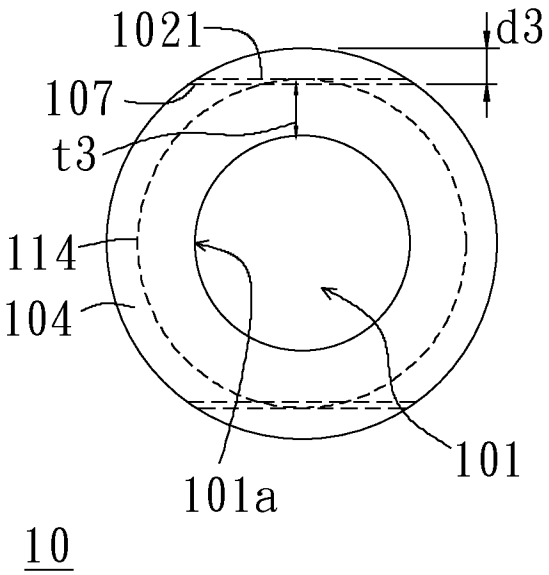
FIG. 3*f* is a front view showing positions of bending lines relative to the inner sleeve with two metal sheets in accordance with the second embodiment of the present invention.

FIG. 3*e* is a cross-sectional view showing the coaxial cable connector assembled with a threaded connector in accordance with the second embodiment of the present invention. Referring to FIG. 3*e*, the method of assembling the coaxial cable connector with a coaxial cable and the method of assembling the coaxial cable connector to the threaded connector 500 may be referred to those in accordance with the first embodiment. When the nut 14 is being screwed on the threaded connector 500, the first outer flange 104 of the inner sleeve 10 may move to the threaded connector 500 in the axial direction. Before the first outer flange 104 of the inner sleeve 10 contacts the threaded connector 500, the metal sheets 103 may press the inner flange 142 of the nut 14 such that the nut 14 abuts against the outer sleeve 12. After the first outer flange 104 of the inner sleeve 10 contacts the threaded connector 500, the nut 14 may continue to be screwed on the threaded connector 500 such that each of the metal sheets 103 may be bent by the inner flange 142 of the nut 14 with the angle b becoming gradually small and the nut 14 does not contact the outer sleeve 12. When the nut 14 is fully locked to the threaded connector 500, the angle b may be substantially 0 degrees or each of the metal sheets 103 may even incline to the front portion of the first outer flange 104, and the inner flange 142 of the nut 14 may abut against and contact the first outer flange 104 of the inner sleeve 10. Thereby, the metal sheets 103 may always contact the inner flange 142 of the nut 14 so as to provide good electrical or ground connection between the inner sleeve 10 and the nut 14. Even when the coaxial cable is casually pulled such that the nut 14 is not fully locked to the threaded connector 500, good electrical or ground connection between the inner sleeve 10 and the nut 14 may still be provided by the metal sheets 103. Accordingly, the coaxial cable connector may transmit signals with improved quality.

Third Embodiment

Figure 4A:
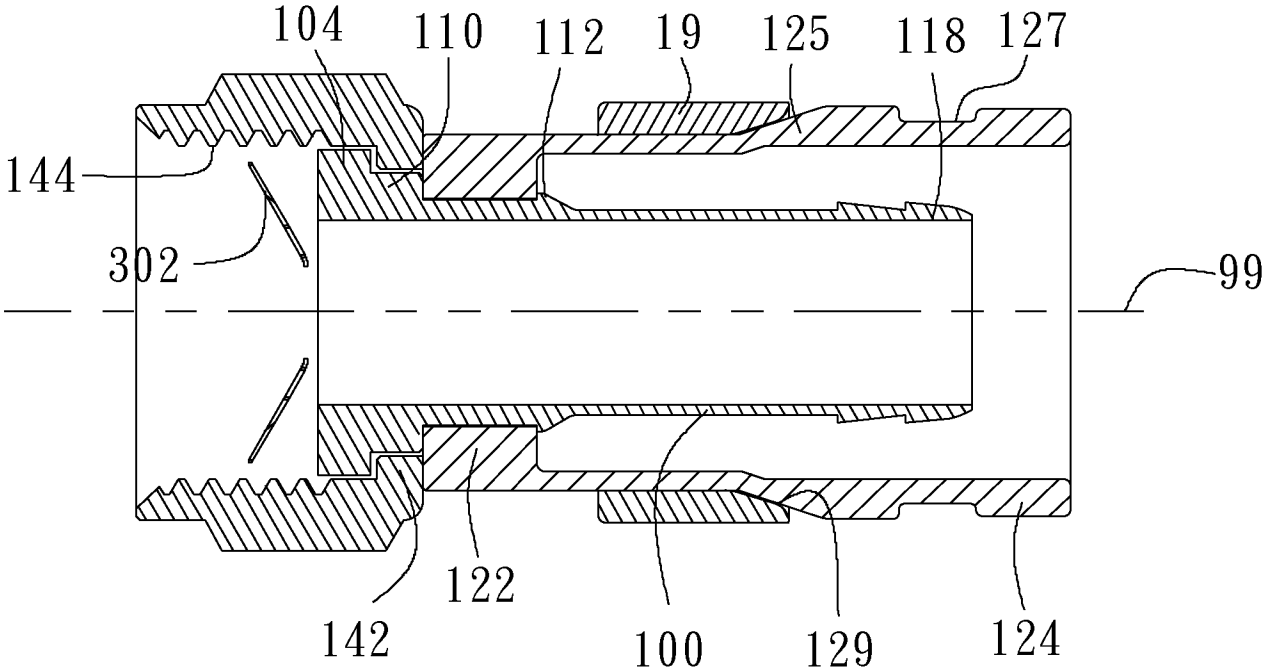
FIG. 4*a* is a cross-sectional view showing a coaxial cable connector in accordance with a third embodiment of the present invention.
Figure 4B:
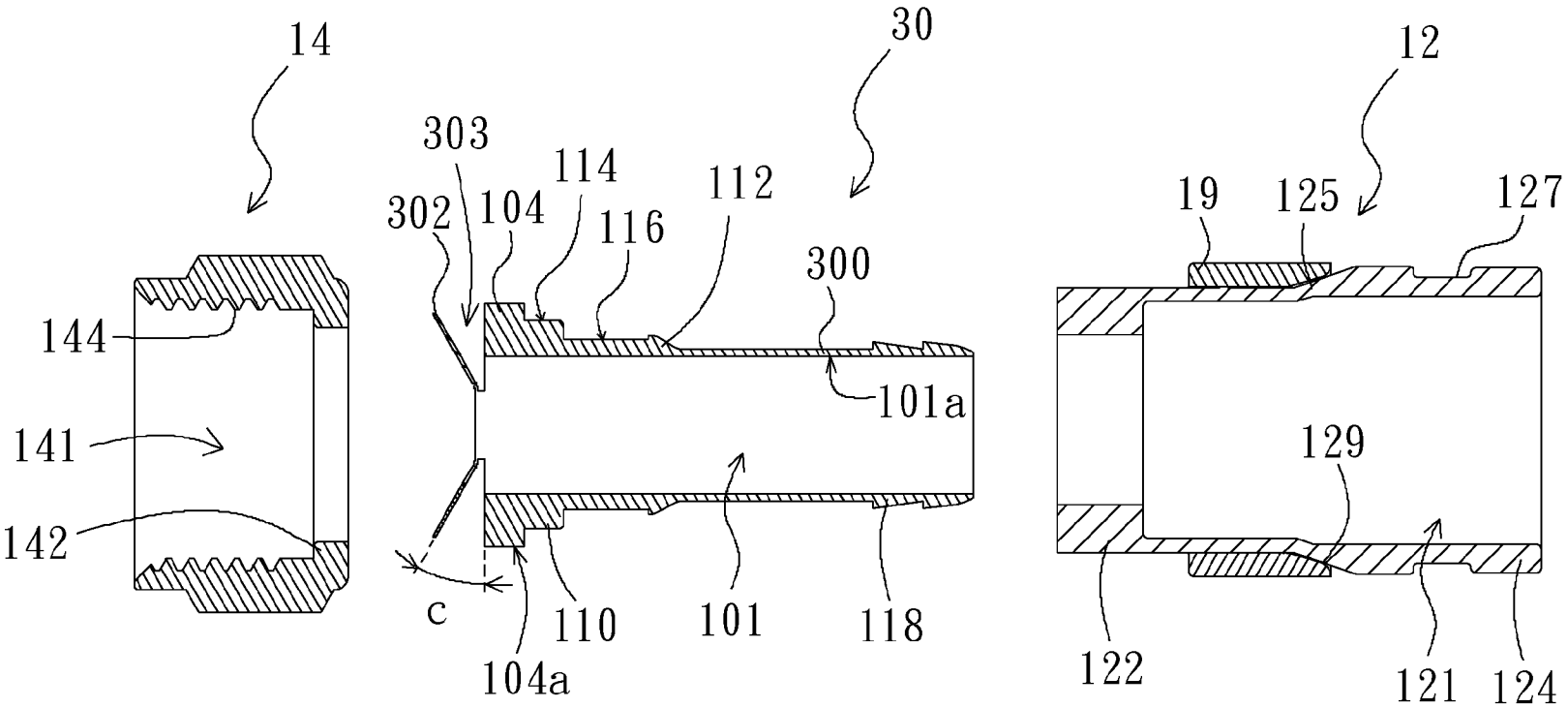
FIG. 4*b* is a cross-sectional exploded view showing the coaxial cable connector in accordance with the third embodiment of the present invention.
Figure 4C:
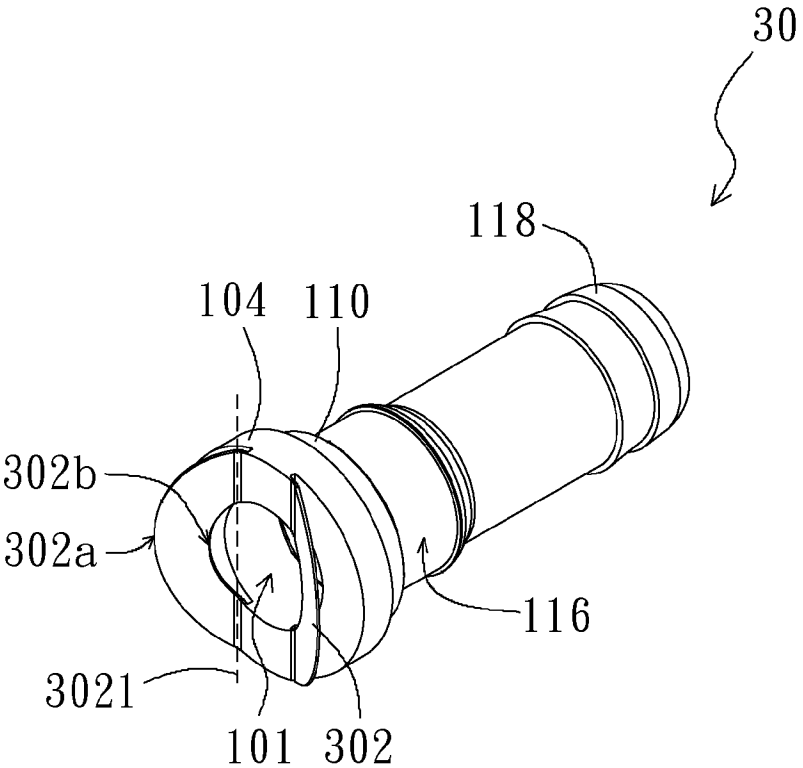
FIG. 4*c* is a perspective view showing an inner sleeve in accordance with the third embodiment of the present invention.
Figure 4E:
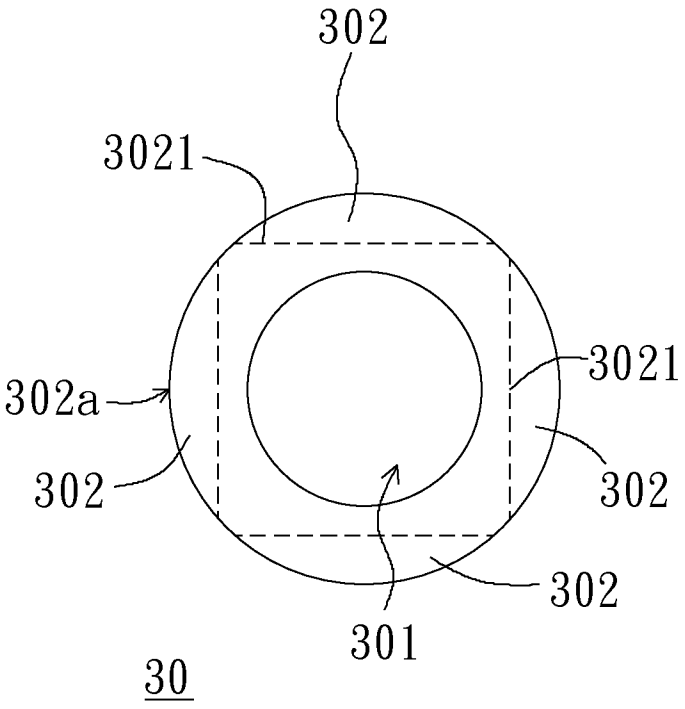
FIGS. 4*d* and 4*e* are front views showing positions of bending lines relative to inner sleeves with various numbers of metal sheets before bent along the bending lings in accordance with the third embodiment of the present invention.
Figure 4D:
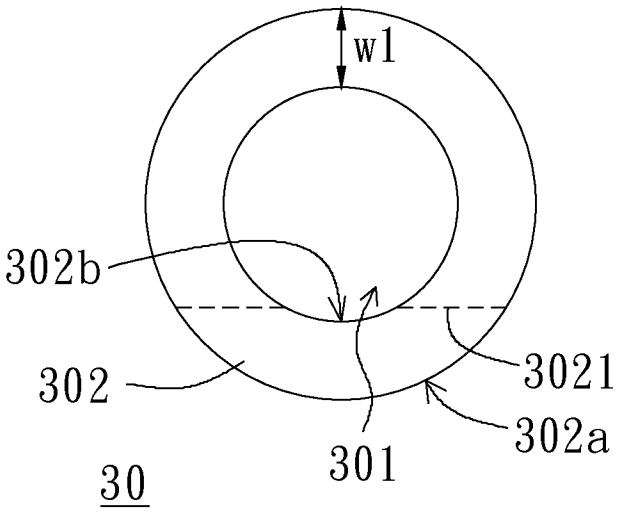

FIG. 4*a* is a cross-sectional view showing a coaxial cable connector in accordance with a third embodiment of the present invention. FIG. 4*b* is a cross-sectional exploded view showing the coaxial cable connector in accordance with the third embodiment of the present invention. FIG. 4*c* is a perspective view showing an inner sleeve in accordance with the third embodiment of the present invention. FIG. 4*i* is a front view showing positions of bending lines relative to the inner sleeve with two metal sheets before bent along the bending line in accordance with the third embodiment of the present invention. Elements in the third embodiment having the same reference number as those in the first embodiment may refer to those illustrated in the first embodiment. Referring to FIGS. 4*a*, 4*b*, 4*c* and 4*i*, the outer sleeve 12, nut 14 and metal ring 19 in accordance with the third embodiment may be referred to those in accordance with the first embodiment. The inner sleeve 30 in accordance with the third embodiment has a different structure from the inner sleeve 10 in accordance with the first embodiment. The inner sleeve 30 may be made of an electrically conductive material, such as copper, iron, silver, nickel, tin, gold, a copper-gold alloy, a copper-tin alloy, a copper-nickel alloy or an electrically conductive polymer or a non-metallic conductor. An antirust metal layer that is an electrically conductive material, such as copper, iron, silver, nickel, tin, gold, a copper-gold alloy, a copper-tin alloy, a copper-nickel alloy, an electrically conductive polymer or a non-metallic material, may be coated, electroplated or electroless plated on a surface of the inner sleeve 30.

Referring to FIGS. 4*a*, 4*b*, 4*c* and 4*i*, the inner sleeve 30 includes a main body 300 and two metal sheets 302 integral with the main body 300, wherein each of the two metal sheets 302 has two separate bottoms, which may extend in a corresponding longitudinal direction and may be collinear, joining a front of the main body 300. A blade may be used to cut into the inner sleeve 30 from the first outer flange 104 of the inner sleeve 30 so as to form two empty gaps 303 symmetrically at opposite sides of the first outer flange 104 with respect to the axis 99 of the inner sleeve 30 and form the two metal sheets 302 at a front side of the main body 300. Each of the two empty gaps 303 is between the main body 300 and a corresponding one of the two metal sheets 302. Each of the two metal sheets 302 may have a thickness between 0.1 and 3 mm, and more particularly between 0.1 and 1.5 mm, between 0.3 and 2 mm, or between 0.5 and 3 mm, for example. Each of the two metal sheets 302 may have an arcuate outer periphery 302*a* with a radian ranging from 60 degrees to 180 degrees for example, and more particularly ranging from 120 degrees to 180 degrees, with respect to the axis 99 of the inner sleeve 30. Each of the two metal sheets 302 may have an arcuate inner periphery 302*b* with a radian ranging from 60 degrees to 180 degrees for example, and more particularly ranging from 120 degrees to 180 degrees, with respect to the axis 99 of the inner sleeve 30.

Referring to FIGS. 4*a*, 4*b*, 4*c* and 4*i*, each of the two metal sheets 302 may be bent along a corresponding bending line 3021, i.e. along the two separate bottoms of said each of the two metal sheets 302, to the side far away from the main body 300. Each empty gap 303 between a corresponding one of the metal sheets 302 and the front of the main body 300 may cut through an annular wall of the inner sleeve 30, separating the arcuate inner periphery 302*b* of the corresponding metal sheet 302 from the main body 300 and separating the arcuate outer periphery 302*a* of the corresponding metal sheet 302 from the main body 300. Each of the two empty gaps 303 may have two separate bottoms connecting two opposite sidewalls of said each of the two empty gaps 303 and extending in the corresponding longitudinal direction. Each of the metal sheets 302 may have a radial width w1 between its arcuate inner and outer peripheries 302*b* and 302*a*, ranging from 0.1 to 3 mm, and more particularly ranging from 0.1 to 1.5 mm, ranging from 0.3 to 2 mm, or ranging from 0.5 to 3 mm.

Referring to FIGS. 4*a*, 4*b*, 4*c* and 4*i*, in an expanded position, each of the metal sheets 302 extends in a corresponding plane at an acute angle c, ranging from 20 degrees to 80 degrees and more particularly ranging from 20 degrees to 60 degrees, ranging from 30 degrees to 70 degrees, or ranging from 45 degrees to 80 degrees, for example, to a vertical plane normal to the axis 99 of the inner sleeve 30. Cut by a plane having the axis 99 of the inner sleeve 30 extending thereon and being normal to the corresponding longitudinal direction, each of the empty gaps 303 may have a first spacing distance between the arcuate outer periphery 302*a* of the corresponding metal sheet 302 and an arcuate outer periphery 104*a* of the first outer flange 104 of the inner sleeve 30 may be greater than a second spacing distance of said each of the empty gaps 303 between the arcuate inner periphery 302*b* of the corresponding metal sheet 302 and an arcuate inner periphery 101*a* of the hole 101 in the inner sleeve 30. Each of the two empty gaps 303 may become gradually wide from the two bottoms of said each of the two empty gaps 303 out away from a diameter of the inner sleeve 30 parallel to the corresponding longitudinal direction.

In this embodiment, the number of the metal sheets 302 of the inner sleeve 30 is two for illustration. Alternatively, the inner sleeve 30 may include any number, such as one, three or four, of metal sheets 302 integral with the main body 300. FIGS. 4*d* and 4*e* are front views showing positions of bending lines relative to inner sleeves with various numbers of metal sheets before bent along the bending lines in accordance with the third embodiment of the present invention. For example, the inner sleeve 30 may include one metal sheet 302 integral with the main body 100, as illustrated in FIGS. 4*d* and 4*j*. The inner sleeve 30 may include four metal sheets 302 integral with the main body 100, as illustrated in FIGS. 4*e* and 4*k*. FIG. 4*j* is a cross-sectional view showing another coaxial cable connector assembled with the inner sleeve of FIG. 4*d* in accordance with the third embodiment of the present invention. FIG. 4*k* is a cross-sectional view showing another coaxial cable connector assembled with the inner sleeve of FIG. 4*e* in accordance with the third embodiment of the present invention.

Referring to FIGS. 4*e* and 4*k*, each of the four metal sheets 302 may have a bottom extending in a corresponding longitudinal direction and joining the front of the maim body 300. A blade may be used to cut into the inner sleeve 30 from the front outer flange 104 so as to form four empty gaps 303, each pair of which are symmetrically at opposite sides of the first outer flange 104 with respect to the axis 99 of the inner sleeve 30, and form the four metal sheets 302 at the front side of the main body 300. Each of the four empty gaps 303 is between the main body 300 and the corresponding metal sheet 302. Each of the four metal sheets 302 may have a thickness between 0.1 and 3 mm, and more particularly between 0.1 and 1.5 mm, between 0.3 and 2 mm, or between 0.5 and 3 mm, for example. Each of the four empty gaps 303 may have a bottom connecting two opposite sidewalls of said each of the four empty gaps 303 and extending in the corresponding longitudinal direction. Each of the four metal sheets 302 may have an arcuate outer periphery 302*a* with a radian ranging from 30 degrees to 180 degrees for example, and more particularly ranging from 45 degrees to 90 degrees, with respect to the axis 99 of the inner sleeve 30. Each of the four metal sheets 302 may be bent along a corresponding bending line 3021, i.e. along the bottom of said each of the four metal sheets 302, to the side far away from the main body 300. Each empty gap 303 between the corresponding metal sheet 302 and the front of the main body 300 may cut into an annular wall of the inner sleeve 30 but not through the annular wall of the inner sleeve 30, separating the arcuate outer periphery 302*a* of the corresponding metal sheet 302 from the main body 300. In an expanded position, each of the metal sheets 302 extends in a corresponding plane at an acute angle c, ranging from 20 degrees to 80 degrees and more particularly ranging from 20 degrees to 60 degrees, ranging from 30 degrees to 70 degrees, or ranging from 45 degrees to 80 degrees, for example, to a vertical plane normal to the axis 99 of the inner sleeve 30. Each of the four empty gaps 303 may become gradually wide from the bottom of said each of the four empty gaps 303 out away from a diameter of the inner sleeve 30 parallel to the corresponding longitudinal direction.

Referring to FIGS. 4*d* and 4*j*, the metal sheet 302 may have two separate bottoms, which may extend in a longitudinal direction and may be collinear, joining the front of the main body 300. A blade may be used to cut into the inner sleeve 30 from the first outer flange 304 so as to form an empty gap 303 at a front side of the main body 300. The empty gap 303 is between the main body 300 and the metal sheet 302. The metal sheet 302 may have a thickness between 0.1 and 3 mm, and more particularly between 0.1 and 1.5 mm, between 0.3 and 2 mm, or between 0.5 and 3 mm, for example. The empty gap 303 may have two separate bottoms connecting two opposite sidewalls of the empty gap 303 and extending in the longitudinal direction. The metal sheet 302 may have an arcuate outer periphery 302*a* with a radian ranging from 60 degrees to 300 degrees for example, and more particularly ranging from 150 degrees to 300 degrees, with respect to the axis 99 of the inner sleeve 30. The metal sheet 302 may have an arcuate inner periphery 302*b* with a radian ranging from 60 degrees to 300 degrees for example, and more particularly ranging from 150 degrees to 300 degrees, with respect to the axis 99 of the inner sleeve 30. The metal sheet 302 may be bent along a bending line 3021, i.e. along the two separate bottoms of the metal sheet 302, to the side far away from the main body 300. The empty gap 303 between the metal sheet 302 and the front of the main body 300 may cut through an annular wall of the inner sleeve 30, separating the arcuate inner periphery 302*b* of the metal sheet 302 from the main body 300 and separating the arcuate outer periphery 302*a* of the metal sheet 302 from the main body 300. The metal sheet 302 may have a radial width w1 between its arcuate inner and outer peripheries 302*b* and 302*a*, ranging from 0.1 to 3 mm, and more particularly ranging from 0.1 to 1.5 mm, ranging from 0.3 to 2 mm, or ranging from 0.5 to 3 mm. In an expanded position, the metal sheet 302 extends in a plane at an acute angle c, ranging from 20 degrees to 80 degrees and more particularly ranging from 20 degrees to 60 degrees, ranging from 30 degrees to 70 degrees, or ranging from 45 degrees to 80 degrees, for example, to a vertical plane normal to the axis 99 of the inner sleeve 30. Cut by a plane having the axis 99 of the inner sleeve 90 extending thereon and being normal to the longitudinal direction, the empty gap 303 may have a first spacing distance between the arcuate outer periphery 302*a* of the metal sheet 302 and an arcuate outer periphery 104*a* of the first outer flange 104 of the inner sleeve 30 may be greater than a second spacing distance of the empty gap 303 between the arcuate inner periphery 302*b* of the metal sheet 302 and an arcuate inner periphery 101*a* of the hole 101 in the inner sleeve 30.

Referring to FIGS. 4*a*-4*e* and 4*i*, each of the metal sheets 302 may be made of an electrically conductive material, such as copper, iron, silver, nickel, tin, gold, a copper-gold alloy, a copper-tin alloy, a copper-nickel alloy or an electrically conductive polymer or a non-metallic conductor. An antirust metal layer that is an electrically conductive material, such as copper, iron, silver, nickel, tin, gold, a copper-gold alloy, a copper-tin alloy, a copper-nickel alloy, an electrically conductive polymer or a non-metallic material, may be coated, electroplated or electroless plated on a surface of said each of the metal sheets 302.

Referring to FIGS. 4*a* and 4*b*, for assembling the coaxial cable connector, the metal ring 19 may be first arranged around the outer sleeve 12. The metal ring 19 has an inner cone surface at a rear side thereof and has an inner diameter gradually increasing in a rearward direction, wherein a first slope angle between the inner cone surface and an axis of the metal ring 19, collinear with the axis 99 of the inner sleeve 30, may range from 5 degrees to 45 degrees. Before the coaxial cable connector is assembled with the coaxial cable, the outer sleeve 12 includes an annular deformable portion 125 with an outer cone surface engaging with and abutting against the inner cone surface of the metal ring 19, wherein a second slope angle between the outer cone surface and an axis of the outer sleeve 12, collinear with the axis of the metal ring 19 and the axis 99 of the inner sleeve 30, may range from 5 degrees to 45 degrees and may be substantially equal to the first slope angle. A trench 127 is annularly formed in the outer sleeve 12 and at a rear side of the deformable portion 126 such that the deformable portion 126 is easily deformed.

Referring to FIGS. 4*a*-4*e* and 4*i*-4*k*, for assembling the coaxial cable connector, the inner sleeve 30 may have the rear extension portion 118 to be first inserted from a front end of the nut 14 into the hole 141 in the nut 14 until the first outer flange 104 may abut against and contact the inner flange 142 of the nut 14 and the inner flange 142 of the nut 14 may be arranged around the cylindrical surface 114 of the second outer flange 110 of the inner sleeve 30. After the nut 14 is assembled with the inner sleeve 30, the inner sleeve 30 may have the rear extension portion 118 to be inserted from a front end of the outer sleeve 12 into the hole 121 in the outer sleeve 12 assembled with the metal ring 19 until the outer sleeve 12 has the inner flange 122 engaging with the trench 116 annularly formed in the inner sleeve 30 and between the second outer flange 110 of the inner sleeve 30 and the third outer flange 112 of the inner sleeve 30. Thereby, the inner flange 142 of the nut 14 may be arranged between the first outer flange 104 of the inner sleeve 30 and the outer sleeve 12 in an axial direction so as to restrict the nut 14 not to move in the axial direction around the inner sleeve 30, but the nut 14 may rotate around the inner sleeve 10. Accordingly, the inner sleeve 30 passes through a rear end of the hole 141 at the inner flange 142 of the nut 14, and each of the metal sheets 302 are in the hole 141 and inclines from its bottom or bottoms to a front end of the hole 141 opposite to the rear end of the hole 141.

Figure 4F:
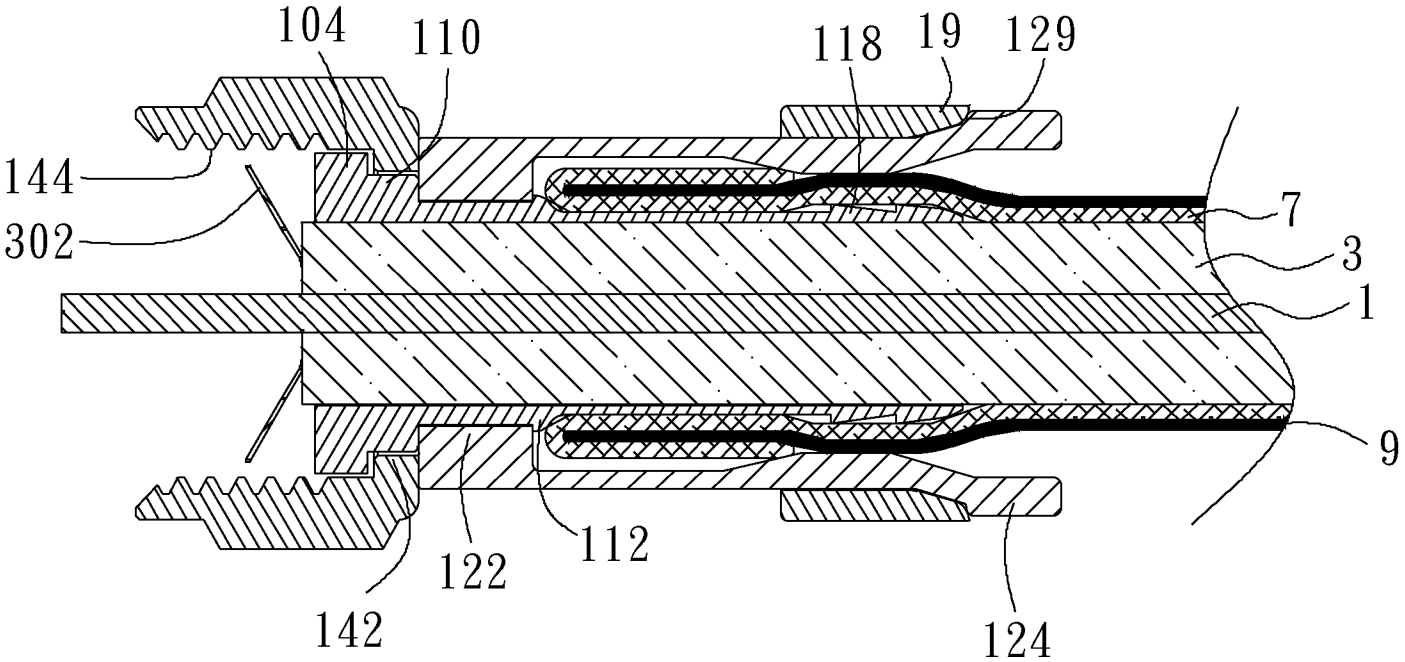
FIG. 4*f* is a cross-sectional view showing the coaxial cable connector assembled with a coaxial cable in accordance with the third embodiment of the present invention.

FIG. 4*f* is a cross-sectional view showing the coaxial cable connector assembled with the coaxial cable in accordance with the third embodiment of the present invention. Referring to FIG. 4*f*, for assembling the coaxial cable as illustrated in FIG. 1 with the axial cable connector, the metal braided film 7 has a front portion folded back over an outer surface of the plastic jacket 9. Next, the coaxial cable has the metal wire 1, insulating layer 3 and thin metal film 5 to be inserted from a back end of the inner sleeve 30 into the hole 101 in the inner sleeve 30 and the folded front portion of the metal braided film 7 and the plastic jacket 9 are inserted from a back end of the outer sleeve 12 into an annular space between the rear extension portion 118 of the inner sleeve 30 and the rear extension portion 124 of the outer sleeve 124. The metal wire 1 extends through the hole 101 in the inner sleeve 30 and to a space, surrounded by the inner thread 144 of the nut 14, outside the hole 101. Next, the metal ring 19 may move backwards in the axial direction around the outer sleeve 12 such that the deformable portion 125 of the outer sleeve 12 may deform in radial inward directions to press the plastic jacket 9 of the coaxial cable with the outer sleeve 12 having the deformed cone surface, which was at a bottom of the trench 127 before the outer sleeve 12 is deformed, engaging with and abutting against the inner cone surface of the metal ring 19, wherein a third slope angle between the deformed cone surface and the axis of the outer sleeve 12 may range from 5 degrees to 45 degrees and may be substantially equal to the first slope angle. Thereby, the coaxial cable may be fixed with the coaxial cable connector. At this time, the metal ring 19 has a rear end abutting against a step 129 of the outer sleeve 12, which was at a rear wall of the trench 127 before the deformable portion 125 is deformed in the radial inward directions.

Figure 4G:
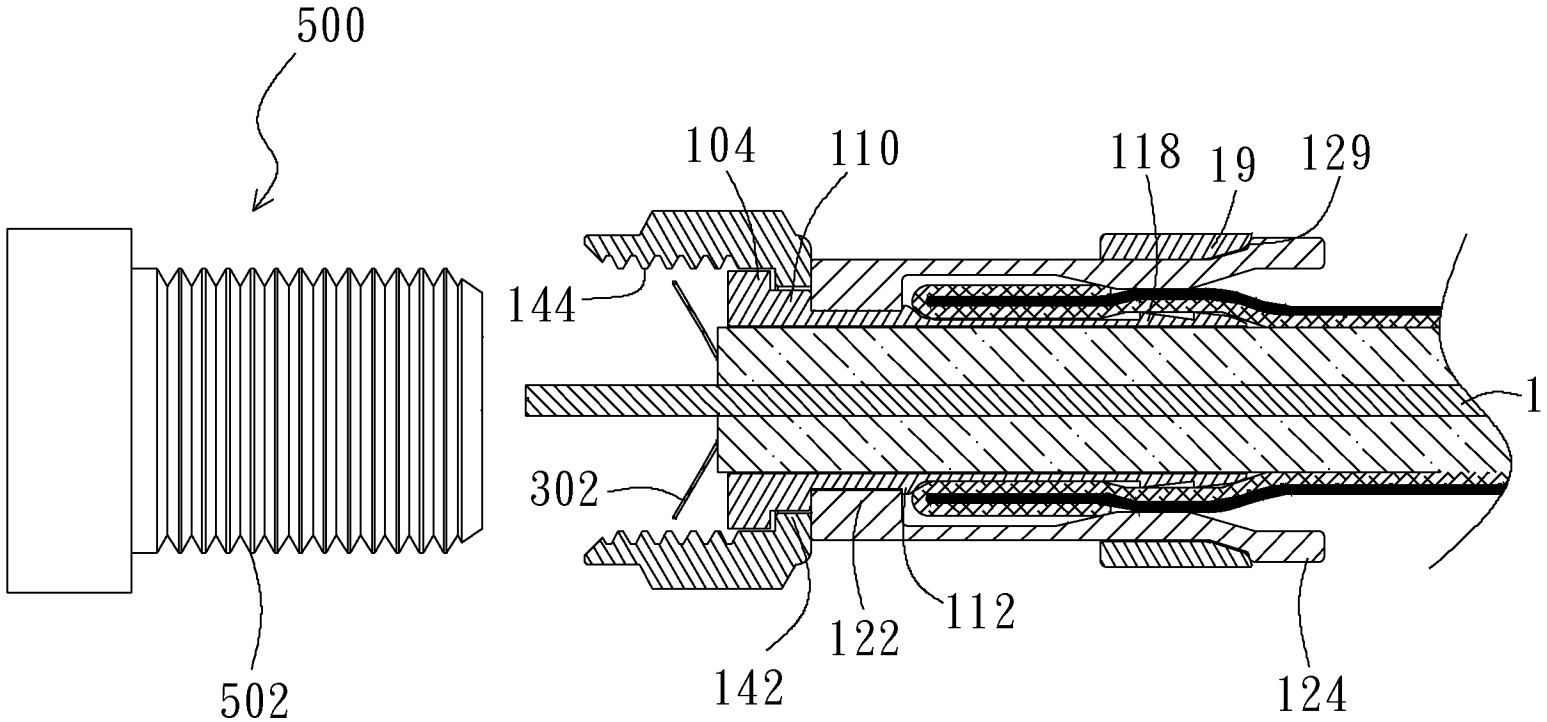
FIGS. 4*g* and 4*h* are cross-sectional views showing the coaxial cable connector before and after assembled with a threaded connector in accordance with the third embodiment of the present invention.
Figure 4H:
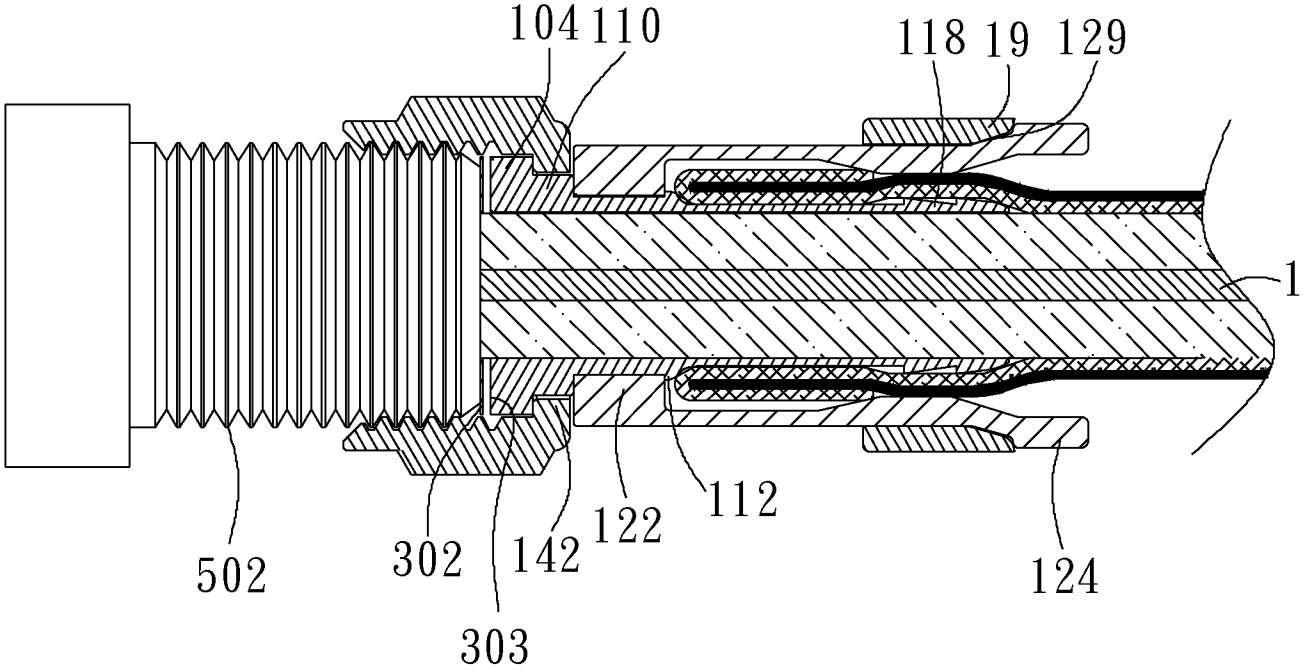
Figure 4I:
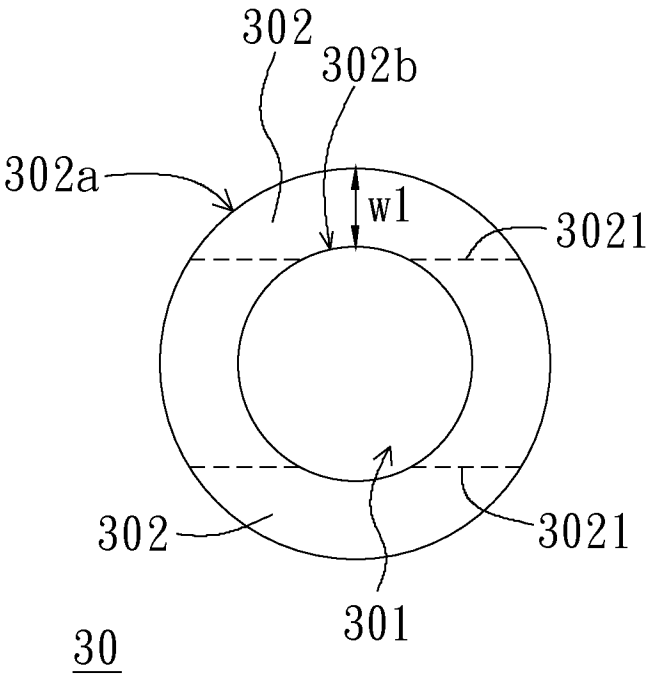
FIG. 4*i* is a front view showing positions of bending lines relative to the inner sleeve with two metal sheets before bent along the bending lines in accordance with the third embodiment of the present invention.

FIGS. 4*g* and 4*h* are cross-sectional views showing the coaxial cable connector before and after assembled with a threaded connector in accordance with the third embodiment of the present invention. Referring to FIGS. 4*g* and 4*h*, the coaxial cable connector may be locked to the treaded connector 500 mounted on an electronic device or an adapter, such as a T-shaped or F-shaped adaptor, for connecting the coaxial cable to another coaxial cable. The coaxial cable fixed with the coaxial cable connector may have the metal wire 1 to be inserted into a hole in the threaded connector 500 and the nut 14 has the inner thread 144 engaging with the outer thread 502 of the threaded connector 500 so as to be screwed on the threaded connector 500. When the nut 14 is being screwed on the threaded connector 500, the metal sheets 302 of the inner sleeve 10 may move to the threaded connector 500 in the axial direction and then may contact the threaded connector 500. Next, the nut 14 may continue to be screwed on the threaded connector 500 such that each of the metal sheets 302 may be bent by the threaded connector 500 with the angle c becoming gradually small. When the nut 14 is fully locked to the threaded connector 500, the angle c may become substantially 0 degrees and each of the metal sheets 302 may have a front surface contacting the threaded connector 500. At this time, the outer flange 104 of the inner sleeve 30 may contact the threaded connector 500. Thereby, when the nut 14 is not fully locked to the threaded connector 500, the metal sheets 302 may contact the threaded connector 500 so as to provide good electrical or ground connection between the inner sleeve 10 and the threaded connector 500. Even when the coaxial cable is casually pulled such that the nut 14 is not fully locked to the threaded connector 500, good electrical or ground connection between the inner sleeve 10 and the threaded connector 500 may still be provided by the metal sheets 302. Accordingly, the coaxial cable connector may transmit signals with improved quality.

Fourth Embodiment

Figure 5A:
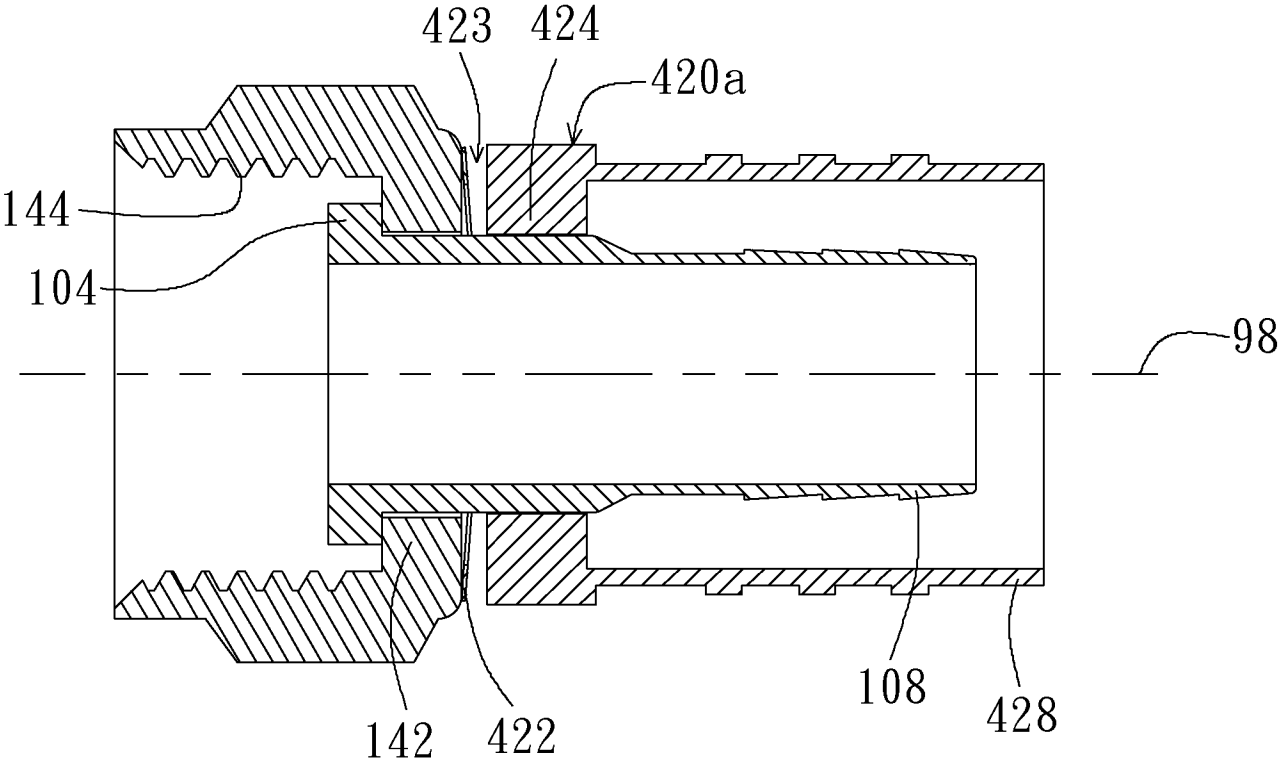
FIG. 5*a* is a cross-sectional view showing a coaxial cable connector in accordance with a fourth embodiment of the present invention.
Figure 5B:
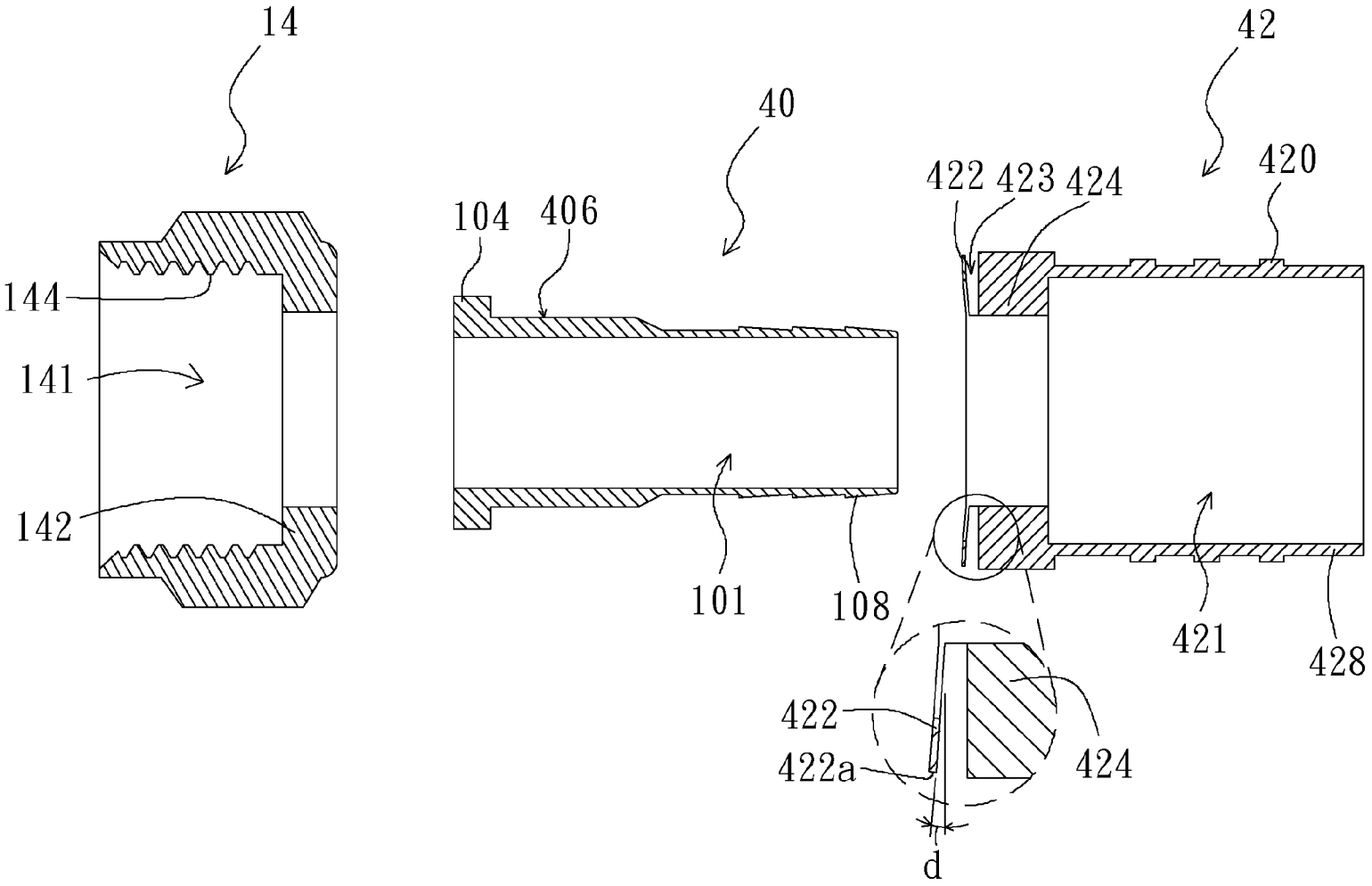
FIG. 5*b* is a cross-sectional exploded view showing the coaxial cable connector in accordance with the fourth embodiment of the present invention.
Figure 5C:
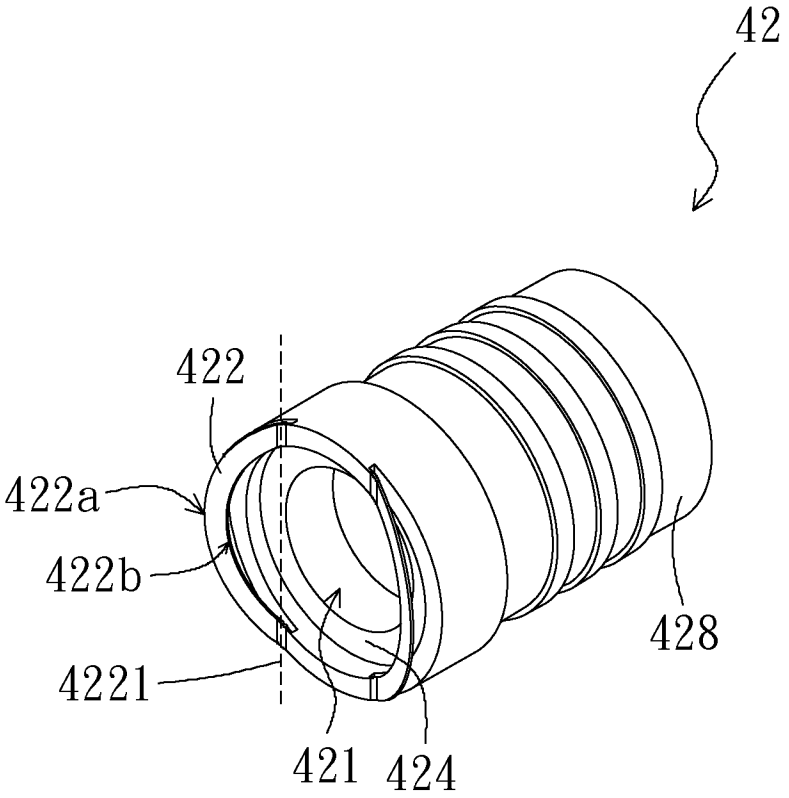
FIG. 5*c* is a perspective view showing an outer sleeve in accordance with the fourth embodiment of the present invention.

FIG. 5*a* is a cross-sectional view showing a coaxial cable connector in accordance with a fourth embodiment of the present invention. FIG. 5*b* is a cross-sectional exploded view showing the coaxial cable connector in accordance with the fourth embodiment of the present invention. FIG. 5*c* is a perspective view showing an outer sleeve in accordance with the fourth embodiment of the present invention. FIG. 5*i* is a front view showing positions of bending lines relative to the outer sleeve with two metal sheets before bent along the bending line in accordance with the fourth embodiment of the present invention. Elements in the fourth embodiment having the same reference number as those in the first embodiment may refer to those illustrated in the first embodiment. Referring to FIGS. 5*a*, 5*b*, 5*c* and 5*i*, the coaxial cable connector includes an inner sleeve 40, an outer sleeve 42 and the nut 14 coaxially arranged with respect to an axis 98 of the outer sleeve 42. Either one of the inner sleeve 40, outer sleeve 42 and nut 14 may be made of an electrically conductive material, such as copper, iron, silver, nickel, tin, gold, a copper-gold alloy, a copper-tin alloy, a copper-nickel alloy or an electrically conductive polymer or a non-metallic conductor. An antirust metal layer that is an electrically conductive material, such as copper, iron, silver, nickel, tin, gold, a copper-gold alloy, a copper-tin alloy, a copper-nickel alloy, an electrically conductive polymer or a non-metallic material, may be coated, electroplated or electroless plated on a surface of the inner sleeve 40, outer sleeve 42 and nut 14. The nut 14 includes an outer hexagonal section configured to engage with a wrench or a similar tool for locking the coaxial cable connector to the threaded connector 500. Alternatively, the nut 14 may be a square nut, circular nut or wing nut.

Referring to FIGS. 5*a*, 5*b*, 5*c* and 5*i*, the outer sleeve 42 includes a main body 420 and two metal sheets 422 integral with the main body 420, wherein each of the two metal sheets 422 has two separate bottoms, which may extend in a corresponding longitudinal direction and may be collinear, joining a front of the main body 420. The outer sleeve 42 may include an inner flange 424 protruding annularly in radial inward directions. A blade may be used to cut into the outer sleeve 42 so as to form two empty gaps 423 symmetrically at opposite sides of the outer sleeve 42 with respect to the axis 98 of the outer sleeve 42 and form the two metal sheets 422 at a front side of the main body 420. Each of the two empty gaps 423 is between the main body 420 and the corresponding metal sheet 422. Each of the two metal sheets 422 may have a thickness between 0.1 and 3 mm, and more particularly between 0.1 and 1.5 mm, between 0.3 and 2 mm, or between 0.5 and 3 mm, for example. Each of the two empty gaps 423 may have two separate bottoms connecting two opposite sidewalls of said each of the two empty gaps 423 and extending in the corresponding longitudinal direction. Each of the two metal sheets 422 may have an arcuate outer periphery 422*a* with a radian ranging from 45 degrees to 180 degrees for example, and more particularly ranging from 90 degrees to 150 degrees, with respect to the axis 98 of the outer sleeve 42. Each of the two metal sheets 422 may have an arcuate inner periphery 422*b* with a radian ranging from 45 degrees to 180 degrees for example, and more particularly ranging from 90 degrees to 150 degrees, with respect to the axis 98 of the outer sleeve 42.

Referring to FIGS. 5*a*, 5*b*, 5*c* and 5*i*, each of the two metal sheets 422 may be bent along a corresponding bending line 4221, i.e. along the two separate bottoms of said each of the two metal sheets 422, to the side far away from the main body 420. Each empty gap 423 between the corresponding metal sheet 422 and the main body 420 may cut through an annular wall of the outer sleeve 42, separating the arcuate inner periphery 422*b* of the corresponding metal sheet 422 from the main body 420 and separating the arcuate outer periphery 422*a* of the corresponding metal sheet 422 from the main body 420. Each of the metal sheets 422 may have a radial width w2 between its arcuate inner and outer peripheries 422*b* and 422*a*, ranging from 0.1 to 3 mm, and more particularly ranging from 0.1 to 1.5 mm, ranging from 0.3 to 2 mm, or ranging from 0.5 to 3 mm, wherein the arcuate inner periphery 422*b* of each of the metal sheets 422 may contact the inner sleeve 40. Alternatively, a radial space may be kept between the arcuate inner periphery 422*b* of each of the metal sheets 422 and the inner sleeve 40. The radial width w2 of each of the metal sheets 422 may be less than a radial width w3 between a circular inner periphery 424*a* of the inner flange 424 of the outer sleeve 42 and a circular outer periphery 420*a*, radially around the inner flange 424, of the outer sleeve 42. In an expanded position, each of the metal sheets 422 extends in a corresponding plane at an acute angle d, ranging from 1 degree to 80 degrees and more particularly ranging from 1 degree to 15 degrees, ranging from 20 degrees to 60 degrees, ranging from 30 degrees to 70 degrees, or ranging from 45 degrees to 80 degrees, for example, to a vertical plane normal to the axis 98 of the outer sleeve 42. Each of the empty gaps 423 may become gradually wide from the two bottoms of said each of the empty gaps 423 out away from a diameter of the outer sleeve 42 parallel to the corresponding longitudinal direction.

Figure 5E:
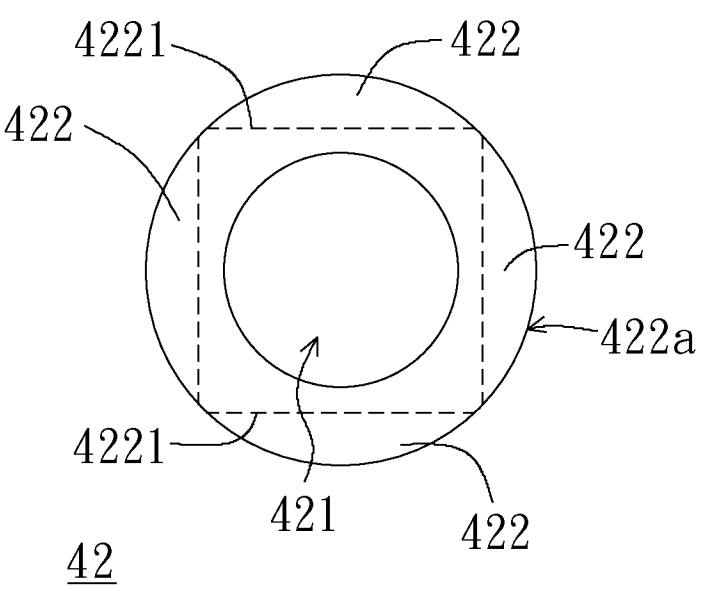
FIGS. 5*d* and 5*e* are front views showing positions of bending lines relative to outer sleeves with various numbers of metal sheets before bent along the bending lings in accordance with the fourth embodiment of the present invention.
Figure 5D:
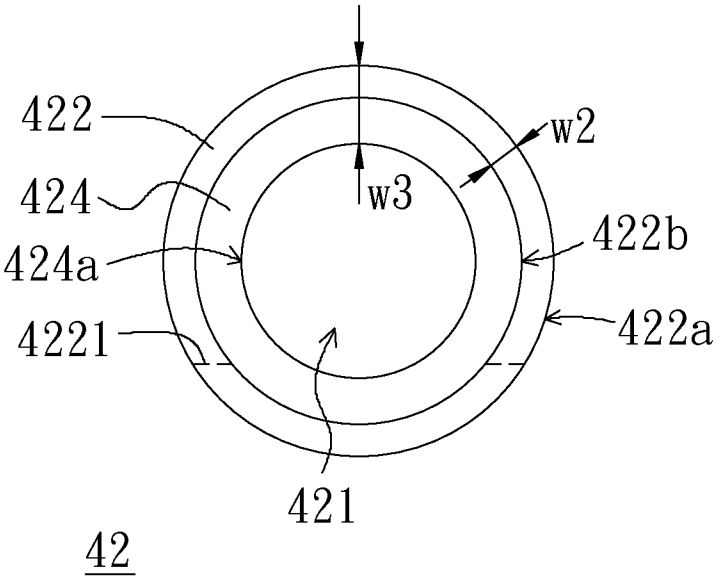

In this embodiment, the number of the metal sheets 422 of the outer sleeve 42 is two for illustration. Alternatively, the outer sleeve 42 may include any number, such as one, three or four, of metal sheets 422 integral with the main body 420. FIGS. 5*d* and 5*e* are front views showing positions of bending lines relative to outer sleeves with various numbers of metal sheets before bent along the bending lings in accordance with the fourth embodiment of the present invention. For example, the outer sleeve 42 may include one metal sheet 422 integral with the main body 420, as illustrated in FIGS. 5*d* and 5*j*. The outer sleeve 42 may include four metal sheets 422 integral with the main body 420, as illustrated in FIGS. 5*e* and 5*k*. FIG. 5*j* is a cross-sectional view showing another coaxial cable connector assembled with the outer sleeve of FIG. 5*d* in accordance with the fourth embodiment of the present invention. FIG. 5*k* is a cross-sectional view showing another coaxial cable connector assembled with the outer sleeve of FIG. 5*e* in accordance with the fourth embodiment of the present invention.

Referring to FIGS. 5*e* and 5*k*, each of the four metal sheets 422 may have a bottom extending in a corresponding longitudinal direction and joining the front of the maim body 420. A blade may be used to cut into the outer sleeve 42 so as to form four empty gaps 423, each pair of which are symmetrically at opposite sides of the outer sleeve 42 with respect to the axis 98 of the outer sleeve 42, and form the four metal sheets 422 at the front of the main body 420. Each of the four empty gaps 423 is between the main body 420 and the corresponding metal sheet 422. Each of the four metal sheets 422 may have a thickness between 0.1 and 3 mm, and more particularly between 0.1 and 1.5 mm, between 0.3 and 2 mm, or between 0.5 and 3 mm, for example. Each of the four metal sheets 422 may have an arcuate outer periphery 422*a* with a radian ranging from 30 degrees to 180 degrees for example, and more particularly ranging from 45 degrees to 90 degrees, with respect to the axis 98 of the outer sleeve 42. Each of the four metal sheets 422 may be bent along a corresponding bending line 4221, i.e. along the bottom of said each of the four metal sheets 422, to the side far away from the main body 420. Each empty gap 423 between the corresponding metal sheet 422 and the front of the main body 420 may cut into an annular wall of the outer sleeve 42 but not through the annular wall of the outer sleeve 42, separating the arcuate outer periphery 422*a* of the corresponding metal sheet 422 from the main body 420. In an expanded position, each of the metal sheets 422 extends in a corresponding plane at an acute angle d, ranging from 1 degrees to 80 degrees and more particularly ranging from 1 degrees to 15 degrees, ranging from 20 degrees to 60 degrees, ranging from 30 degrees to 70 degrees, or ranging from 45 degrees to 80 degrees, for example, to a vertical plane normal to the axis 98 of the outer sleeve 42. Each of the four empty gaps 423 may become gradually wide from the bottom of said each of the four empty gaps 423 out away from a diameter of the outer sleeve 42 parallel to the corresponding longitudinal direction.

Referring to FIGS. 5*d* and 5*j*, the metal sheet 422 may have two separate bottoms, which may extend in a longitudinal direction and may be collinear, joining the front of the main body 420. A blade may be used to cut into the outer sleeve 42 so as to form an empty gap 423 at a front side of the main body 420. The empty gap 423 is between the main body 420 and the metal sheet 422. The metal sheet 422 may have a thickness between 0.1 and 3 mm, and more particularly between 0.1 and 1.5 mm, between 0.3 and 2 mm, or between 0.5 and 3 mm, for example. The empty gap 423 may have two separate bottoms connecting two opposite sidewalls of the empty gap 423 and extending in the longitudinal direction. The metal sheet 422 may have an arcuate outer periphery 422*a* with a radian ranging from 60 degrees to 300 degrees for example, and more particularly ranging from 150 degrees to 300 degrees, with respect to the axis 98 of the outer sleeve 42. The metal sheet 422 may have an arcuate inner periphery 422*b* with a radian ranging from 60 degrees to 300 degrees for example, and more particularly ranging from 150 degrees to 300 degrees, with respect to the axis 98 of the outer sleeve 42. The metal sheet 422 may be bent along a bending line 4221, i.e. along the two separate bottoms of the metal sheet 422, to the side far away from the main body 420. The empty gap 423 between the metal sheet 422 and the front of the main body 420 may cut through an annular wall of the outer sleeve 42, separating the arcuate inner periphery 422*b* of the metal sheet 422 from the main body 420 and separating the arcuate outer periphery 422*a* of the metal sheet 422 from the main body 420. The metal sheet 422 may have a radial width w2 between its arcuate inner and outer peripheries 422*b* and 422*a*, ranging from 0.1 to 3 mm, and more particularly ranging from 0.1 to 1.5 mm, ranging from 0.3 to 2 mm, or ranging from 0.5 to 3 mm, wherein the arcuate inner periphery 422*b* of the metal sheet 422 may contact the inner sleeve 40. Alternatively, a radial space may be kept between the arcuate inner periphery 422*b* of the metal sheets 422 and the inner sleeve 40. The radial width w2 of the metal sheet 422 may be less than a radial width w3 between a circular inner periphery 424*a* of the inner flange 424 of the outer sleeve 42 and a circular outer periphery 420*a*, radially around the inner flange 424, of the outer sleeve 42. In an expanded position, the metal sheet 422 extends in a plane at an acute angle d, ranging from 1 degrees to 80 degrees and more particularly ranging from 1 degrees to 15 degrees, ranging from 20 degrees to 60 degrees, ranging from 30 degrees to 70 degrees, or ranging from 45 degrees to 80 degrees, for example, to a vertical plane normal to the axis 98 of the outer sleeve 42. Cut by a plane having the axis 98 of the outer sleeve 42 extending thereon and being normal to the longitudinal direction, the empty gap 423 may have a first spacing distance between the arcuate outer periphery 422*a* of the metal sheet 422 and the circular outer periphery 420*a* of the outer sleeve 42 may be greater than a second spacing distance of the empty gap 423 between the arcuate inner periphery 422*b* of the metal sheet 422 and the circular inner periphery 424*a* of the inner flange 424 of the outer sleeve 42. The arcuate inner periphery 422*b* of the metal sheet 442 may contact the inner sleeve 40. Alternatively, a radial space may be kept between the arcuate inner periphery 422*b* of the metal sheet 442 and the inner sleeve 40.

Referring to FIGS. 5*a*-5*e* and 5*i*-5*k*, each of the metal sheets 422 may be made of an electrically conductive material, such as copper, iron, silver, nickel, tin, gold, a copper-gold alloy, a copper-tin alloy, a copper-nickel alloy or an electrically conductive polymer or a non-metallic conductor. An antirust metal layer that is an electrically conductive material, such as copper, iron, silver, nickel, tin, gold, a copper-gold alloy, a copper-tin alloy, a copper-nickel alloy, an electrically conductive polymer or a non-metallic material, may be coated, electroplated or electroless plated on a surface of said each of the metal sheets 422.

Referring to FIGS. 5*a*-5*e* and 5*i*-5*k*, for assembling the coaxial cable connector, the inner sleeve 40 may have the rear extension portion 108 to be first inserted from a front end of the nut 14 into the hole 141 in the nut 14 until the outer flange 104 of the inner sleeve 40 may abut against and contact the inner flange 142 of the nut 14 and the inner flange 142 of the nut 14 may be arranged around an annular surface 406 of the inner sleeve 40. After the nut 14 is assembled with the inner sleeve 40, the inner sleeve 40 may have the rear extension portion 108 to be inserted from a front end of the outer sleeve 42 into the hole 421 in the outer sleeve 42 and then the inner flange 424 of the outer sleeve 42 may tightly fit with the inner sleeve 40 and around the annular surface 406 of the inner sleeve 40. The outer sleeve 42 has the metal sheets 422 generating an elastic force upon a back of the nut 14 so as to lead the inner flange 142 of the nut 14 to press the outer flange 104 of the inner sleeve 40. Thereby, the nut 14 may be restricted not to move in the axial direction around the inner sleeve 40, but the nut 14 may rotate around the inner sleeve 40.

Figure 5F:
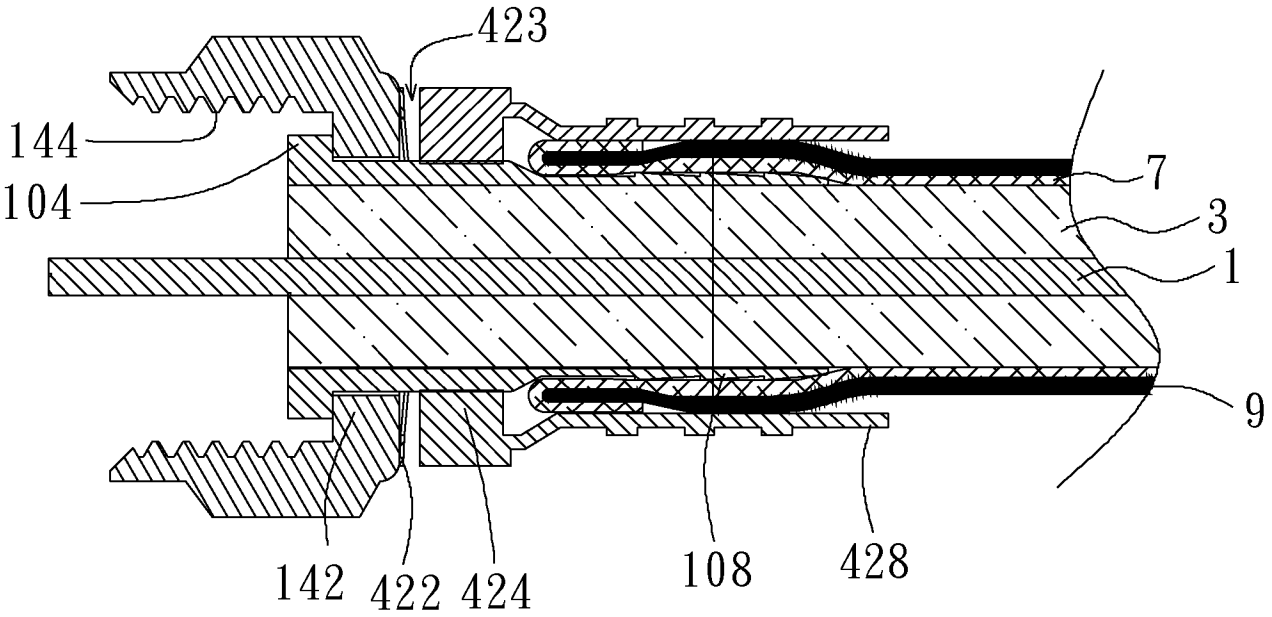
FIG. 5*f* is a cross-sectional view showing the coaxial cable connector assembled with a coaxial cable in accordance with the fourth embodiment of the present invention.

FIG. 5*f* is a cross-sectional view showing the coaxial cable connector assembled with a coaxial cable in accordance with the fourth embodiment of the present invention. Referring to FIG. 5*f*, for assembling the coaxial cable as illustrated in FIG. 1 with the axial cable connector, the metal braided film 7 has a front portion folded back over an outer surface of the plastic jacket 9. Next, the coaxial cable has the metal wire 1, insulating layer 3 and thin metal film 5 to be inserted from a back end of the inner sleeve 40 into the hole 101 in the inner sleeve 40 and the folded front portion of the metal braided film 7 and the plastic jacket 9 are inserted from a back end of the outer sleeve 42 into an annular space between the rear extension portion 108 of the inner sleeve 40 and the rear extension portion 428 of the outer sleeve 42. The metal wire 1 extends through the hole 101 in the inner sleeve 40 and to a space, surrounded by the inner thread 144 of the nut 14, outside the hole 101. Next, the outer sleeve 42 may be radially pressed by a tool such that the outer sleeve 42 may deform in radial inward directions to press the plastic jacket 9 so as to fix the coaxial cable with the coaxial cable connector.

Figure 5G:
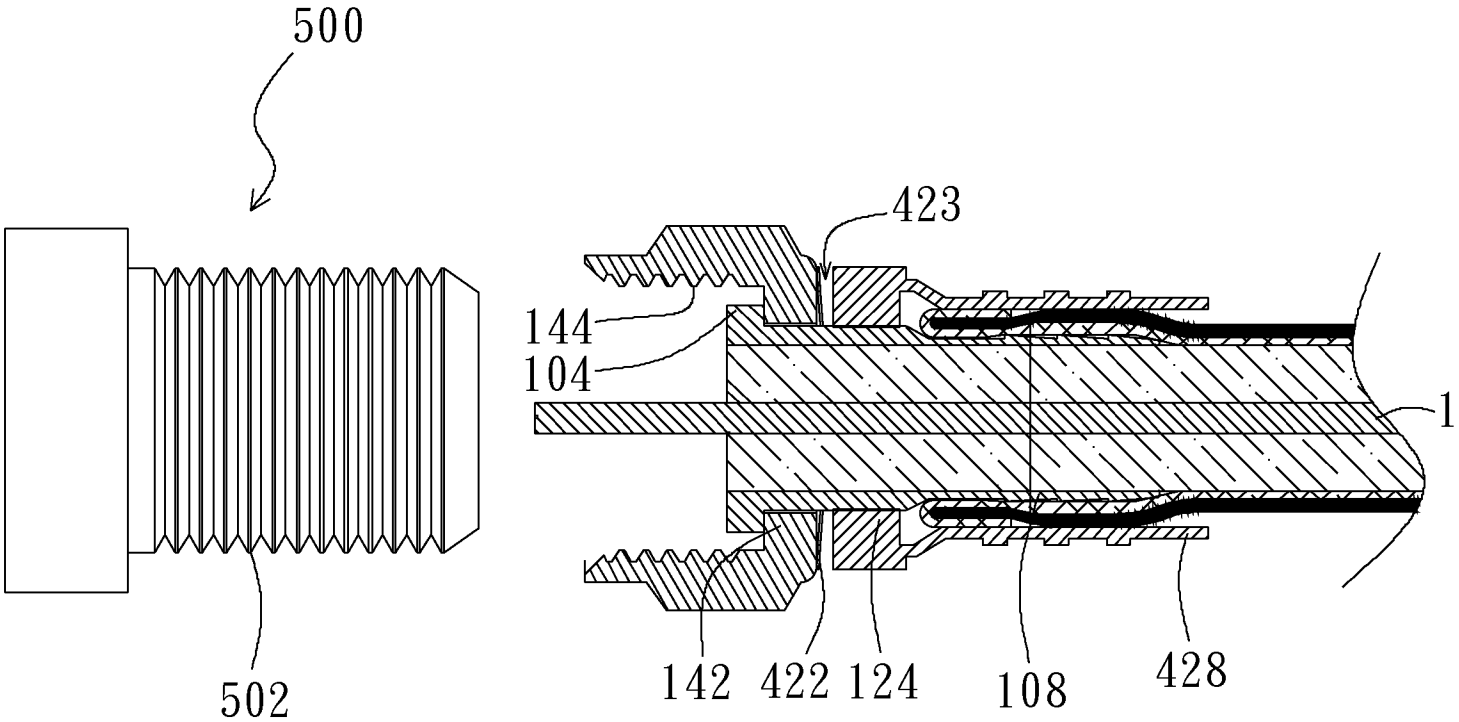
FIGS. 5*g* and 5*h* are cross-sectional views showing the coaxial cable connector before and after assembled with a thread connector in accordance with the fourth embodiment of the present invention.
Figure 5H:
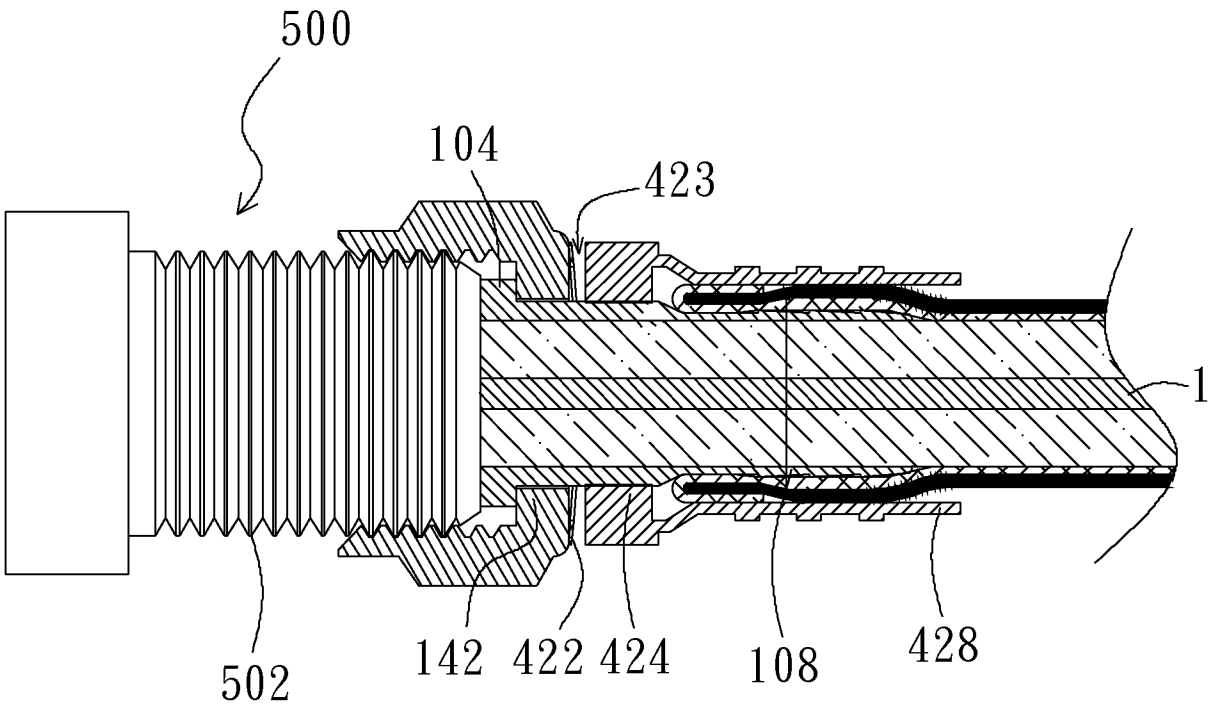
Figure 51:
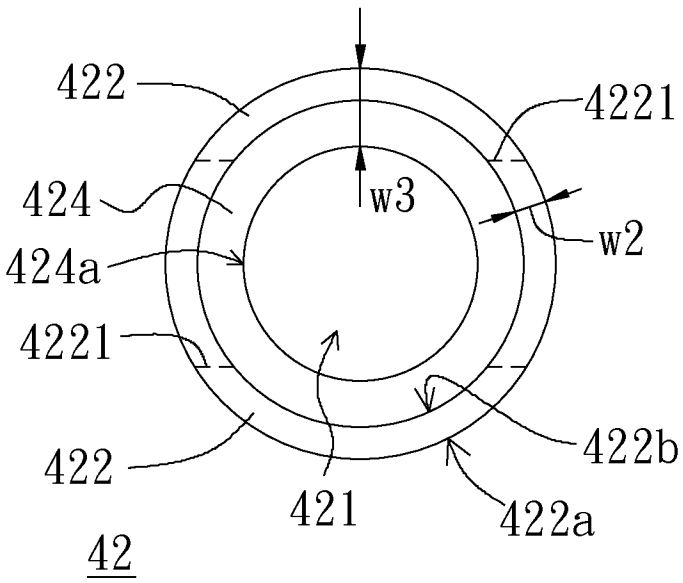

FIGS. 5*g* and 5*h* are cross-sectional views showing the coaxial cable connector before and after assembled with a thread connector in accordance with the fourth embodiment of the present invention. Referring to FIGS. 5*g* and 5*h*, the coaxial cable connector may be locked to the treaded connector 500 mounted on an electronic device or an adapter, such as a T-shaped or F-shaped adaptor, for connecting the coaxial cable to another coaxial cable. The coaxial cable fixed with the coaxial cable connector may have the metal wire 1 to be inserted into a hole in the threaded connector 500 and the nut 14 has the inner thread 144 engaging with the outer thread 502 of the threaded connector 500 so as to be screwed on the threaded connector 500. When the nut 14 is being screwed on the threaded connector 500, the outer flange 104 of the inner sleeve 40 may move to the threaded connector 500 in the axial direction and then may contact the threaded connector 500. No matter whether the nut 14 is fully locked to the threaded connector 500 or not, the outer sleeve 42 has the metal sheets 422 always abutting against and contacting a back of the nut 14 with the angle d such that the nut 14 has the inner flange 142 stopping at the outer flange 104 of the inner sleeve 40 and good electrical or ground connection between the inner sleeve 40 and the nut 14 may be provided. Thereby, the metal sheets 422 may always contact the nut 14 so as to provide good electrical or ground connection between the outer sleeve 42 and the nut 14. Even when the coaxial cable is casually pulled such that the nut 14 is not fully locked to the threaded connector 500, good electrical or ground connection between the inner sleeve 40 and the nut 14 and between the outer sleeve 42 and the nut 14 may still be provided by the metal sheets 422 generating an elastic force upon the back of the nut 14 so as to lead the inner flange 142 of the nut 14 to press the outer flange 104 of the inner sleeve 40. Accordingly, the coaxial cable connector may transmit signals with improved quality.

Fifth Embodiment

Figure 6A:
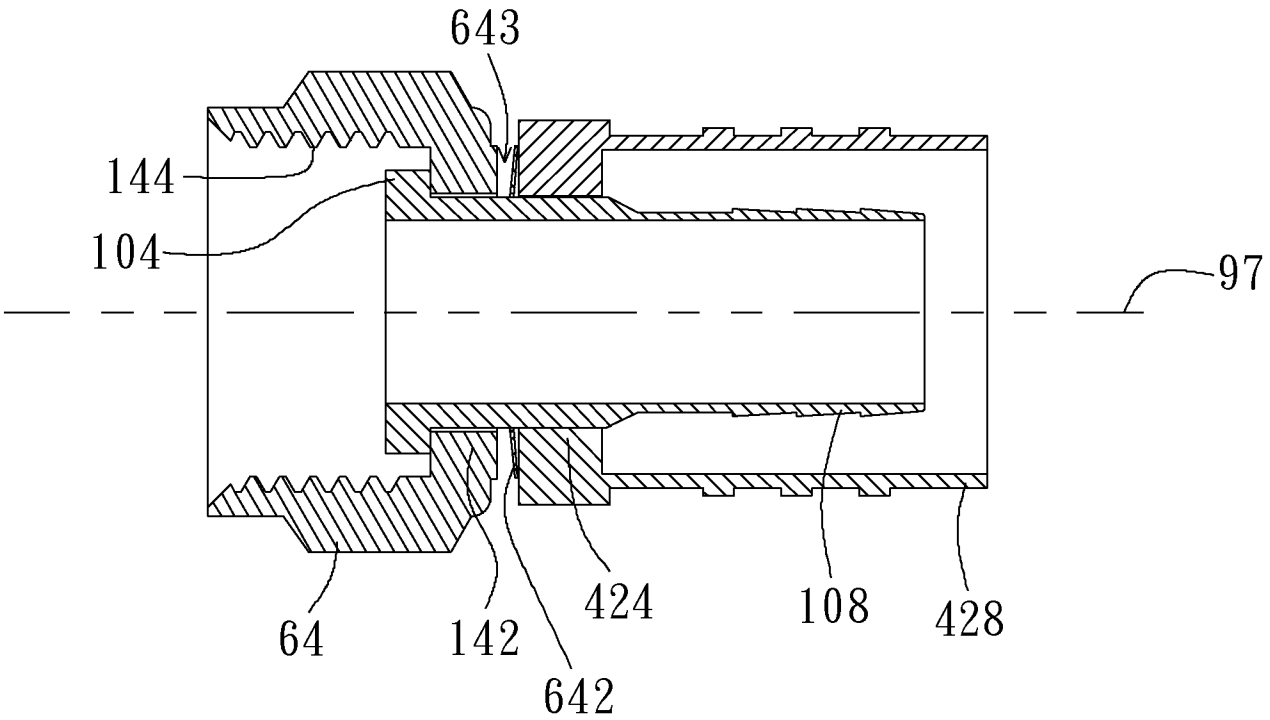
FIG. 6*a* is a cross-sectional view showing a coaxial cable connector in accordance with a fifth embodiment of the present invention.
Figure 6B:
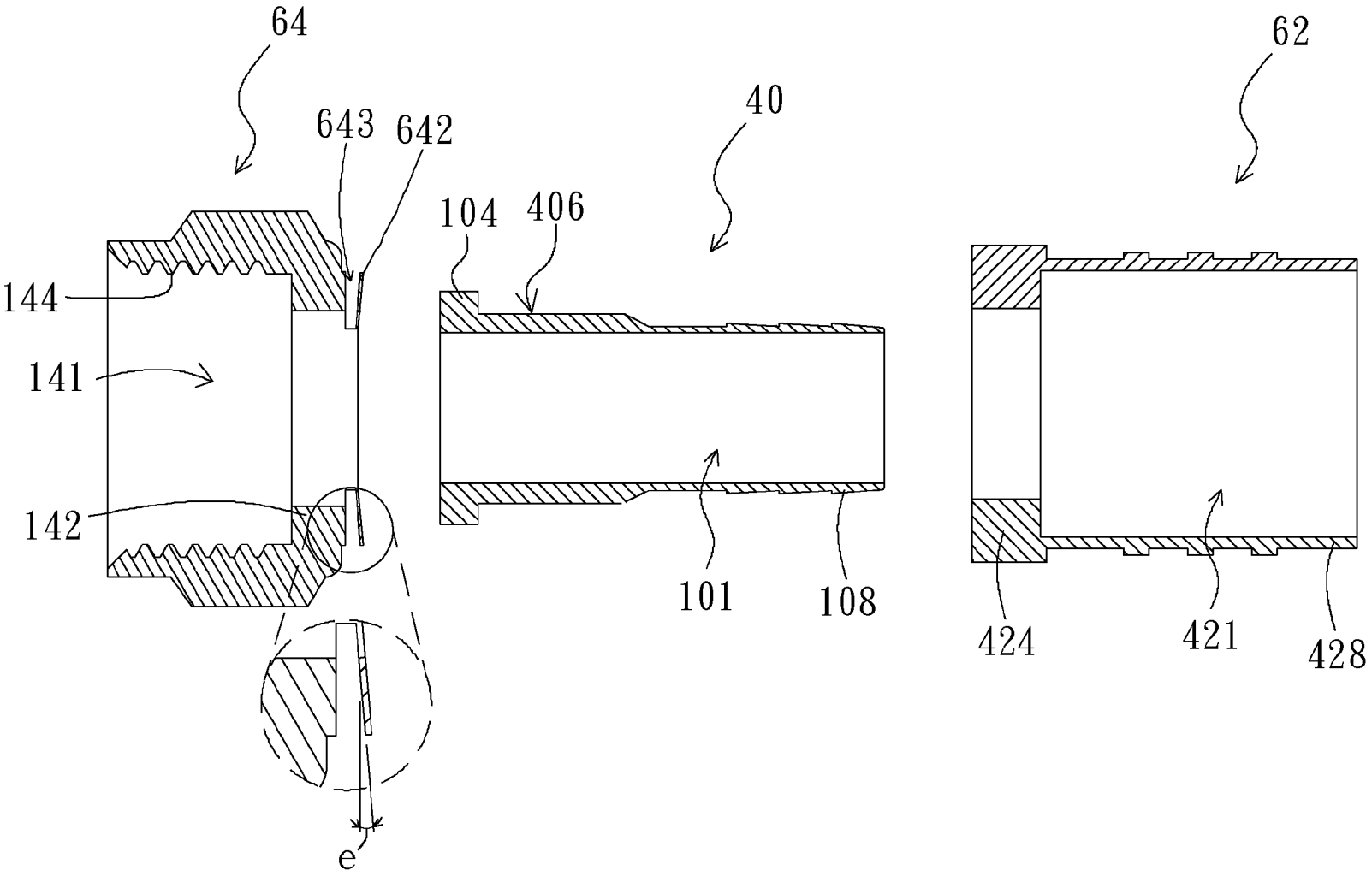
FIG. 6*b* is a cross-sectional exploded view showing the coaxial cable connector in accordance with the fifth embodiment of the present invention.
Figure 6C:
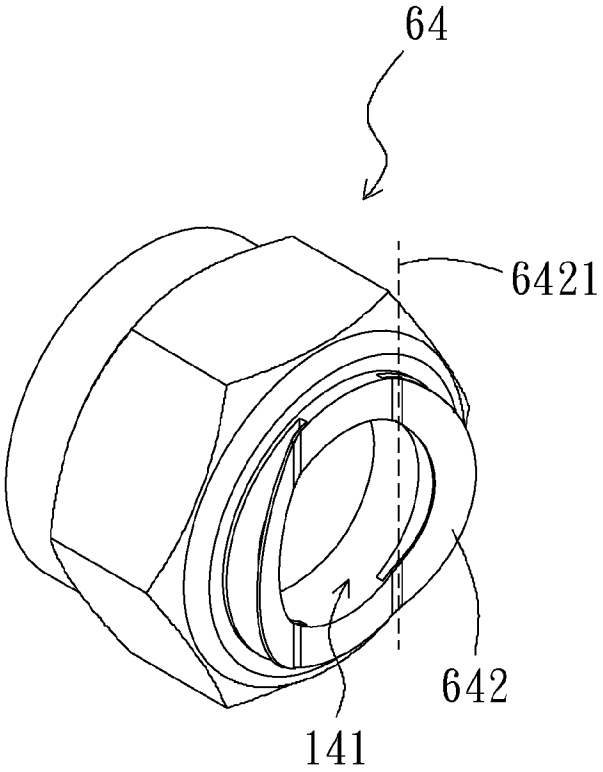
FIG. 6*c* is a perspective view showing a nut in accordance with the fifth embodiment of the present invention.
Figure 6E:
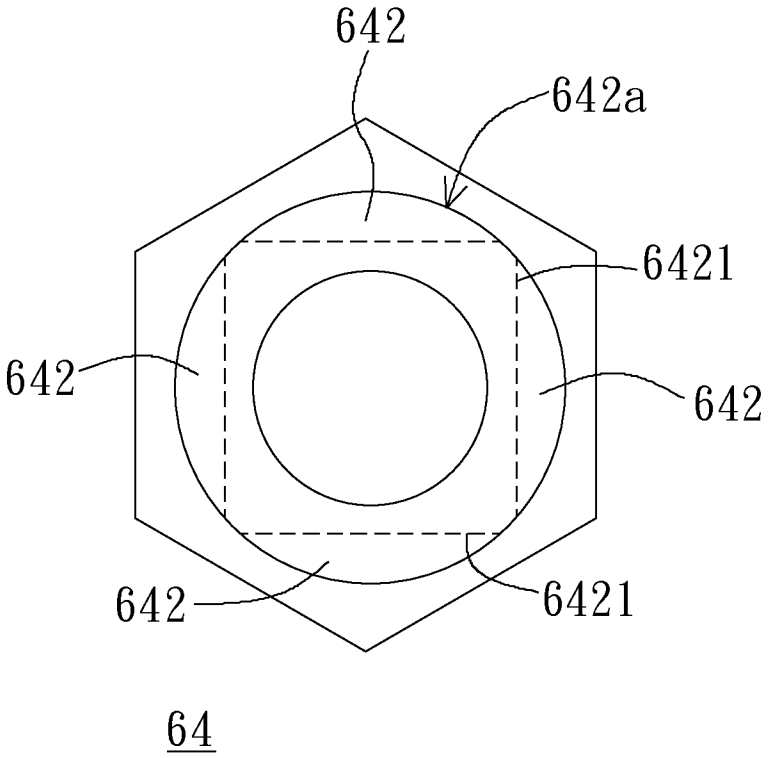
FIGS. 6*d* and 6*e* are back views showing positions of bending lines relative to nuts with various numbers of metal sheets before bent along the bending lings in accordance with the fifth embodiment of the present invention.
Figure 6D:
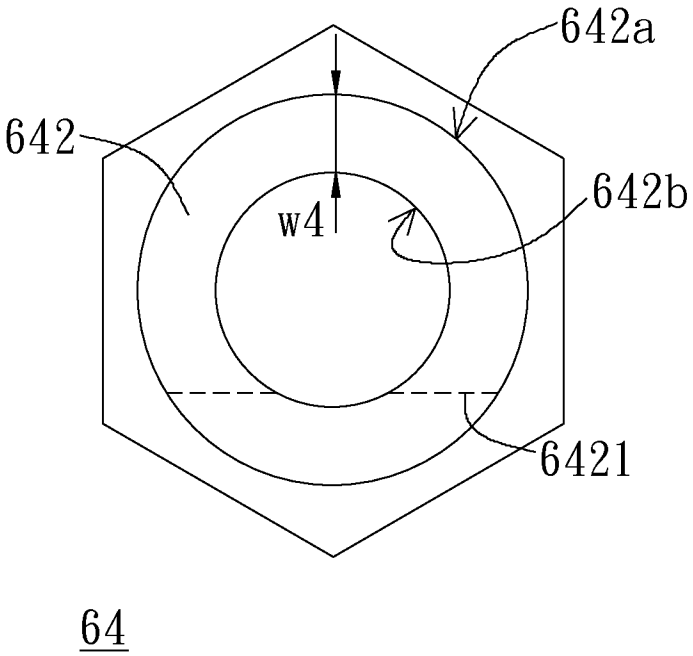

FIG. 6*a* is a cross-sectional view showing a coaxial cable connector in accordance with a fifth embodiment of the present invention. FIG. 6*b* is a cross-sectional exploded view showing the coaxial cable connector in accordance with the fifth embodiment of the present invention. FIG. 6*c* is a perspective view showing a nut in accordance with the fifth embodiment of the present invention. FIG. 6*k* is a back view showing positions of bending lines relative to the nut with two metal sheets before bent along the bending lines in accordance with the fifth embodiment of the present invention. Elements in the fifth embodiment having the same reference number as those in the first and/or fourth embodiments may refer to those illustrated in the first and/or fourth embodiments. Referring to FIGS. 6*a*, 6*b*, 6*c* and 6*k*, the coaxial cable connector includes an inner sleeve 40, an outer sleeve 62 and a nut 64 coaxially arranged with respect to an axis 97 of the nut 64. The inner sleeve 40 in the fifth embodiment has a similar structure as that of the inner sleeve 40 illustrated in the fourth embodiment. The outer sleeve 62 in the fifth embodiment has a similar structure as that of the outer sleeve 42 illustrated in the fourth embodiment except that the outer sleeve 62 does not include the metal sheets 422 illustrated in the fourth embodiment. The nut 64 in the fifth embodiment has a similar structure as that of the nut 14 illustrated in the first and fourth embodiments except that the nut 64 includes two metal sheets 642 mentioned as below. Either one of the inner sleeve 40, outer sleeve 62 and nut 64 may be made of an electrically conductive material, such as copper, iron, silver, nickel, tin, gold, a copper-gold alloy, a copper-tin alloy, a copper-nickel alloy or an electrically conductive polymer or a non-metallic conductor. An antirust metal layer that is an electrically conductive material, such as copper, iron, silver, nickel, tin, gold, a copper-gold alloy, a copper-tin alloy, a copper-nickel alloy, an electrically conductive polymer or a non-metallic material, may be coated, electroplated or electroless plated on a surface of the inner sleeve 40, outer sleeve 62 and nut 64. The nut 64 includes an outer hexagonal section configured to engage with a wrench or a similar tool for locking the coaxial cable connector to the threaded connector 500. Alternatively, the nut 64 may be a square nut, circular nut or wing nut.

Referring to FIGS. 6*a*, 6*b*, 6*c* and 6*k*, the nut 64 includes a main body 640 and the two metal sheets 642 integral with the main body 640, wherein each of the two metal sheets 642 has two separate bottoms, which may extend in a longitudinal direction and may be collinear, joining the back of the main body 640. The nut 64 may include an inner flange 142 protruding annularly in radial inward directions. A blade may be used to cut into the nut 64 so as to form two empty gaps 643 symmetrically at opposite sides of the nut 64 with respect to the axis 97 of the nut 64 and form the two metal sheets 642 at a back side of the main body 640. Each of the two empty gaps 643 is between the main body 640 and a corresponding one of the two metal sheets 642. Each of the two metal sheets 642 may have a thickness between 0.1 and 3 mm, and more particularly between 0.1 and 1.5 mm, between 0.3 and 2 mm, or between 0.5 and 3 mm, for example. Each of the two metal sheets 642 may have an arcuate outer periphery 642*a* with a radian ranging from 45 degrees to 180 degrees for example, and more particularly ranging from 90 degrees to 150 degrees, with respect to the axis 97 of the nut 64. Each of the two metal sheets 642 may have an arcuate inner periphery 642*b* with a radian ranging from 45 degrees to 180 degrees for example, and more particularly ranging from 90 degrees to 150 degrees, with respect to the axis 97 of the nut 64.

Referring to FIGS. 6*a*, 6*b*, 6*c* and 6*k*, each of the two metal sheets 642 may be bent along a corresponding bending line 6421, i.e. along the two separate bottoms of said each of the two metal sheets 642, to the side far away from the main body 640. Each empty gap 643 between the corresponding metal sheet 642 and the main body 640 may cut through an annular wall of the nut 64, separating the arcuate inner periphery 642*b* of the corresponding metal sheet 642 from the main body 640 and separating the arcuate outer periphery 642*a* of the corresponding metal sheet 642 from the main body 640. Each of the metal sheets 642 may have a radial width w4 between its arcuate inner and outer peripheries 642*b* and 642*a*, ranging from 0.1 to 3 mm, and more particularly ranging from 0.1 to 1.5 mm, ranging from 0.3 to 2 mm, or ranging from 0.5 to 3 mm, wherein the arcuate inner periphery 642*b* of each of the metal sheets 642 may contact the inner sleeve 40. Alternatively, a radial space may be kept between the arcuate inner periphery 642*b* of each of the metal sheets 642 and the inner sleeve 40.

Referring to FIGS. 6*a*, 6*b*, 6*c* and 6*k*, in an expanded position, each of the metal sheets 642 extends in a corresponding plane at an acute angle e, ranging from 1 degree to 80 degrees and more particularly ranging from 1 degree to 15 degrees, ranging from 20 degrees to 60 degrees, ranging from 30 degrees to 70 degrees, or ranging from 45 degrees to 80 degrees, for example, to a vertical plane normal to the axis 97 of the nut 64. Each of the empty gaps 643 may become gradually wide from the two bottoms of said each of the empty gaps 643 out away from a diameter of the nut 64 parallel to the corresponding longitudinal direction.

In this embodiment, the number of the metal sheets 642 of the nut 64 is two for illustration. Alternatively, the nut 64 may include any number, such as one, three or four, of metal sheets 642 integral with the main body 640. FIGS. 6*d* and 6*e* are back views showing positions of bending lines relative to nuts with various numbers of metal sheets in accordance with the fifth embodiment of the present invention. For example, the nut 64 may include one metal sheet 642 integral with the main body 640, as illustrated in FIGS. 6*d* and 6*l*. The nut 64 may include four metal sheets 642 integral with the main body 640, as illustrated in FIGS. 6*e* and 6*m*. FIG. 6*l* is a cross-sectional view showing another coaxial cable connector assembled with the nut of FIG. 6*d* in accordance with the fifth embodiment of the present invention. FIG. 6*m* is a cross-sectional view showing another coaxial cable connector assembled with the nut of FIG. 6*e* in accordance with the fifth embodiment of the present invention.

Referring to FIGS. 6*e* and 6*m*, each of the four metal sheets 642 may have a bottom extending in a longitudinal direction and joining the back of the maim body 640. A blade may be used to cut into the nut 64 so as to form four empty gaps 643, each pair of which are symmetrically at opposite sides of the nut 64 with respect to the axis 97 of the nut 64, and form the four metal sheets 642 at the back of the main body 640. Each of the four empty gaps 642 is between the main body 640 and the corresponding metal sheet 642. Each of the four metal sheets 642 may have a thickness between 0.1 and 3 mm, and more particularly between 0.1 and 1.5 mm, between 0.3 and 2 mm, or between 0.5 and 3 mm, for example. Either of the four metal sheets 642 may have an arcuate outer periphery 642*a* with a radian ranging from 60 degrees to 180 degrees for example, and more particularly ranging from 120 degrees to 180 degrees, with respect to the axis 97 of the nut 64. Each of the four metal sheets 642 may be bent along a corresponding bending line 6421, i.e. along the bottom of said each of the four metal sheets 642, to the side far away from the main body 640. Each empty gap 643 between the corresponding metal sheet 642 and the back of the main body 640 may cut into an annular wall of the nut 64 but not through the annular wall of the nut 64, separating the arcuate outer periphery 642*a* of the corresponding metal sheet 642 from the main body 640. In an expanded position, each of the four metal sheets 642 extends in a corresponding plane at an acute angle e, ranging from 1 degrees to 80 degrees and more particularly ranging from 1 degrees to 15 degrees, ranging from 20 degrees to 60 degrees, ranging from 30 degrees to 70 degrees, or ranging from 45 degrees to 80 degrees, for example, to a vertical plane normal to the axis 97 of the nut 64. Each of the four empty gaps 643 may become gradually wide from the bottom of said each of the four empty gaps 643 out away from a diameter of a hole 141 in the nut 64 parallel to the corresponding longitudinal direction.

Referring to FIGS. 6*d* and 6*l*, the metal sheet 642 may have two separate bottoms, which may extend in a longitudinal direction and may be collinear, joining the back of the main body 640. A blade may be used to cut into the nut 64 so as to form an empty gap 643 at a back side of the main body 640. The empty gap 643 is between the main body 640 and the metal sheet 642. The metal sheet 642 may have a thickness between 0.1 and 3 mm, and more particularly between 0.1 and 1.5 mm, between 0.3 and 2 mm, or between 0.5 and 3 mm, for example. The metal sheet 642 may have an arcuate outer periphery 642*a* with a radian ranging from 60 degrees to 300 degrees for example, and more particularly ranging from 150 degrees to 300 degrees, with respect to the axis 97 of the nut 64. The metal sheet 642 may have an arcuate inner periphery 642*b* with a radian ranging from 60 degrees to 300 degrees for example, and more particularly ranging from 150 degrees to 300 degrees, with respect to the axis 97 of the nut 64. The metal sheet 642 may be bent along a corresponding bending line 6421, i.e. along the two separate bottoms of the metal sheet 642, to the side far away from the main body 640. The empty gap 643 between the metal sheet 642 and the front of the main body 640 may cut through an annular wall of the nut 64, separating the arcuate inner periphery 642*b* of the metal sheet 642 from the main body 640 and separating the arcuate outer periphery 642*a* of the metal sheet 642 from the main body 640. The metal sheet 642 may have a radial width w4 between its arcuate inner and outer peripheries 642*b* and 642*a*, ranging from 0.1 to 3 mm, and more particularly ranging from 0.1 to 1.5 mm, ranging from 0.3 to 2 mm, or ranging from 0.5 to 3 mm. In an expanded position, the metal sheet 642 extends in a plane at an acute angle e, ranging from 1 degrees to 80 degrees and more particularly ranging from 1 degrees to 15 degrees, ranging from 20 degrees to 60 degrees, ranging from 30 degrees to 70 degrees, or ranging from 45 degrees to 80 degrees, for example, to a vertical plane normal to the axis 97 of the nut 64. The arcuate inner periphery 642*b* of the metal sheet 642 may contact the inner sleeve 40. Alternatively, a radial space may be kept between the arcuate inner periphery 642*b* of the metal sheet 642 and the inner sleeve 40.

Referring to FIGS. 6*a*-6*e* and 6*k*-6*m*, each of the metal sheets 642 may be made of an electrically conductive material, such as copper, iron, silver, nickel, tin, gold, a copper-gold alloy, a copper-tin alloy, a copper-nickel alloy or an electrically conductive polymer or a non-metallic conductor. An antirust metal layer that is an electrically conductive material, such as copper, iron, silver, nickel, tin, gold, a copper-gold alloy, a copper-tin alloy, a copper-nickel alloy, an electrically conductive polymer or a non-metallic material, may be coated, electroplated or electroless plated on a surface of said each of the metal sheets 642.

Referring to FIGS. 6*a*-6*e* and 6*k*-6*m*, for assembling the coaxial cable connector, the inner sleeve 40 may have a rear extension portion 108 to be first inserted from a front end of the nut 64 into the hole 141 in the nut 64 until the inner sleeve 40 may have an outer flange 104 abutting against and contacting an inner flange 142 of the nut 64 and the inner flange 142 of the nut 64 may be arranged around an annular surface 406 of the inner sleeve 40. After the nut 64 is assembled with the inner sleeve 40, the inner sleeve 40 may have a rear extension portion 108 to be first inserted from a front end of the outer sleeve 62 into a hole 421 in the outer sleeve 62 and then the outer sleeve 62 may have an inner flange 424 tightly fitting with the inner sleeve 40 and around the annular surface 406 of the inner sleeve 40. The nut 64 has the metal sheets 642 generating an elastic force against a front of the outer sleeve 62 such that the nut 64 has the inner flange 142 pressing the outer flange 104 of the inner sleeve 40. Thereby, the nut 64 may be restricted not to move in an axial direction around the inner sleeve 40, but the nut 64 may rotate around the inner sleeve 40.

Figure 6F:
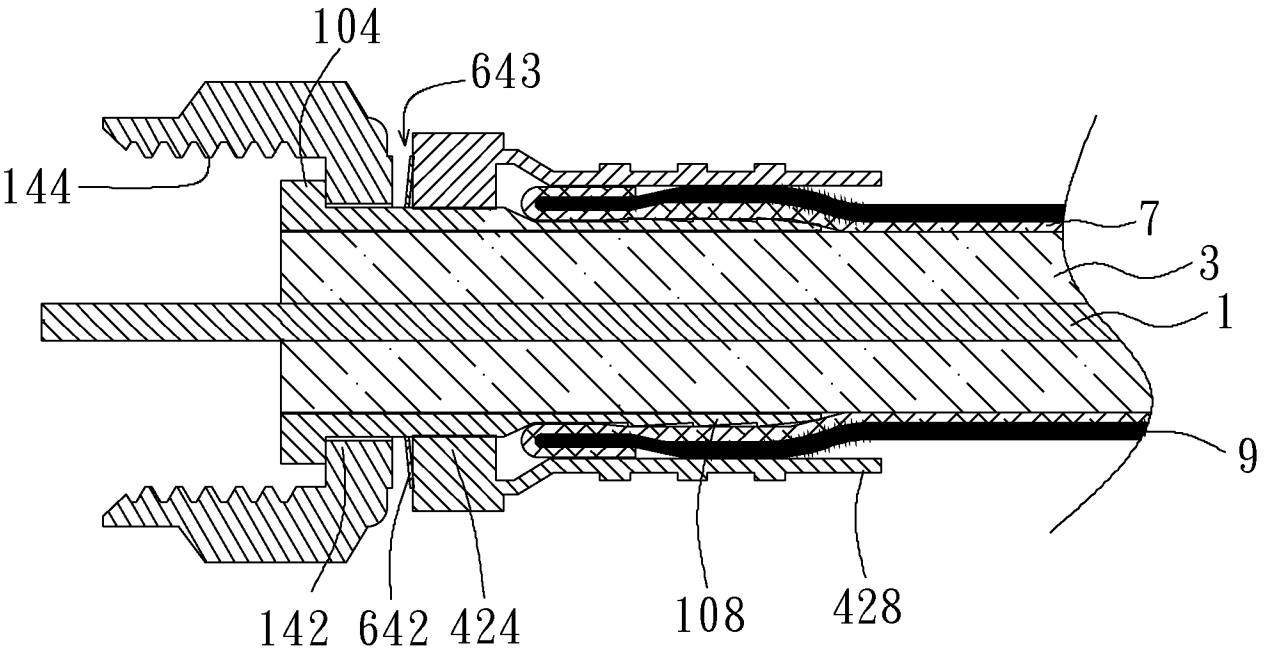
FIG. 6*f* is a cross-sectional view showing the coaxial cable connector assembled with a coaxial cable in accordance with the fifth embodiment of the present invention.

FIG. 6*f* is a cross-sectional view showing the coaxial cable connector assembled with a coaxial cable in accordance with the fifth embodiment of the present invention. Referring to FIG. 6*f*, for assembling the coaxial cable as illustrated in FIG. 1 with the axial cable connector, the metal braided film 7 has a front portion folded back over an outer surface of the plastic jacket 9. Next, the coaxial cable has the metal wire 1, insulating layer 3 and thin metal film 5 to be inserted from a back end of the inner sleeve 40 into the hole 101 in the inner sleeve 40 and the folded front portion of the metal braided film 7 and the plastic jacket 9 are inserted from a back end of the outer sleeve 62 into an annular space between the rear extension portion 108 of the inner sleeve 60 and a rear extension portion 428 of the outer sleeve 62. The metal wire 1 extends through the hole 101 in the inner sleeve 40 and to a space, surrounded by the inner thread 144 of the nut 64, outside the hole 101. Next, the outer sleeve 62 may be radially pressed by a tool such that the outer sleeve 62 may deform in radial inward directions to press the plastic jacket 9 so as to fix the coaxial cable with the coaxial cable connector.

Figure 6G:
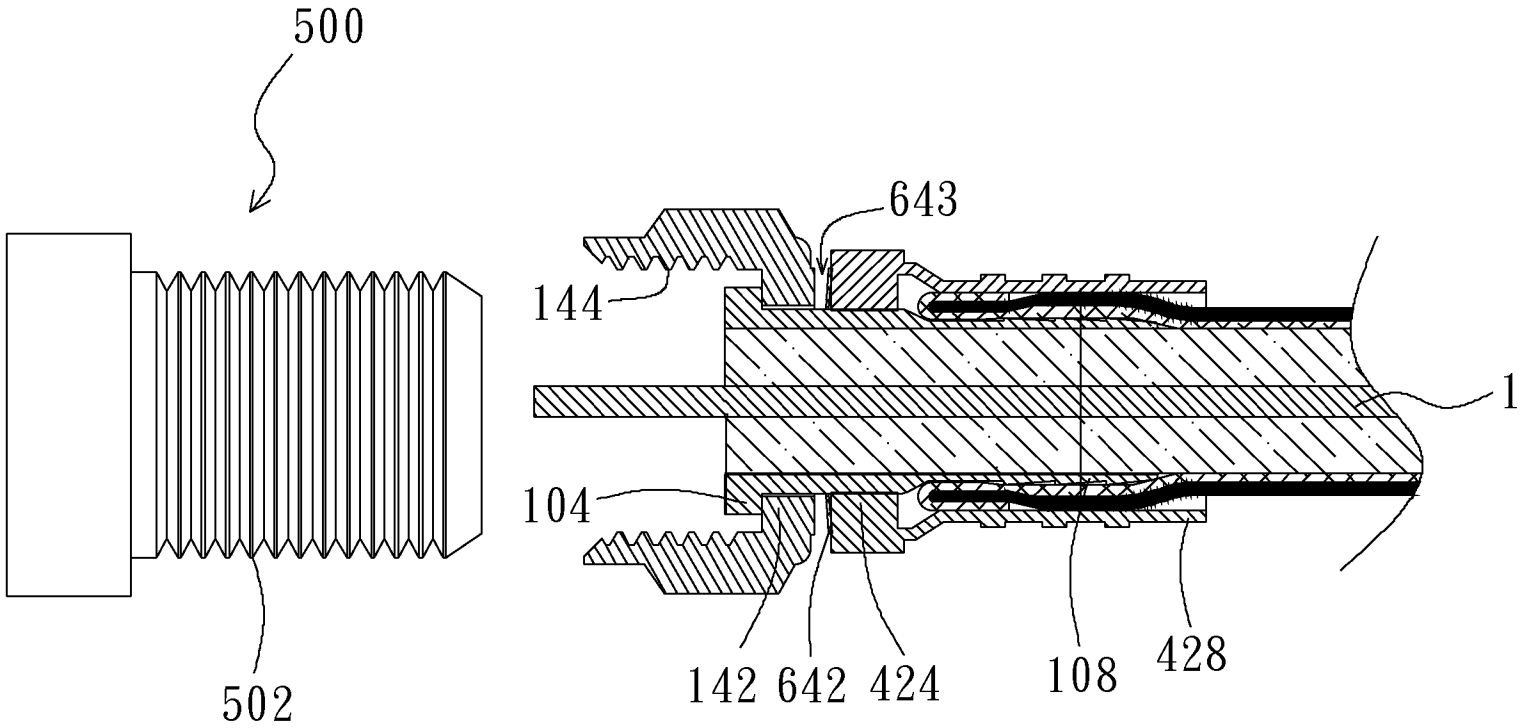
FIGS. 6*g* and 6*h* are cross-sectional views showing the coaxial cable connector before and after assembled with a thread connector in accordance with the fifth embodiment of the present invention.
Figure 6H:
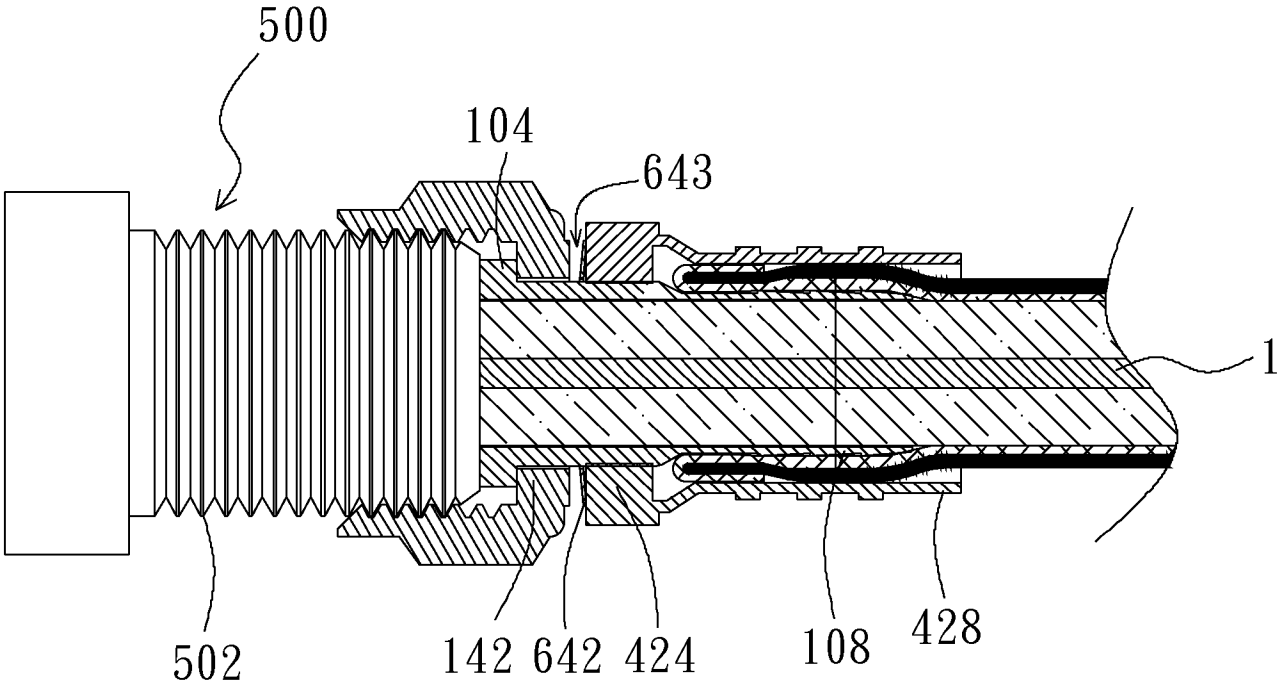

FIGS. 6*g* and 6*h* are cross-sectional views showing the coaxial cable connector before and after assembled with a thread connector in accordance with the fourth embodiment of the present invention. Referring to FIGS. 6*g* and 6*h*, the coaxial cable connector may be locked to the treaded connector 500 mounted on an electronic device or an adapter, such as a T-shaped or F-shaped adaptor, for connecting the coaxial cable to another coaxial cable. The coaxial cable fixed with the coaxial cable connector may have the metal wire 1 to be inserted into a hole in the threaded connector 500 and the nut 64 has the inner thread 144 engaging with the outer thread 502 of the threaded connector 500 so as to be screwed on the threaded connector 500. When the nut 64 is being screwed on the threaded connector 500, the outer flange 104 of the inner sleeve 40 may move to the threaded connector 500 in the axial direction and then may contact the threaded connector 500. No matter whether the nut 64 is fully locked to the threaded connector 500 or not, the nut 64 has the metal sheets 642 always abutting against and contacting a front of the outer sleeve 62 with the angle e such that the nut 64 has the inner flange 142 stopping at the outer flange 104 of the inner sleeve 40 and good electrical or ground connection between the inner sleeve 40 and the nut 64 may be provided. Thereby, the metal sheets 642 may always contact the outer sleeve 62 so as to provide good electrical or ground connection between the outer sleeve 62 and the nut 64. Even when the coaxial cable is casually pulled such that the nut 64 is not fully locked to the threaded connector 500, good electrical or ground connection between the inner sleeve 40 and the nut 64 and between the outer sleeve 62 and the nut 64 may still be provided by the metal sheets 642 always generating an elastic force against the outer sleeve 62 so as to lead the inner flange 142 of the nut 64 to always press the outer flange 104 of the inner sleeve 61. Accordingly, the coaxial cable connector may transmit signals with improved quality.

Figure 6I:
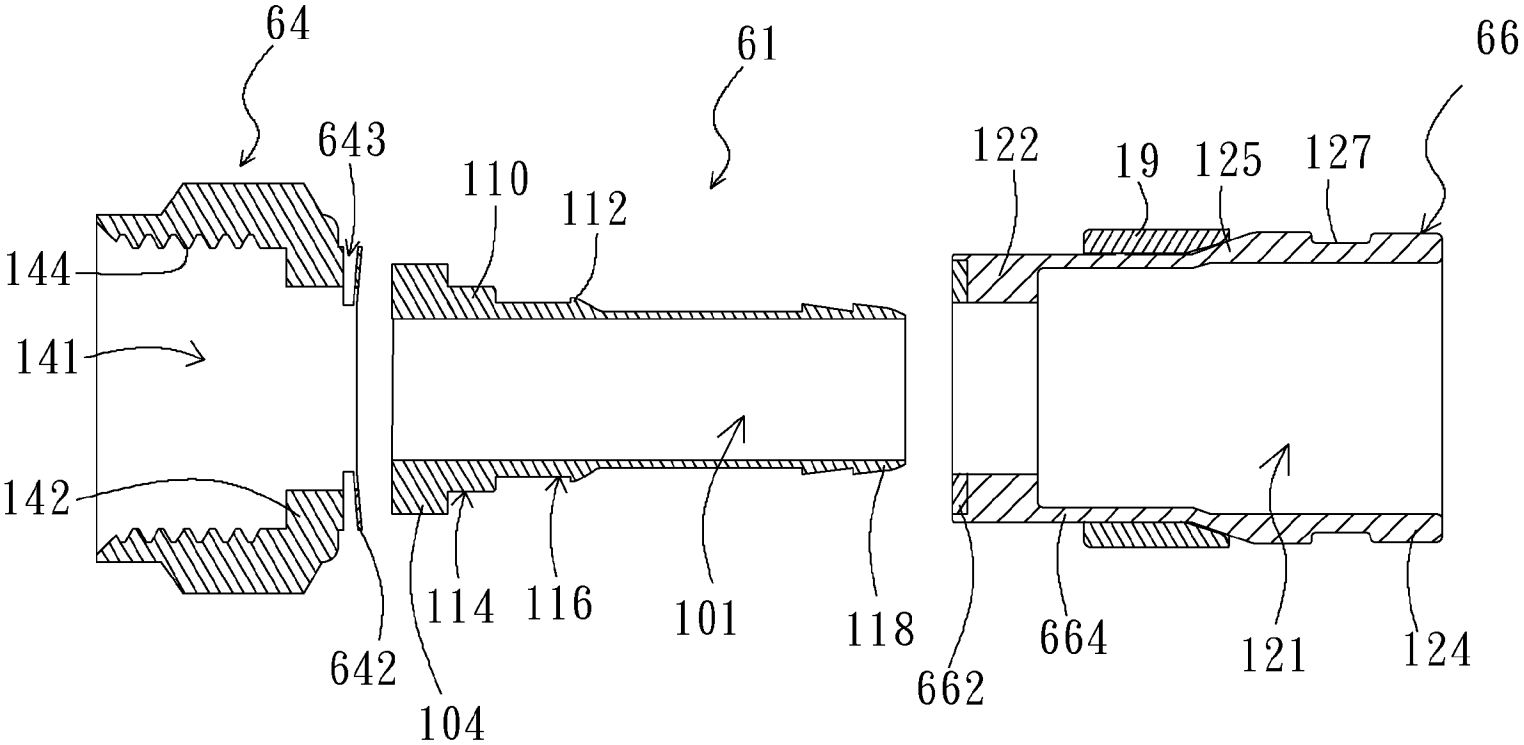
FIG. 6*i* is a cross-sectional exploded view showing another coaxial cable connector in accordance with the fifth embodiment of the present invention.
Figure 6J:
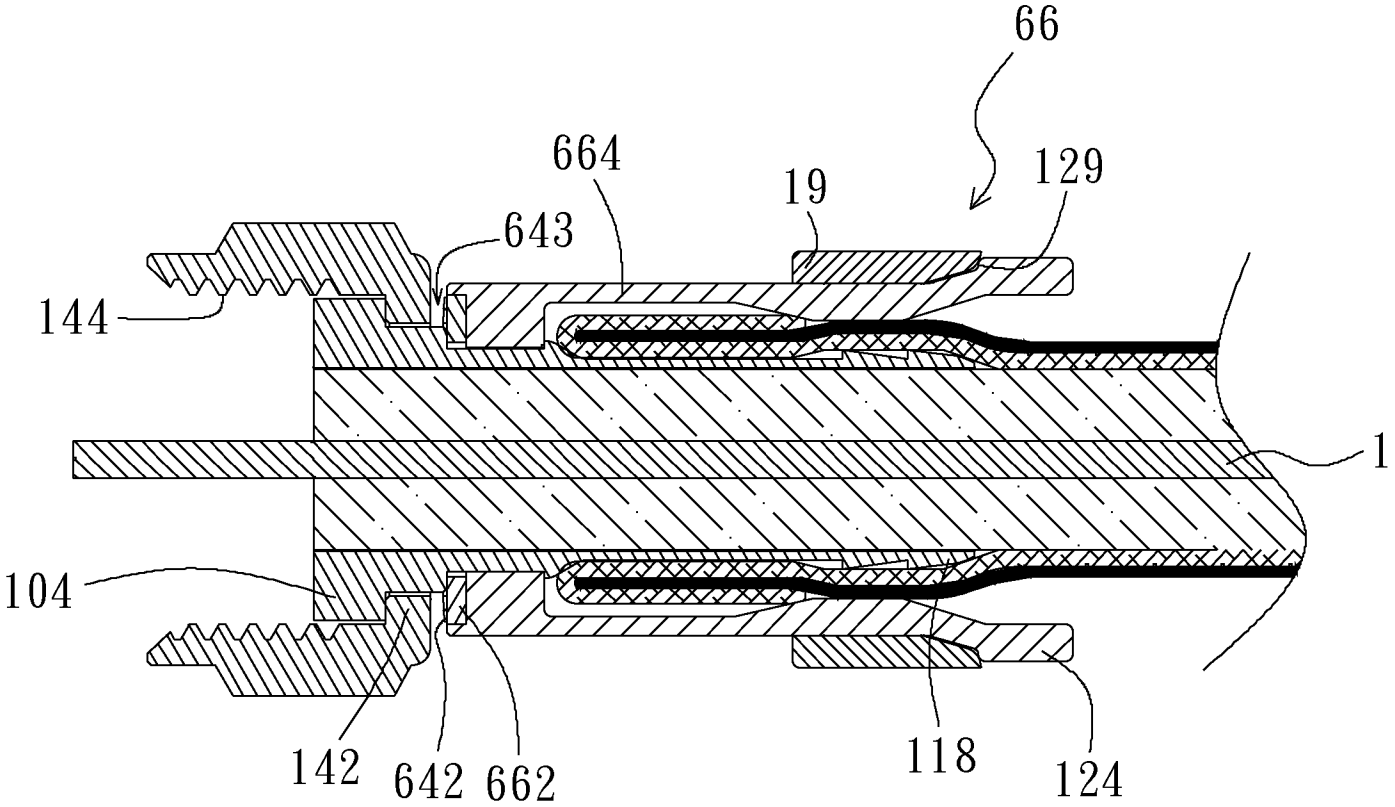
FIG. 6*j* is a cross-sectional view showing the another coaxial cable connector assembled with a coaxial cable in accordance with the fifth embodiment of the present invention.
Figure 6K:
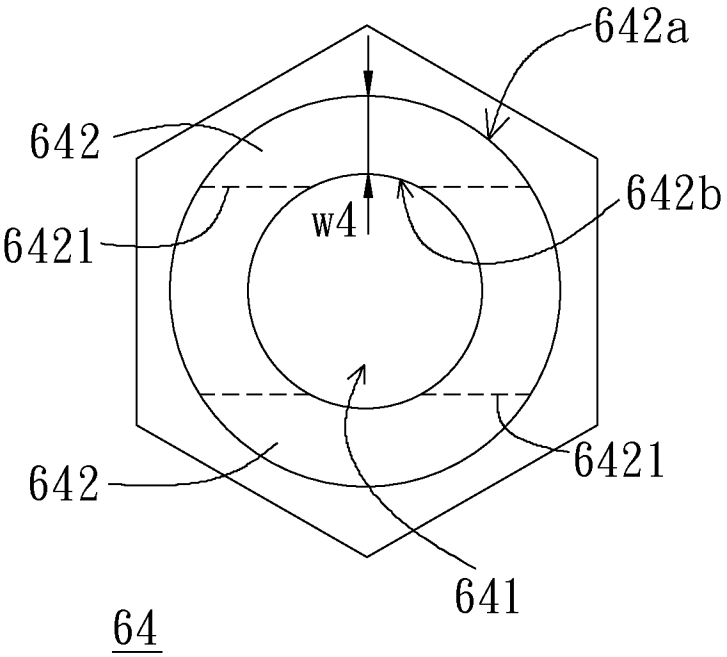
FIG. 6*k* is a back view showing positions of bending lines relative to the nut with two metal sheets before bent along the bending lines in accordance with the fifth embodiment of the present invention.
Figure 61:
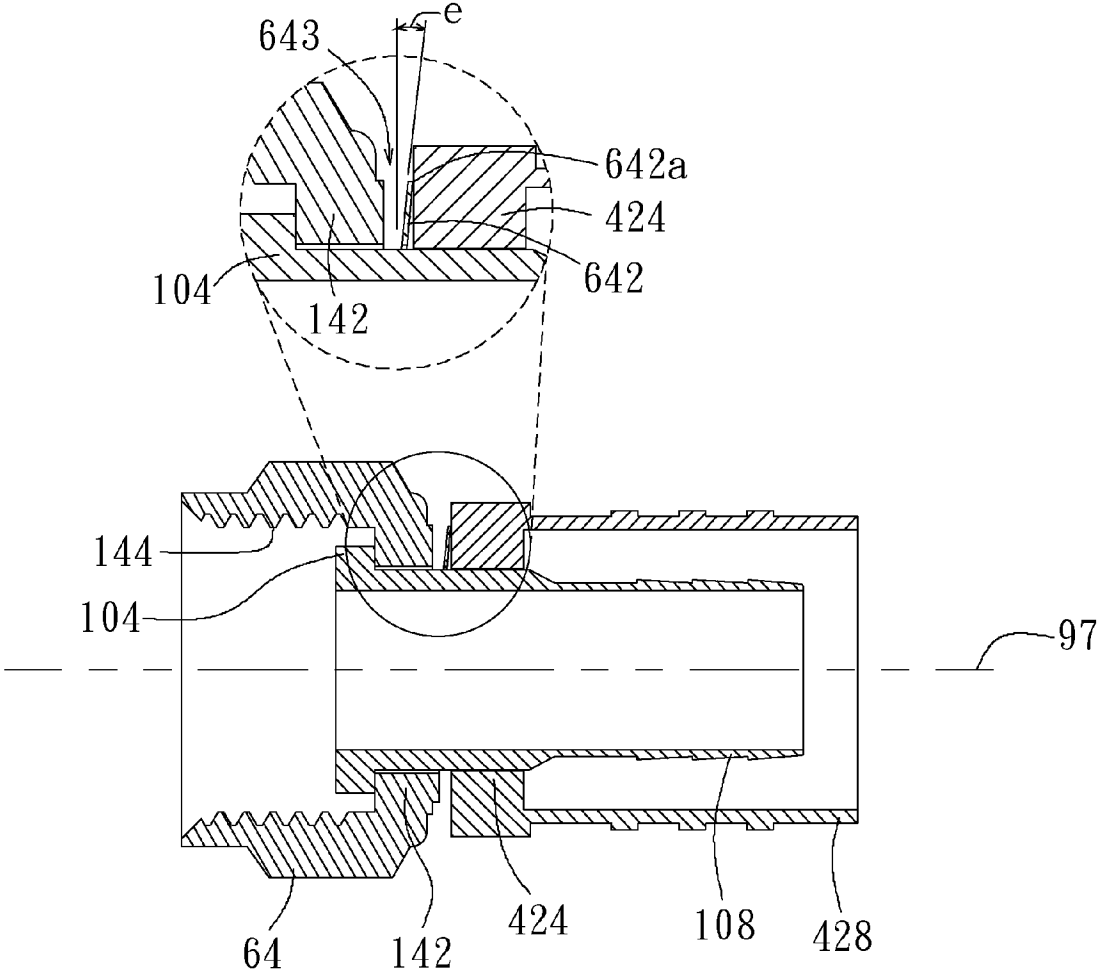
Figure 6M:
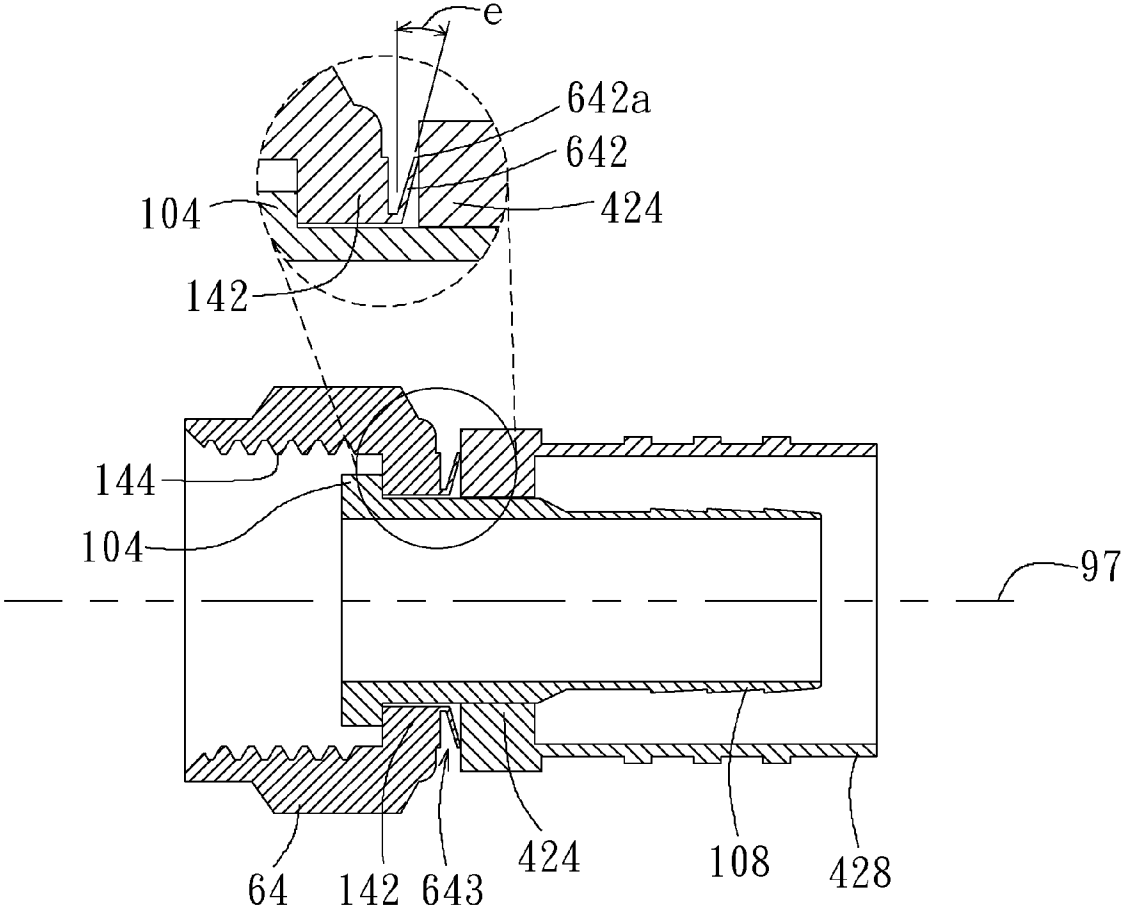
FIG. 6*m* is a cross-sectional view showing another coaxial cable connector assembled with the nut of FIG. 6*e* in accordance with the fifth embodiment of the present invention.

FIG. 6*i* is a cross-sectional exploded view showing another coaxial cable connector in accordance with the fifth embodiment of the present invention. FIG. 6*j* is a cross-sectional view showing the another coaxial cable connector assembled with a coaxial cable in accordance with the fifth embodiment of the present invention. Referring to FIGS. 6*i* and 6*j*, another outer sleeve 66 may be provided to replace the outer sleeve 62 illustrated in FIGS. 6*a*-6*h* and 6*k*-6*m*. The outer sleeve 66 is similar to the outer sleeve 12 illustrated in the first embodiment except that the outer sleeve 66 may include a main body 664 that is a non-metallic material or a non-electrically conductive material, such as a plastic material, and a metal ring 662 tightly fixed with the main body 664 and at a front side of the main body 664 and coaxially arranged with the main body 664 with respect to an axis of the outer sleeve 66. The metal ring 662 may have an inner annular periphery substantially coplanar with an inner annular periphery of an inner flange 122 of the main body 664. The metal ring 662 may have an inner diameter substantially the same as an inner diameter of the inner flange 122 of the main body 664. Alternatively, the metal ring 662 may be coaxially arranged with the main body 664 with respect to an axis of the outer sleeve 66 and has an inner diameter greater than an inner diameter of the inner flange 122 of the main body 664. The metal ring 662 may be made of an electrically conductive material, such as copper, iron, silver, nickel, tin, gold, a copper-gold alloy, a copper-tin alloy, a copper-nickel alloy or an electrically conductive polymer or a non-metallic conductor. An antirust metal layer that is an electrically conductive material, such as copper, iron, silver, nickel, tin, gold, a copper-gold alloy, a copper-tin alloy, a copper-nickel alloy, an electrically conductive polymer or a non-metallic material, may be coated, electroplated or electroless plated on a surface of the metal ring 662.

Referring to FIGS. 6*i* and 6*j*, the arrangement of the metal ring 19 around the outer sleeve 66 may be referred to that of the metal ring 19 around the outer sleeve 12 as illustrated in the first embodiment. For assembling the coaxial cable connector, the inner sleeve 61, having a similar structure as that of the inner sleeve 10 illustrated in the first embodiment, may have a rear extension portion 118 to be first inserted from a front end of the nut 64 into the hole 141 in the nut 64 until the outer flange 104 of the inner sleeve 61 may abut against and contact the inner flange 142 of the nut 64 and the inner flange 142 of the nut 64 may be arranged around an cylindrical surface 114 of the inner sleeve 61. After the nut 64 is assembled with the inner sleeve 61, the inner sleeve 61 may have the rear extension portion 118 to be inserted from a front end of the outer sleeve 66 into the hole 121 in the outer sleeve 66 and then the inner flange 122 of the outer sleeve 66 may tightly fit with the inner sleeve 61 and around an annular surface 116 of the inner sleeve 61. The nut 64 has the metal sheets 642 generating an elastic force against the metal ring 662 such that the nut 64 has the inner flange 142 pressing the outer flange 104 of the inner sleeve 61. Thereby, the nut 64 may be restricted not to move in the axial direction around the inner sleeve 61, but the nut 64 may rotate around the inner sleeve 61.

Referring to FIGS. 6*i* and 6*j*, for assembling the coaxial cable as illustrated in FIG. 1 with the axial cable connector, the metal braided film 7 has a front portion folded back over an outer surface of the plastic jacket 9. Next, the coaxial cable has the metal wire 1, insulating layer 3 and thin metal film 5 to be inserted from a back end of the inner sleeve 61 into the hole 101 in the inner sleeve 61 and the folded front portion of the metal braided film 7 and the plastic jacket 9 are inserted from a back end of the outer sleeve 66 into an annular space between the rear extension portion 118 of the inner sleeve 61 and a rear extension portion 124 of the outer sleeve 66. The metal wire 1 extends through the hole 101 in the inner sleeve 61 and to a space, surrounded by the inner thread 144 of the nut 64, outside the hole 101. Next, the metal ring 19 may move backwards in the axial direction around the outer sleeve 66 such that the deformable portion 125 of the outer sleeve 66 may deform in radial inward directions to press the plastic jacket 9 of the coaxial cable with the outer sleeve 66 having a deformed cone surface, which was at a bottom of a trench 127 before the outer sleeve 66 is deformed, engaging with and abutting against the inner cone surface of the metal ring 19, wherein a third slope angle between the deformed cone surface and an axis 98 of the outer sleeve 66 may range from 5 degrees to 45 degrees and may be substantially equal to the first slope angle. Thereby, the coaxial cable may be fixed with the coaxial cable connector. At this time, the metal ring 19 has a rear end abutting against a step 129 of the outer sleeve 66, which was at a rear wall of the trench 127 before the deformable portion 125 is deformed in the radial inward directions.

Accordingly, no matter whether the nut 64 is fully locked to the threaded connector 500 or not, the nut 64 has the metal sheets 642 always generating an elastic force against the metal ring 662 with the angle e such that the nut 64 has the inner flange 142 always pressing the outer flange 104 of the inner sleeve 61. Thereby, good electrical or ground connection may be provided between the nut 64 and the inner sleeve 61. Even when the coaxial cable is casually pulled such that the nut 64 is not fully locked to the threaded connector 500, good electrical or ground connection between the nut 64 and the inner sleeve 61 may still be provided by the metal sheets 642 always generating an elastic force against the metal ring 662 so as to lead the inner flange 142 of the nut 64 to always press the outer flange 104 of the inner sleeve 61. Accordingly, the coaxial cable connector may transmit signals with improved quality.

Sixth Embodiment

Figure 7A:
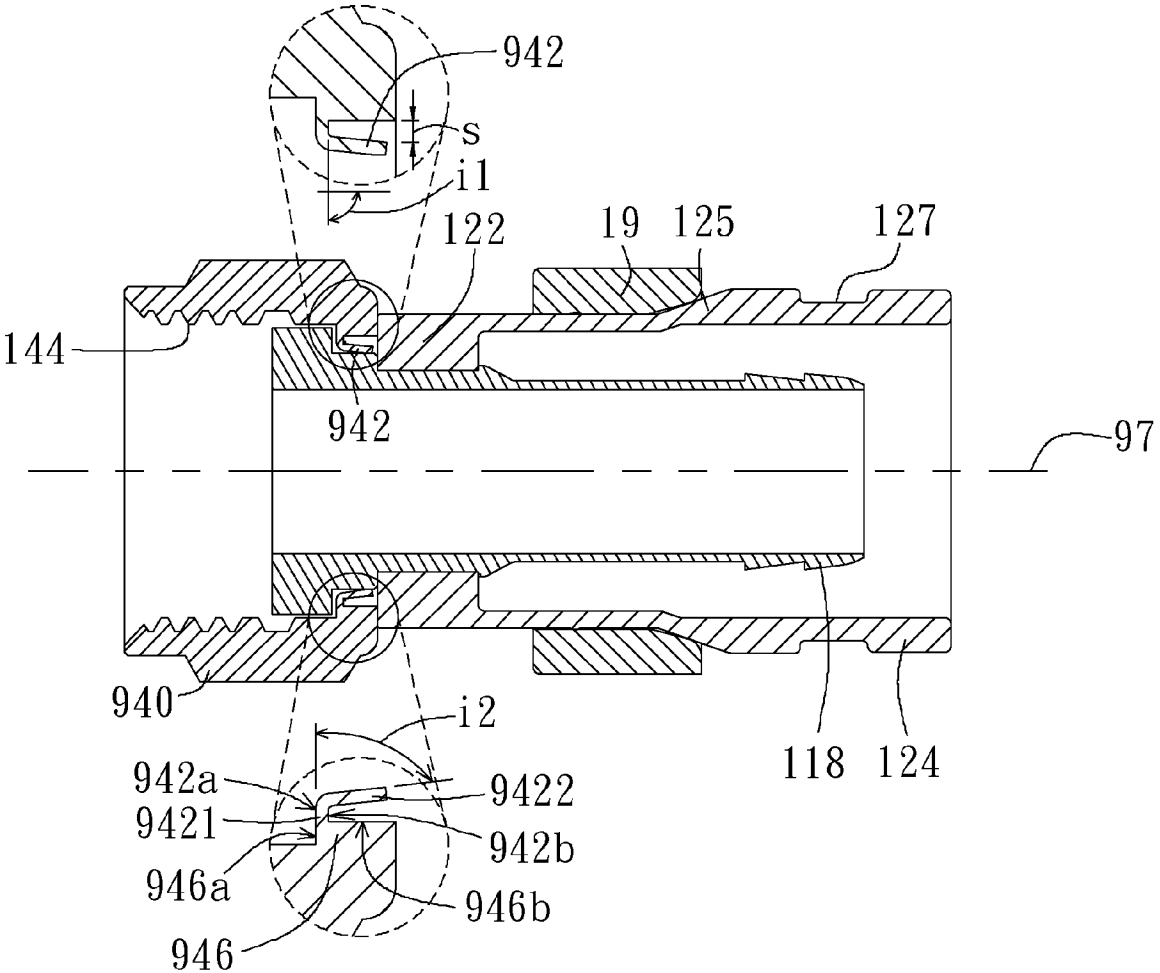
FIG. 7*a* is a cross-sectional view showing a coaxial cable connector in accordance with a sixth embodiment of the present invention.
Figure 7B:
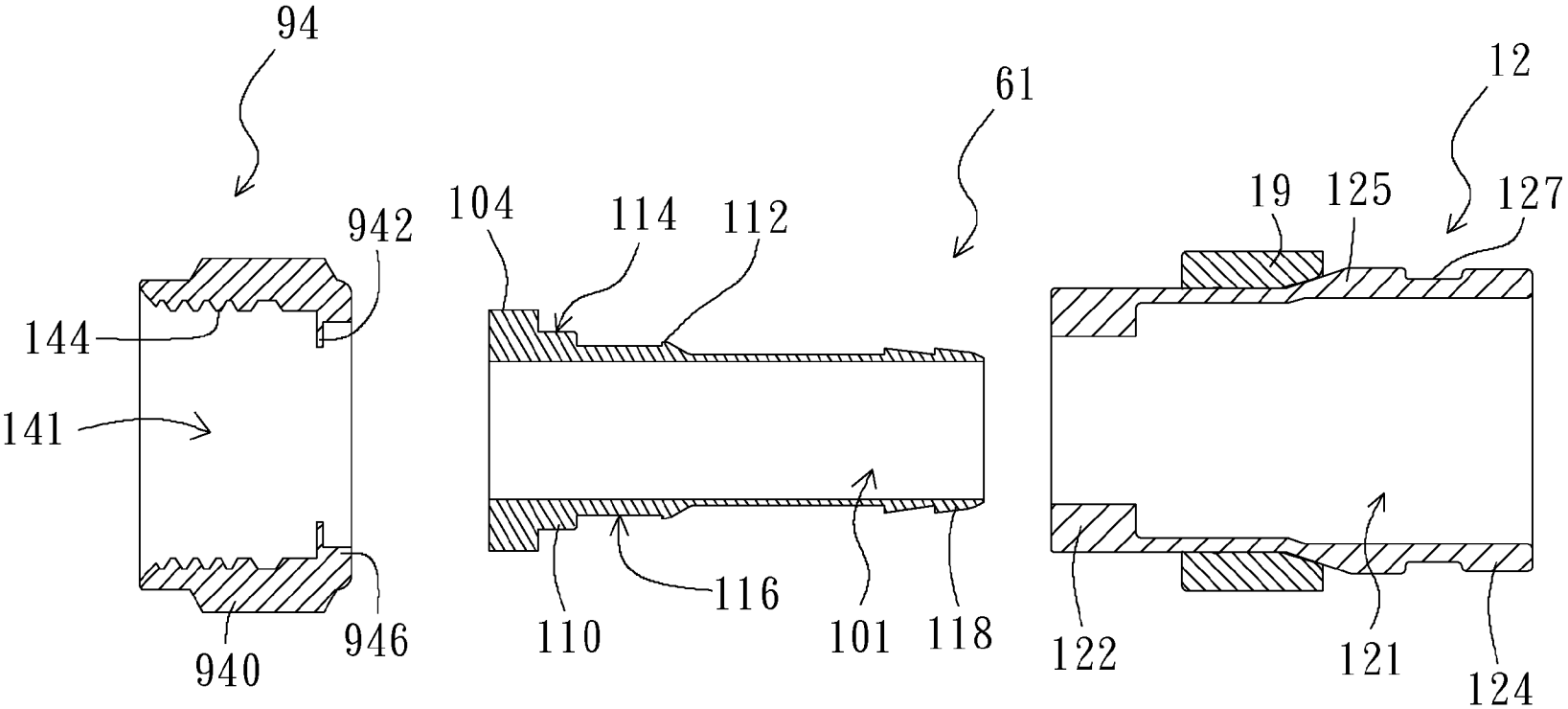
FIG. 7*b* is a cross-sectional exploded view showing the coaxial cable connector in accordance with the sixth embodiment of the present invention.
Figure 7D:
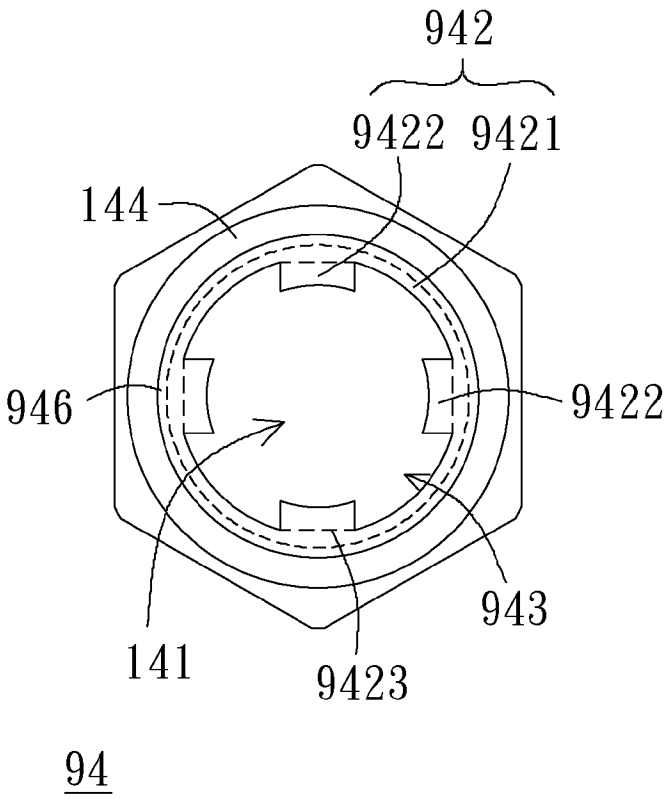
FIGS. 7*d*-7*f* are front views showing the nuts provided with metal sheets having various numbers of bends in accordance with the sixth embodiment of the present invention.
Figure 7C:
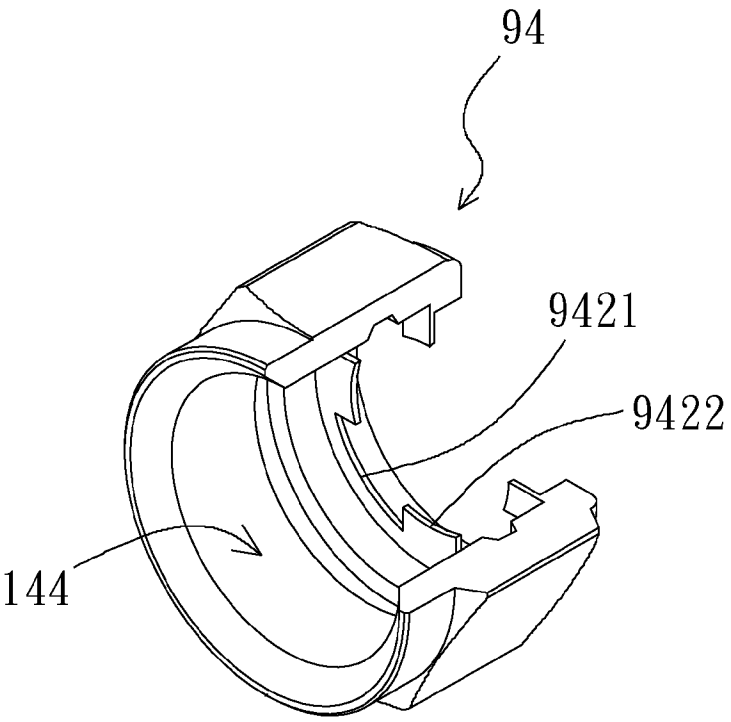
FIG. 7*c* is a perspective cross-sectional view showing a nut in accordance with the sixth embodiment of the present invention.

FIG. 7*a* is a cross-sectional view showing a coaxial cable connector in accordance with a sixth embodiment of the present invention. FIG. 7*b* is a cross-sectional exploded view showing the coaxial cable connector in accordance with the sixth embodiment of the present invention. FIG. 7*c* is a perspective cross-sectional view showing a nut in accordance with the sixth embodiment of the present invention. FIG. 7*d* is a front view showing the nut provided with a metal sheet having two bending portions in accordance with the sixth embodiment of the present invention. Elements in the sixth embodiment having the same reference number as those in the first and/or fifth embodiments may refer to those illustrated in the first and/or fifth embodiments. Referring to FIGS. 7*a*-7*d*, the coaxial cable connector includes an inner sleeve 61, an outer sleeve 12, a nut 94 and a metal ring 19 coaxially arranged with respect to an axis 97 of the nut 94. Either one of the inner sleeve 61, nut 94 and metal ring 19 may be made of an electrically conductive material, such as copper, iron, silver, nickel, tin, gold, a copper-gold alloy, a copper-tin alloy, a copper-nickel alloy or an electrically conductive polymer or a non-metallic conductor. An antirust metal layer that is an electrically conductive material, such as copper, iron, silver, nickel, tin, gold, a copper-gold alloy, a copper-tin alloy, a copper-nickel alloy, an electrically conductive polymer or a non-metallic material, may be coated, electroplated or electroless plated on a surface of the inner sleeve 61, nut 94 and metal ring 19. The outer sleeve 12 may be made of a plastic material or an organic polymer. Alternatively, the outer sleeve 12 may be made of a metallic material, such as copper, iron, silver, nickel, tin, gold, a copper-gold alloy, a copper-tin alloy or a copper-nickel alloy, an electrically conductive polymer or a non-metallic material.

Referring to FIGS. 7*a*-7*d*, the nut 94 includes a main body 940 and a metal sheet 942 integral with an inner flange 946 of the main body 940 protruding annularly in radial inward directions. The metal sheet 942 may protrude inwards from the inner flange 946 in radial inward directions normal to the axis 97 of the nut 94. The metal sheet 942 may have a ring portion 9421 and four bends 9422 integral with the ring portion 9421, wherein the ring portion 9421 may have an outer periphery joining the inner flange 946 of the nut 94 protruding annularly in radial inward directions and an inner periphery joining the four bends 9422 with four arcuate gaps 943, each pair of which are symmetrically at opposite sides with respect to the axis 97 of the nut 94 and each of which is between neighboring two of the four bends 9422 in a circumferential direction about the axis 97 of the nut 94. Each of the bends 9422 may have a fixed end fixed to the ring portion 9421 and a free end abutting against a cylindrical surface 114 of the inner sleeve 61. The ring portion 9421 has four inner arcuate peripheries 9421*a* at outer arcuate sides of the four respective arcuate gaps 943, wherein either of the four inner arcuate peripheries 9421*a* may have a radian ranging from 30 degrees to 90 degrees, and more particularly ranging from 30 degrees to 75 degrees or ranging from 70 degrees to 90 degrees, with respect to the axis 97 of the nut 94 and may have an arc length between 1 mm and 7 mm and more particularly between 2 mm and 5 mm. For example, each of the four inner arcuate peripheries 9421*a* may have a radian ranging from 30 degrees to 75 degrees with respect to the axis 97 of the nut 94 and may have an arc length between 2 mm and 5 mm. The metal sheet 942, i.e. the ring portion 9421, may have a first surface 942*a* continuous with a front annular surface 946*a* of the inner flange 946 at a plane vertical to the axis 97 of the nut 94. The metal sheet 942, i.e. the ring portion 9421, may have a second surface 942*b*, opposite to the first surface 942*a* thereof, contacting an inner cylindrical surface of the inner flange 942 at an angle it ranging from 45 to 90 degrees, such as 90 degrees. The metal sheet 92 may have a thickness between 0.1 and 3 mm, and more particularly between 0.1 and 1.5 mm, between 0.3 and 2 mm, or between 0.5 and 3 mm, for example. The four bends 9422 and the ring portion 9421 may extend in the same plane vertical to the axis 97 of the nut 94.

Figure 7F:
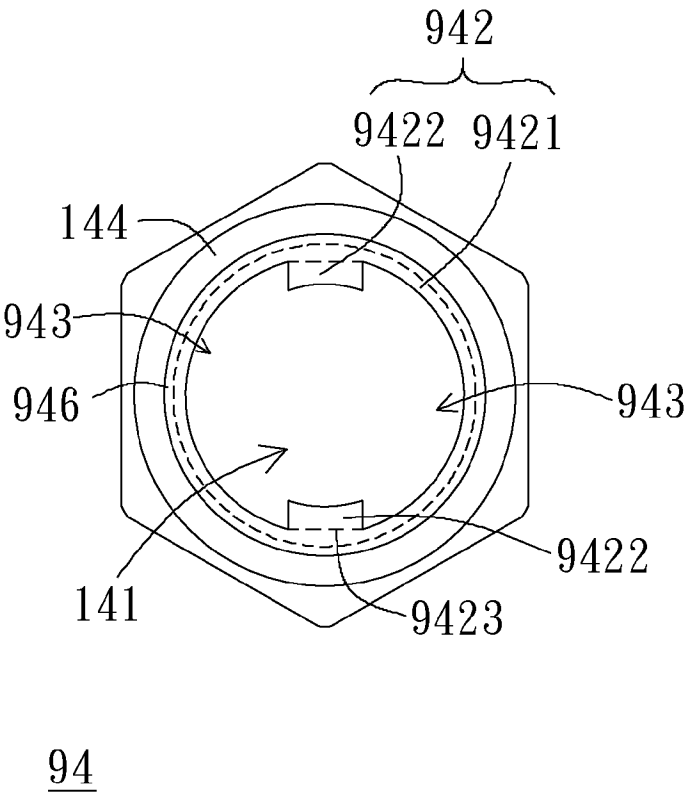
Figure 7E:
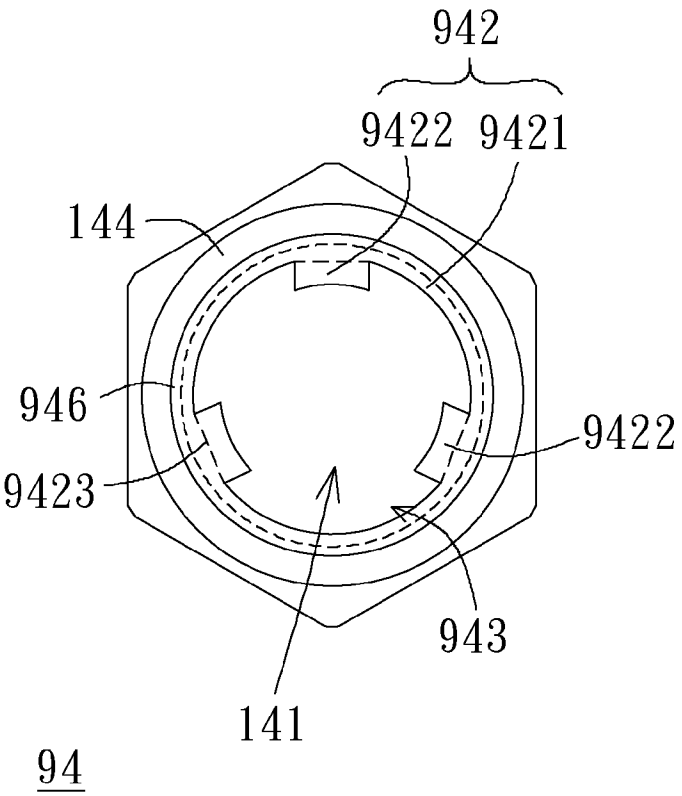

In this embodiment, the number of the bends 9422 of the metal sheet 942 is four for illustration. Alternatively, the metal sheet 942 may include any number, such as one, three or four, of bends 9422 integral with the ring portion 9421. For example, FIGS. 7*e* and 7*f* are front views showing the nut provided with a metal sheet having various numbers of bends in accordance with the sixth embodiment of the present invention. The metal sheet 942 may include three bends 9422 integral with the ring portion 9421, as illustrated in FIG. 7*e*, wherein either of the three bends 9422 in FIG. 7*e* may have the same feature as illustration for one of the four bends 9422 in FIGS. 7*a*-7*d* and the ring portion 9421 in FIG. 7*e* may have the same feature as illustration for the ring portion 9421 in FIGS. 7*a*-7*d* except with three arcuate gaps 943 each between neighboring two of the three bends 9422 in a circumferential direction about the axis 97 of the nut 94. The ring portion 9421 has three inner arcuate peripheries 9421*a* at outer arcuate sides of the three respective arcuate gaps 943, wherein either of the three inner arcuate peripheries 9421*a* may have a radian ranging from 30 degrees to 150 degrees, and more particularly ranging from 60 degrees to 100 degrees, with respect to the axis 97 of the nut 94 and may have an arc length between 2 mm and 10 mm and more particularly between 3 mm and 7 mm. For example, each of the three inner arcuate peripheries 9421*a* may have a radian ranging from 60 degrees to 100 degrees with respect to the axis 97 of the nut 94 and may have an arc length between 3 mm and 7 mm.

Alternatively, the metal sheet 942 may include two bends 9422 integral with the ring portion 9421, as illustrated in FIG. 7*f*, wherein either of the two bends 9422 in FIG. 7*f* may have the same feature as illustration for one of the four bends 9422 in FIGS. 7*a*-7*d* and the ring portion 9421 in FIG. 7*e* may have the same feature as illustration for the ring portion 9421 in FIGS. 7*a*-7*d* except with two arcuate gaps 943 symmetrically at opposite sides with respect to the axis 97 of the nut 94, wherein each of the two arcuate gaps 943 is between the bends 9422 in a circumferential direction about the axis 97 of the nut 94. The ring portion 9421 has two inner arcuate peripheries 9421*a* at outer arcuate sides of the two respective arcuate gaps 943, wherein either of the two inner arcuate peripheries 9421*a* may have a radian ranging from 30 degrees to 210 degrees, and more particularly ranging from 120 degrees to 165 degrees, with respect to the axis 97 of the nut 94 and may have an arc length between 3 mm and 12 mm and more particularly between 4 mm and 10 mm. For example, each of the two inner arcuate peripheries 9421*a* may have a radian ranging from 120 degrees to 165 degrees with respect to the axis 97 of the nut 94 and may have an arc length between 4 mm and 10 mm.

Referring to FIGS. 7*a*-7*f*, the ring portion 9421 and bends 9422 of each of the metal sheets 942 may be made of the same electrically conductive material, such as copper, iron, silver, nickel, tin, gold, a copper-gold alloy, a copper-tin alloy, a copper-nickel alloy or an electrically conductive polymer or a non-metallic conductor. An antirust metal layer that is an electrically conductive material, such as copper, iron, silver, nickel, tin, gold, a copper-gold alloy, a copper-tin alloy, a copper-nickel alloy, an electrically conductive polymer or a non-metallic material, may be coated, electroplated or electroless plated on a surface of the ring portion 9421 and bends 9422 of said each of the metal sheets 942.

Figure 7H:
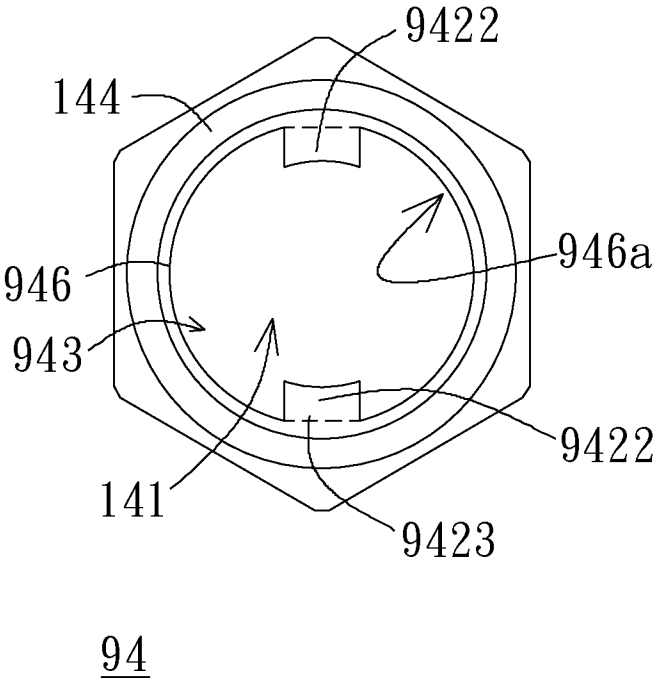
FIG. 7*h* is a front view showing another type of nut without any ring portion but with two bends in accordance with the sixth embodiment of the present invention.
Figure 7G:
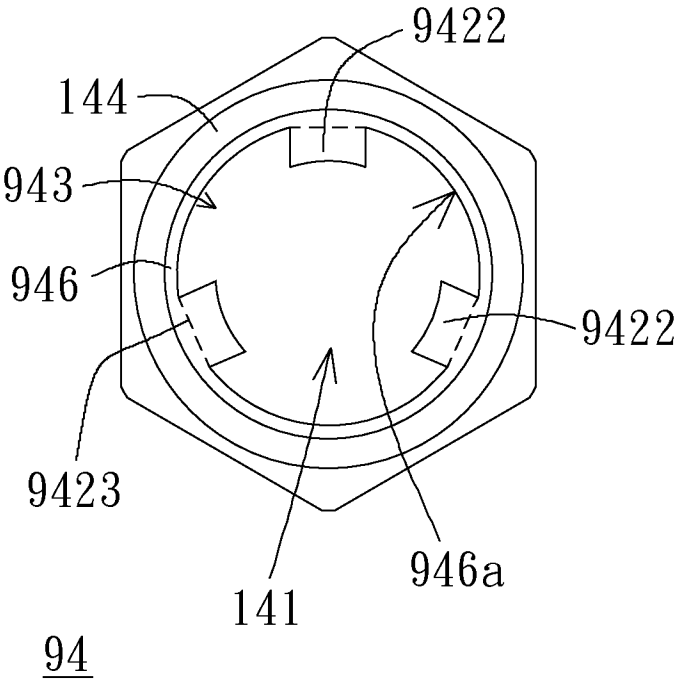
FIG. 7*g* is a front view showing another type of nut without any ring portion but with three bends in accordance with the sixth embodiment of the present invention.

Alternatively, the ring portion 9421 of the metal sheet 942 may be omitted and each of the bends 9422 may have an outer periphery joining the inner flange 946 of the nut 94, as seen in FIGS. 7*g*, 7*h* and 7*l*. FIG. 7*g* is a front view showing another type of nut without any ring portion but with three bends in accordance with the sixth embodiment of the present invention. FIG. 7*h* is a front view showing another type of nut without any ring portion but with two bends in accordance with the sixth embodiment of the present invention. FIG. 7*l* is a front view showing another type of nut without any ring portion but with four bends in accordance with the sixth embodiment of the present invention. Referring to FIG. 7*l*, the nut 97 and the assembling for the nut 97 may be referred to those illustrated in FIGS. 7*a*-7*d*. The inner flange 946 of the nut 94 may have four inner arcuate peripheries 946*a* at outer arcuate sides of the four respective arcuate gaps 943, wherein either of the four inner arcuate peripheries 946*a* may have a radian ranging from 30 degrees to 90 degrees, and more particularly ranging from 30 degrees to 75 degrees or ranging from 70 degrees to 90 degrees, with respect to the axis 97 of the nut 94 and may have an arc length between 1 mm and 7 mm and more particularly between 2 mm and 5 mm. For example, each of the four inner arcuate peripheries 946*a* may have a radian ranging from 30 degrees to 75 degrees with respect to the axis 97 of the nut 94 and may have an arc length between 2 mm and 5 mm. Each of the bends 9422 may have a fixed end fixed to the inner flange 946 of the nut 94 and a free end abutting against the cylindrical surface 114 of the inner sleeve 61. Each of the bends 9422 may have a first surface continuous with the front annular surface 946*a* of the inner flange 946 at a plane vertical to the axis 97 of the nut 94. Each of the bends 9422 may have a second surface, opposite to the first surface thereof, contacting the inner cylindrical surface of the inner flange 942 at an angle i1 ranging from 45 to 90 degrees, such as 90 degrees. Each of the bends 9422 may have a thickness between 0.1 and 3 mm, and more particularly between 0.1 and 1.5 mm, between 0.3 and 2 mm, or between 0.5 and 3 mm, for example. The four bends 9422 may extend in the same plane vertical to the axis 97 of the nut 94.

Referring to FIG. 7*g*, the nut 94 may include three bends 9422 integral with the inner flange 946 of the nut 94, wherein either of the three bends 9422 in FIG. 7*g* may have the same feature as illustration for one of the four bends 9422 in FIG. 7*l* except with three arcuate gaps 943 each between neighboring two of the three bends 9422 in a circumferential direction about the axis 97 of the nut 94. The inner flange 946 has three inner arcuate peripheries 946*a* at outer arcuate sides of the three respective arcuate gaps 943, wherein either of the three inner arcuate peripheries 946*a* may have a radian ranging from 30 degrees to 150 degrees, and more particularly ranging from 60 degrees to 100 degrees, with respect to the axis 97 of the nut 94 and may have an arc length between 2 mm and 10 mm and more particularly between 3 mm and 7 mm. For example, each of the three inner arcuate peripheries 946*a* may have a radian ranging from 60 degrees to 100 degrees with respect to the axis 97 of the nut 94 and may have an arc length between 3 mm and 7 mm.

Alternatively, referring to FIG. 7*h*, the nut 94 may include two bends 9422 integral with the inner flange 946 of the nut 94, wherein either of the two bends 9422 in FIG. 7*h* may have the same feature as illustration for one of the four bends 9422 in FIG. 7*l* except with two arcuate gaps 943 symmetrically at opposite sides with respect to the axis 97 of the nut 94, wherein each of the two arcuate gaps 943 is between the bends 9422 in a circumferential direction about the axis 97 of the nut 94. The inner flange 946 has two inner arcuate peripheries 946*a* at outer arcuate sides of the two respective arcuate gaps 943, wherein either of the two inner arcuate peripheries 946*a* may have a radian ranging from 30 degrees to 210 degrees, and more particularly ranging from 120 degrees to 165 degrees, with respect to the axis 97 of the nut 94 and may have an arc length between 3 mm and 12 mm and more particularly between 4 mm and 10 mm. For example, each of the two inner arcuate peripheries 946*a* may have a radian ranging from 120 degrees to 165 degrees with respect to the axis 97 of the nut 94 and may have an arc length between 4 mm and 10 mm.

Referring to FIGS. 7*a*-7*h* and 7*l*, for assembling the coaxial cable connector, the metal ring 19 may be first mounted around the outer sleeve 12 as illustrated in the first embodiment. Next, the inner sleeve 61 may have a rear extension portion 118 to be first inserted from a front end of the nut 14 into the hole 141 in the nut 94 with each of the bends 9422 to be bent rearwards along a corresponding bending line 9423, between said each of the bends 9422 and the ring portion 9421, by a second outer flange 110 of the inner sleeve 61 until the inner sleeve 61 may have a first outer flange 104 contacting the inner flange 946 of the nut 94 and the bends 9422 of the metal sheet 942 may abut against and contact a cylindrical surface 114 of the second outer flange 110 of the inner sleeve 61 and may face the inner cylindrical surface of the inner flange 946 of the nut 94. The nut 94 has the inner flange 946 around the cylindrical surface 114 of the second outer flange 110. After the nut 94 is assembled with the inner sleeve 61, the inner sleeve 61 may have the rear extension portion 118 to be inserted from a front end of the outer sleeve 12 into a hole 121 in the outer sleeve 12 assembled with the metal ring 19 until the outer sleeve 12 has an inner flange 122, protruding annularly in radial inward directions, engaging with a trench 116 annularly formed in the inner sleeve 61 and between the second outer flange 110 of the inner sleeve 10 and a third outer flange 112 of the inner sleeve 10, wherein the third outer flange 112 protrudes annularly in radial outward directions. Thereby, the inner flange 946 of the nut 94 may be arranged between the first outer flange 104 of the inner sleeve 61 and the outer sleeve 12 in an axial direction so as to restrict the nut 94 not to move in the axial direction around the inner sleeve 61, but the nut 94 may rotate around the inner sleeve 61. Accordingly, the bends 9422 are between the inner flange 946 of the nut 94 and the cylindrical surface 114 of the inner sleeve 61. The metal sheet 932 has a fixed side, close to the outer flange 104 of the inner sleeve 61, fixed to the inner flange 946 of the nut 94, and a free side, away from the outer flange 104 of the inner sleeve 61, abutting against the cylindrical surface 114 of the inner sleeve 61. Furthermore, each of the bends 9422 may abut against and contact the inner sleeve 61 with an acute angle i2, ranging from 30 degrees to 90 degrees and in particular ranging from 40 degrees to 80 degrees or ranging from 50 degrees to 85 degrees, between said each of the bends 9422 and a plane normal to the axis 97 of the nut 94 so as to electrically connect the inner sleeve 61 to the nut 94 for ground connection even when the coaxial cable connector is not fully locked to the threaded connector 500 shown in FIGS. 7*j* and 7*k*. Cut by a plane having the axis 97 of the nut 94 extending thereon and being normal to the longitudinal direction, a corresponding empty gap between said each of the bends 9422 and the inner cylindrical surface of the inner flange 946 of the nut 94 may have an angle therebetween ranging from 90 degrees to 150 degrees, and more particularly ranging from 90 degrees to 120 degrees or ranging from 100 degrees to 150 degrees. A radial spacing distance s between the cylindrical surface 114 of the second outer flange 110 of the inner sleeve 61 and the inner cylindrical surface of the inner flange 942 may be between 0.03 and 0.2 mm, and more particularly between 0.03 mm and 0.1 mm or between 0.05 mm and 0.2 mm.

Figure 7I:
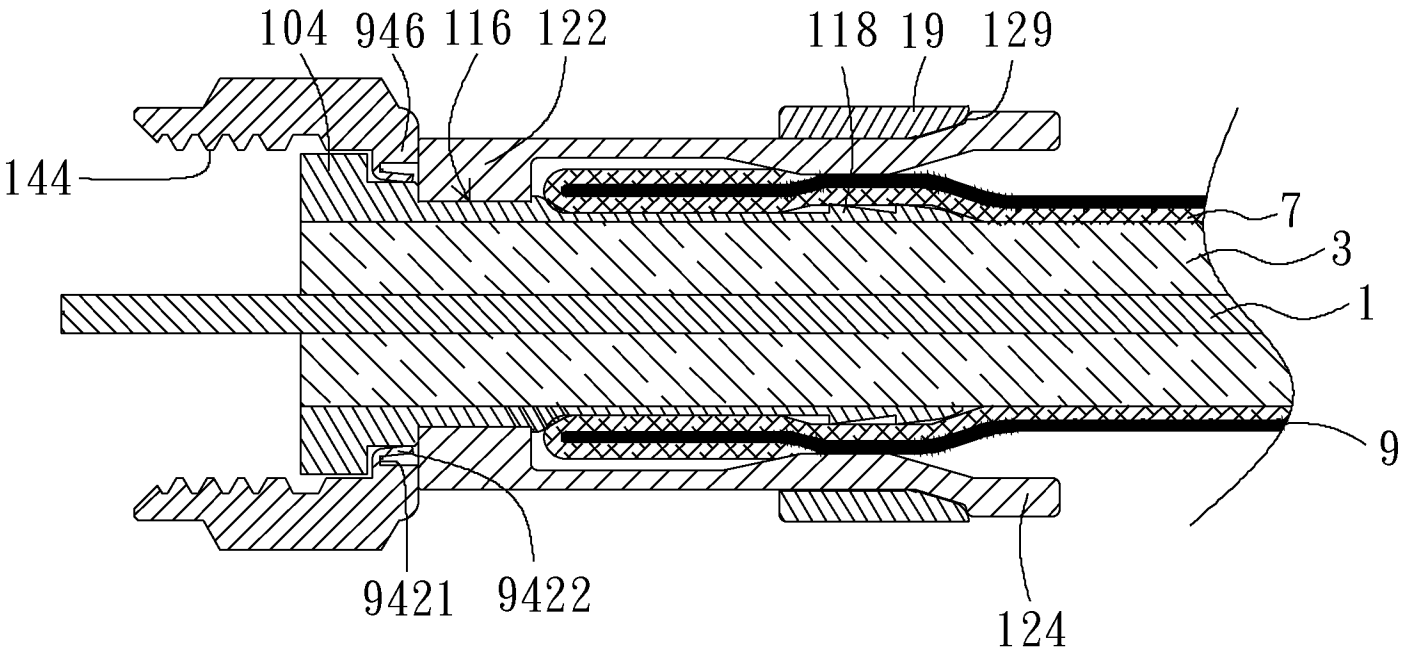
FIG. 7*i* is a cross-sectional view showing the coaxial cable connector assembled with a coaxial cable in accordance with the sixth embodiment of the present invention.
Figure 7J:
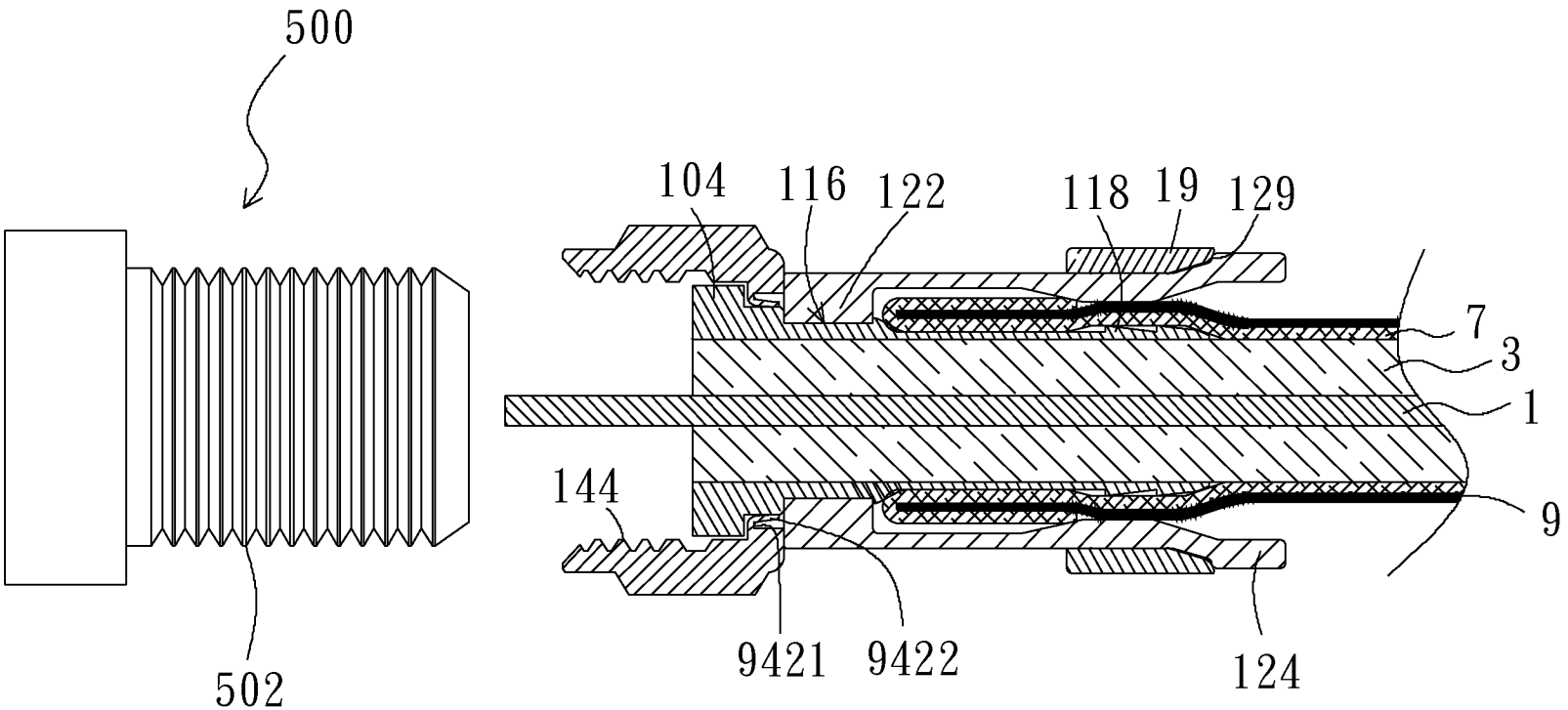
FIGS. 7*j* and 7*k* are cross-sectional views showing the coaxial cable connector before and after assembled with a thread connector in accordance with the sixth embodiment of the present invention.
Figure 7K:
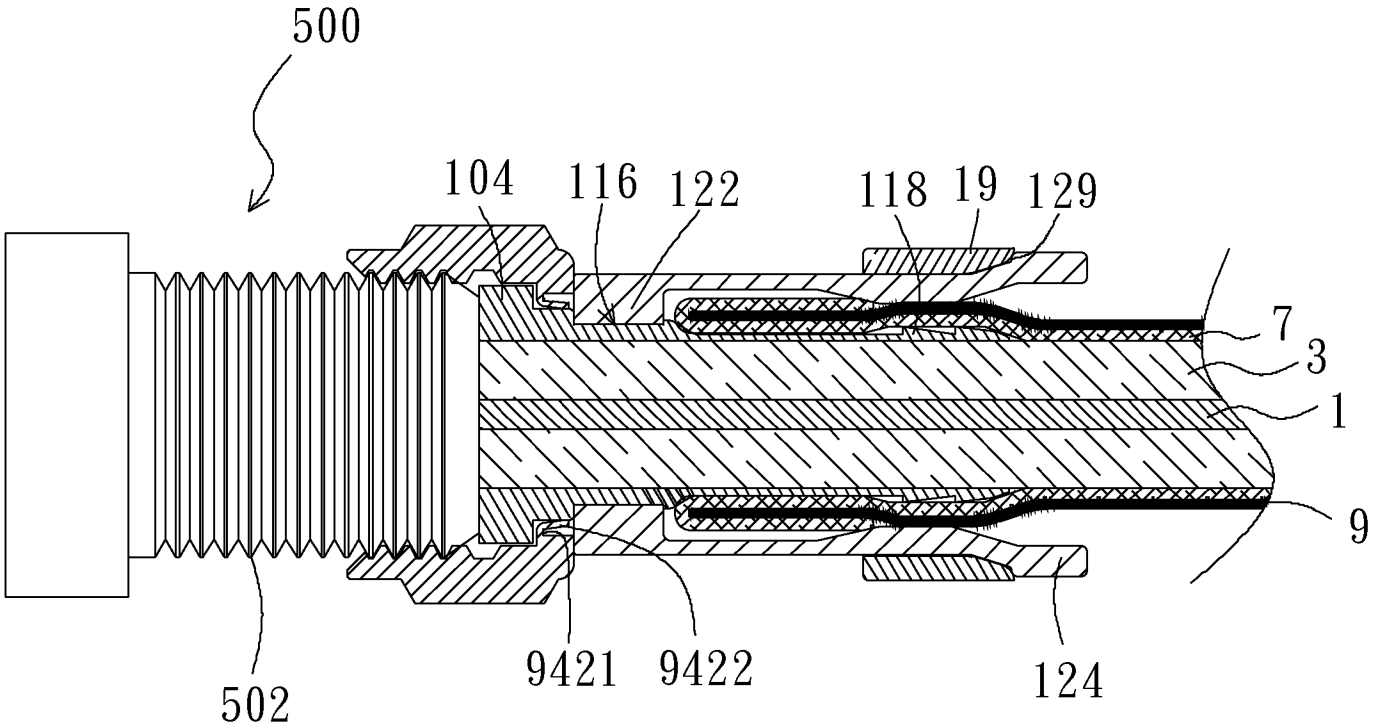
Figure 71:
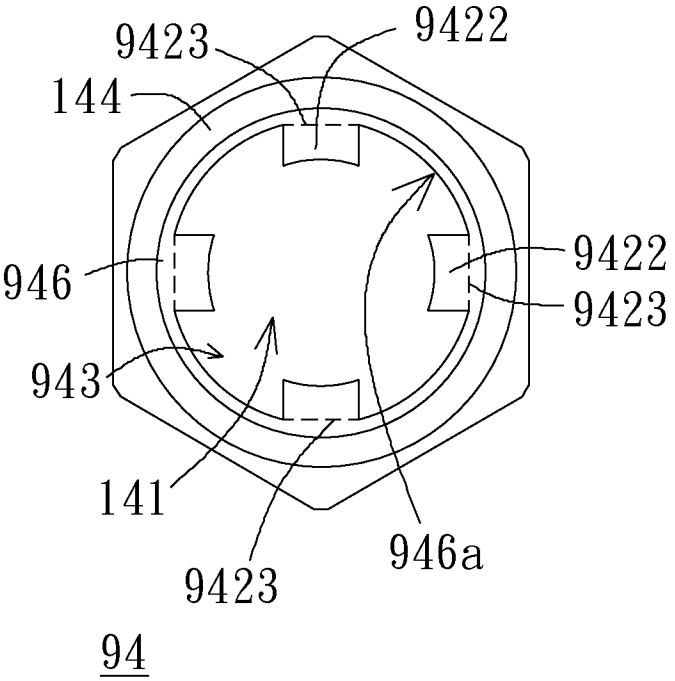

FIG. 7*i* is a cross-sectional view showing the coaxial cable connector assembled with a coaxial cable in accordance with the sixth embodiment of the present invention. Referring to FIG. 7*i*, the method of assembling the coaxial cable connector with a coaxial cable may be referred to that in accordance with the first embodiment. FIGS. 7*j* and 7*k* are cross-sectional views showing the coaxial cable connector before and after assembled with a thread connector in accordance with the sixth embodiment of the present invention. Referring to FIGS. 7*j* and 7*k*, the method of assembling the coaxial cable connector to the threaded connector 500 may be referred to that in accordance with the first embodiment. The coaxial cable fixed with the coaxial cable connector may have the metal wire 1 to be inserted into a hole in the threaded connector 500 and the nut 94 has the inner thread 144 engaging with the outer thread 502 of the threaded connector 500 so as to be screwed on the threaded connector 500. When the nut 94 is being screwed on the threaded connector 500, the first outer flange 104 of the inner sleeve 61 may move to the threaded connector 500 in the axial direction and then may contact the threaded connector 500. No matter whether the nut 94 is fully locked to the threaded connector 500 or not, the nut 94 has the bends 9422 always abutting against and contacting the cylindrical surface 114 of the second outer flange 110 of the inner sleeve 61 with the angle i2 and good electrical or ground connection between the inner sleeve 61 and the nut 94 may be provided. Thereby, the bends 9422 may always contact the inner sleeve 61 so as to provide good electrical or ground connection between the inner sleeve 61 and the nut 94. Even when the coaxial cable is casually pulled such that the nut 94 is not fully locked to the threaded connector 500, good electrical or ground connection between the inner sleeve 61 and the nut 94 may still be provided by the bends 9422 or metal sheets 942 always generating an elastic force against the inner sleeve 61. Accordingly, the coaxial cable connector may transmit signals with improved quality.

Seventh Embodiment

Figure 8A:
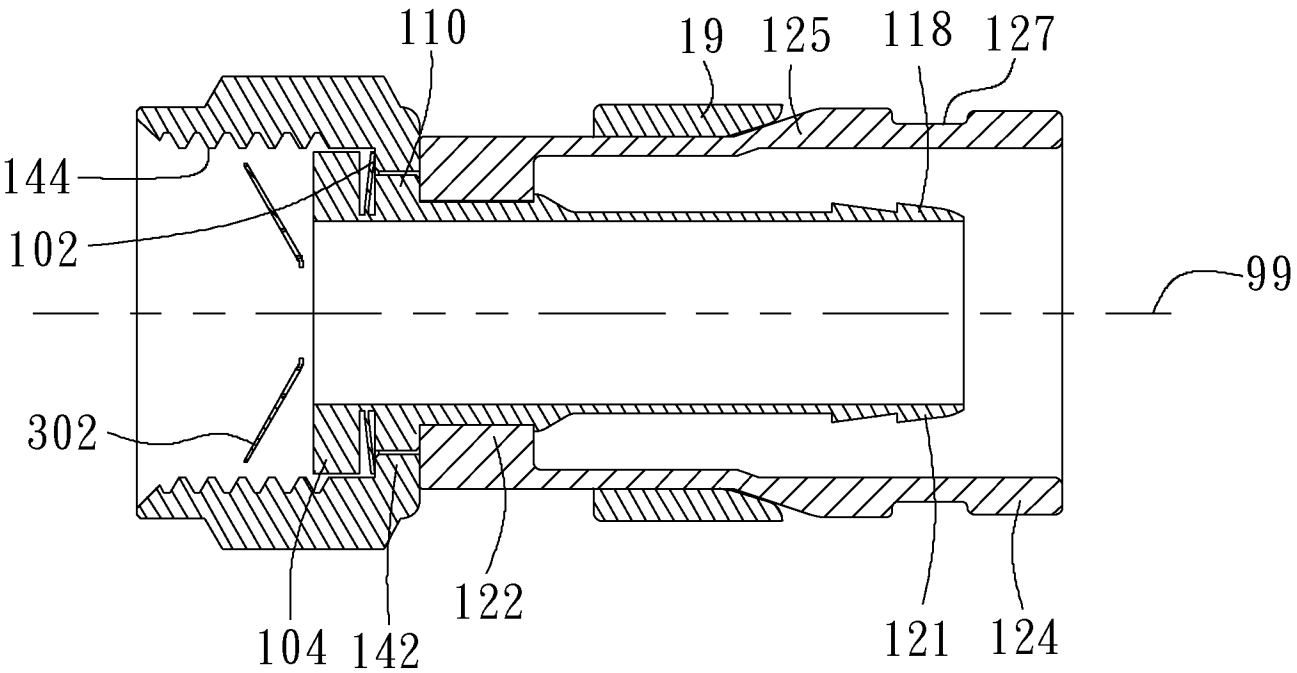
FIG. 8*a* is a cross-sectional view showing a coaxial cable connector in accordance with a seventh embodiment of the present invention.
Figure 8B:
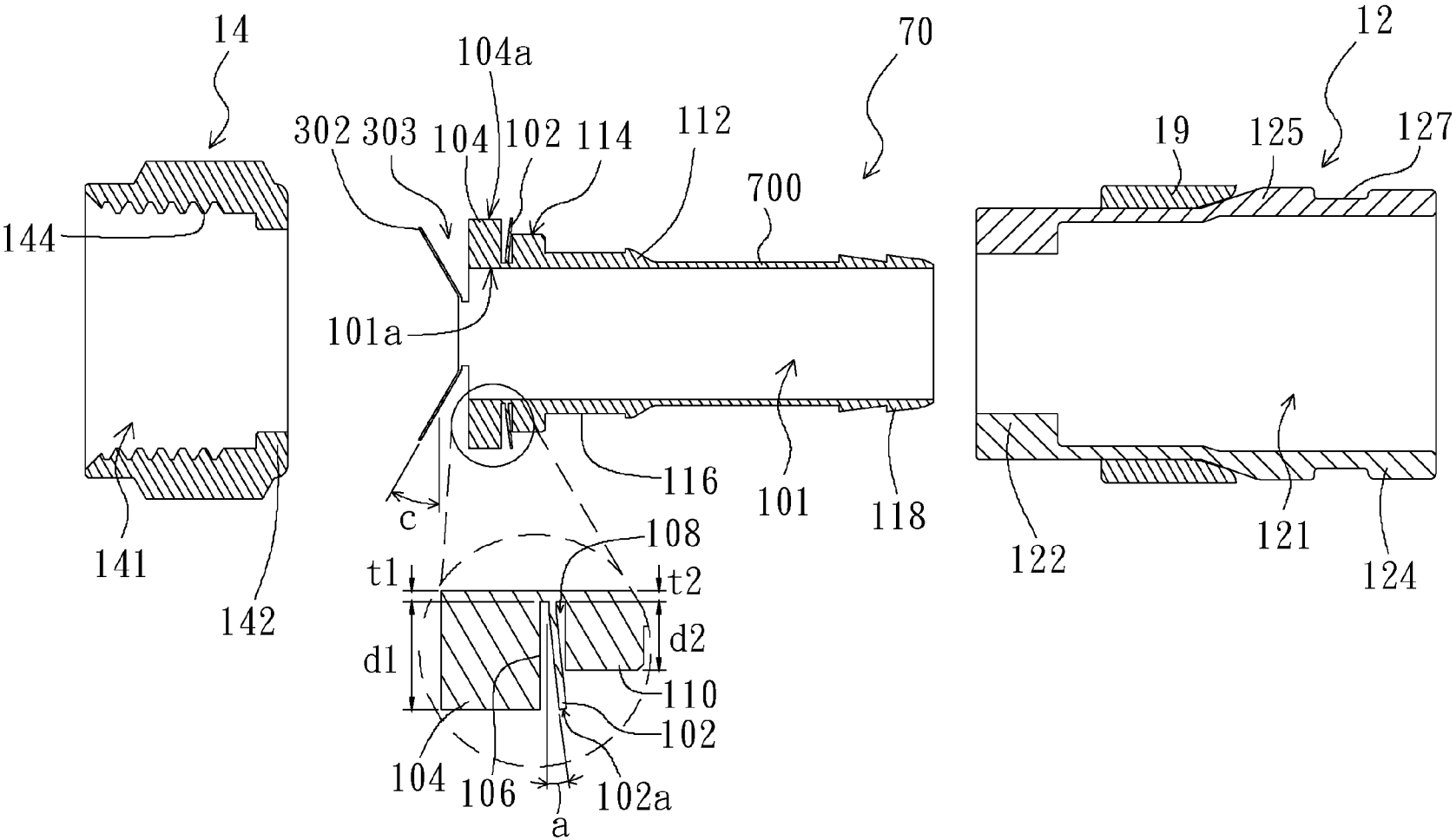
FIG. 8*b* is a cross-sectional exploded view showing the coaxial cable connector in accordance with the seventh embodiment of the present invention.
Figure 8C:
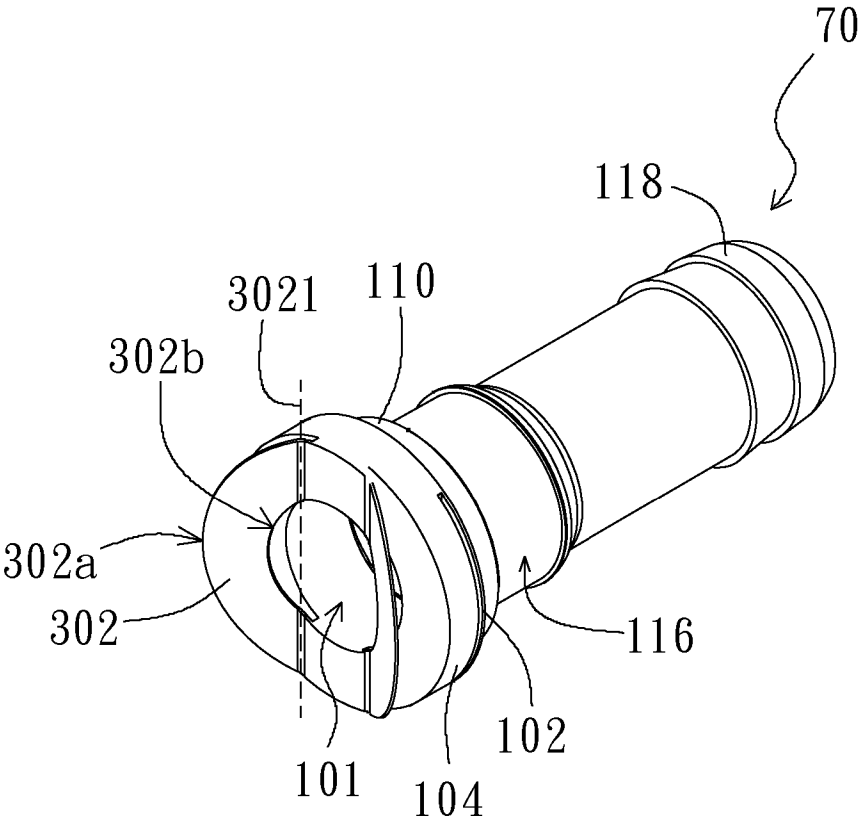
FIG. 8*c* is a perspective cross-sectional view showing an inner sleeve in accordance with the seventh embodiment of the present invention.

FIG. 8*a* is a cross-sectional view showing a coaxial cable connector in accordance with a seventh embodiment of the present invention. FIG. 8*b* is a cross-sectional exploded view showing the coaxial cable connector in accordance with the seventh embodiment of the present invention. FIG. 8*c* is a perspective cross-sectional view showing an inner sleeve in accordance with the seventh embodiment of the present invention. Elements in the seventh embodiment having the same reference number as those in the first and third embodiments may refer to those illustrated in the first and third embodiments. Referring to FIGS. 8*a*-8*c*, the coaxial cable connector includes an inner sleeve 70, an outer sleeve 12, a nut 14 and a metal ring 19 coaxially arranged with respect to an axis 99 of the inner sleeve 70. Either one of the inner sleeve 70, nut 14 and metal ring 19 may be made of an electrically conductive material, such as copper, iron, silver, nickel, tin, gold, a copper-gold alloy, a copper-tin alloy, a copper-nickel alloy or an electrically conductive polymer or a non-metallic conductor. An antirust metal layer that is an electrically conductive material, such as copper, iron, silver, nickel, tin, gold, a copper-gold alloy, a copper-tin alloy, a copper-nickel alloy, an electrically conductive polymer or a non-metallic material, may be coated, electroplated or electroless plated on a surface of the inner sleeve 70, nut 14 and metal ring 19. The outer sleeve 12 may be made of a plastic material or an organic polymer. Alternatively, the outer sleeve 12 may be made of a metallic material, such as copper, iron, silver, nickel, tin, gold, a copper-gold alloy, a copper-tin alloy or a copper-nickel alloy, an electrically conductive polymer or a non-metallic material.

Referring to FIGS. 8*a*-8*c*, either type of metal sheets 302 as illustrated in FIGS. 4*a*-4*e* and 4*i*-4*k* may be applied to either type of inner sleeve 10 as illustrated in FIGS. 2*a*-2*e* and 2*i* so as to obtain the inner sleeve 70. The inner sleeve 70 may have the metal sheets 302 with the same features as those illustrated in FIGS. 4*a*-4*e* and 4*i*-4*k* and the metal sheets 102 with the same features as those illustrated in FIGS. 2*a*-2*e* and 2*i*.

Figure 8D:
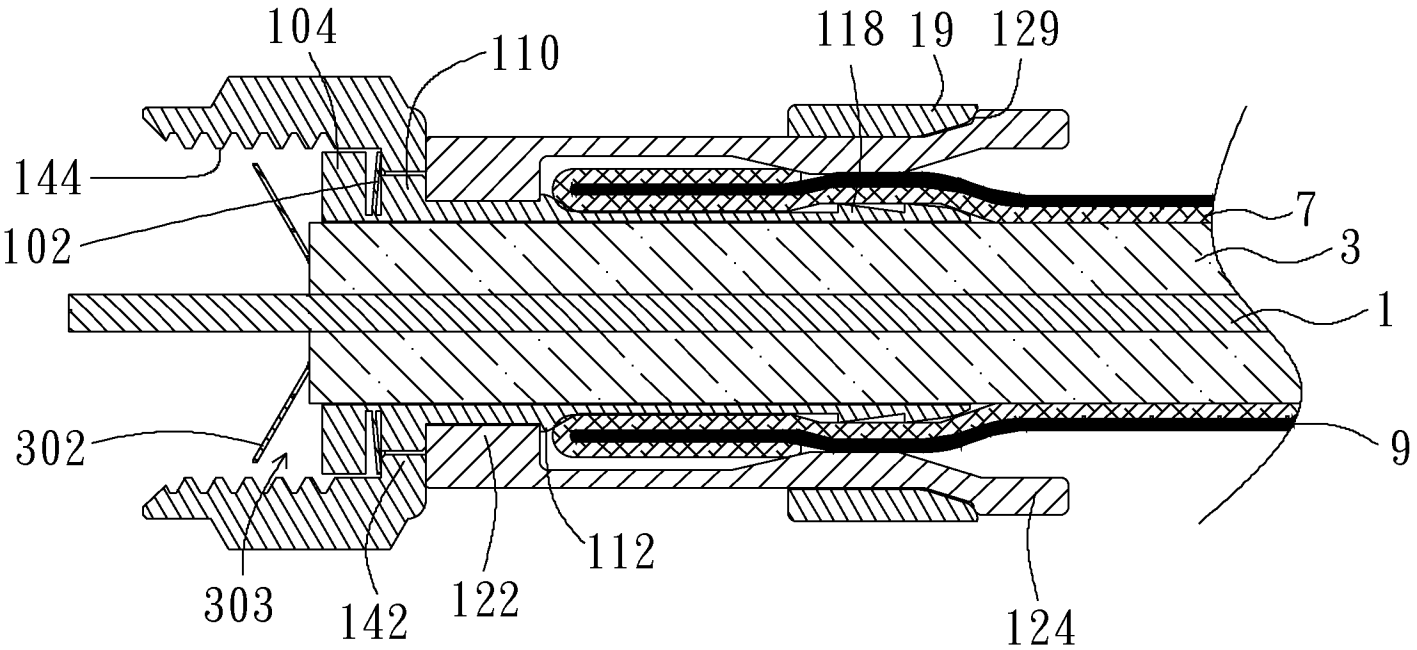
FIG. 8*d* is a cross-sectional view showing the coaxial cable connector assembled with a coaxial cable in accordance with the seventh embodiment of the present invention.

FIG. 8*d* is a cross-sectional view showing the coaxial cable connector assembled with a coaxial cable in accordance with the seventh embodiment of the present invention. The method of assembling the coaxial cable connector may be referred to that in accordance with the first embodiment. After assembling the coaxial cable connector, each of the metal sheets 102 may abut against and contact the inner flange 142 of the nut 14 with the acute angle a between said each of the metal sheets 102 and a radial direction perpendicular to the axis 99 of the inner sleeve 70 so as to electrically connect the inner sleeve 70 to the nut 14 for ground connection even when the coaxial cable connector is not fully locked to the threaded connector 500 shown in FIGS. 8*e* and 8*f*. The inner flange 142 of the nut 14 may be arranged between the metal sheets 102 and the outer sleeve 12 in an axial direction so as to restrict the nut 14 not to move in the axial direction around the inner sleeve 70, but the nut 14 may rotate around the inner sleeve 70. The coaxial cable connector may be assembled with a coaxial cable, which may be referred to the illustration of FIG. 2*f* in the first embodiment.

Figure 8E:
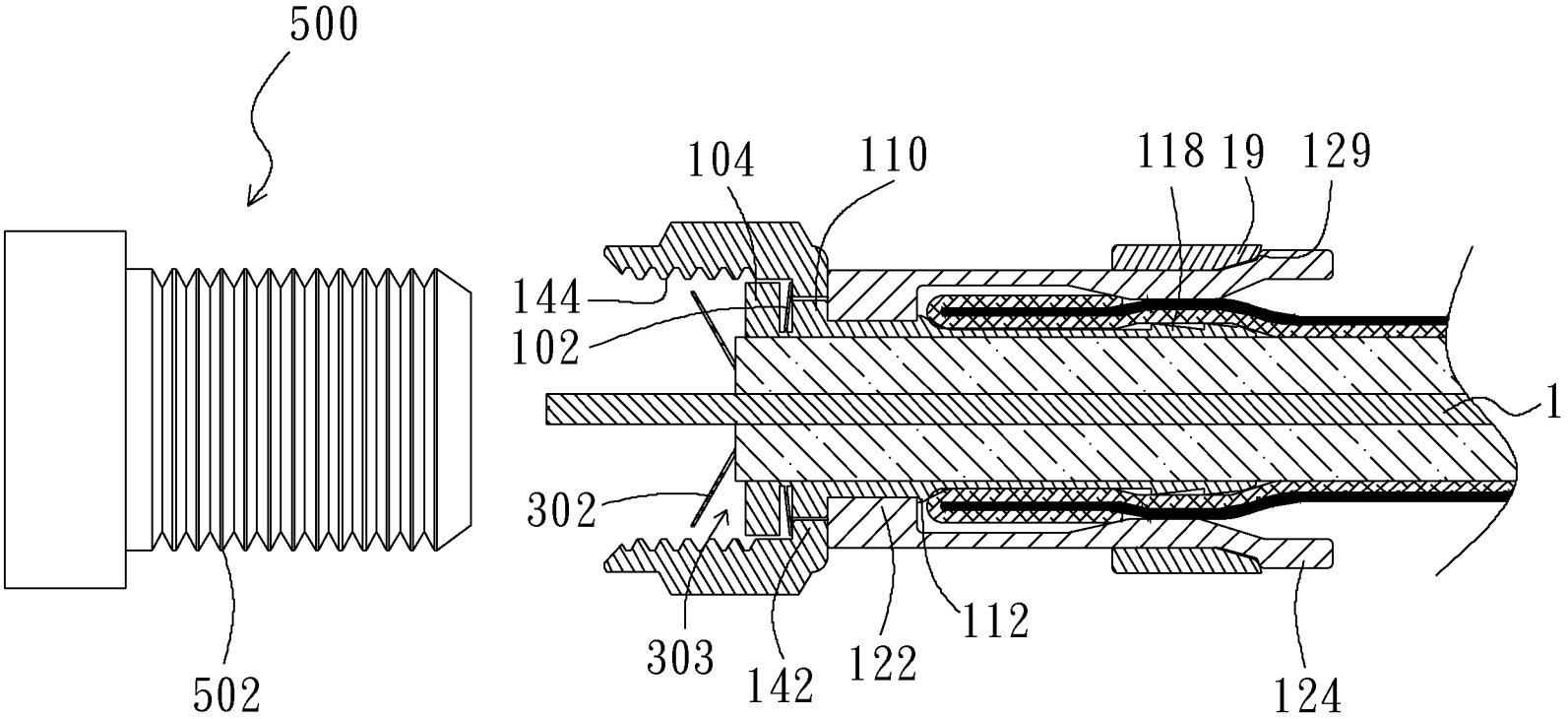
FIGS. 8*e* and 8*f* are cross-sectional views showing the coaxial cable connector before and after assembled with a thread connector in accordance with the seventh embodiment of the present invention.
Figure 8F:
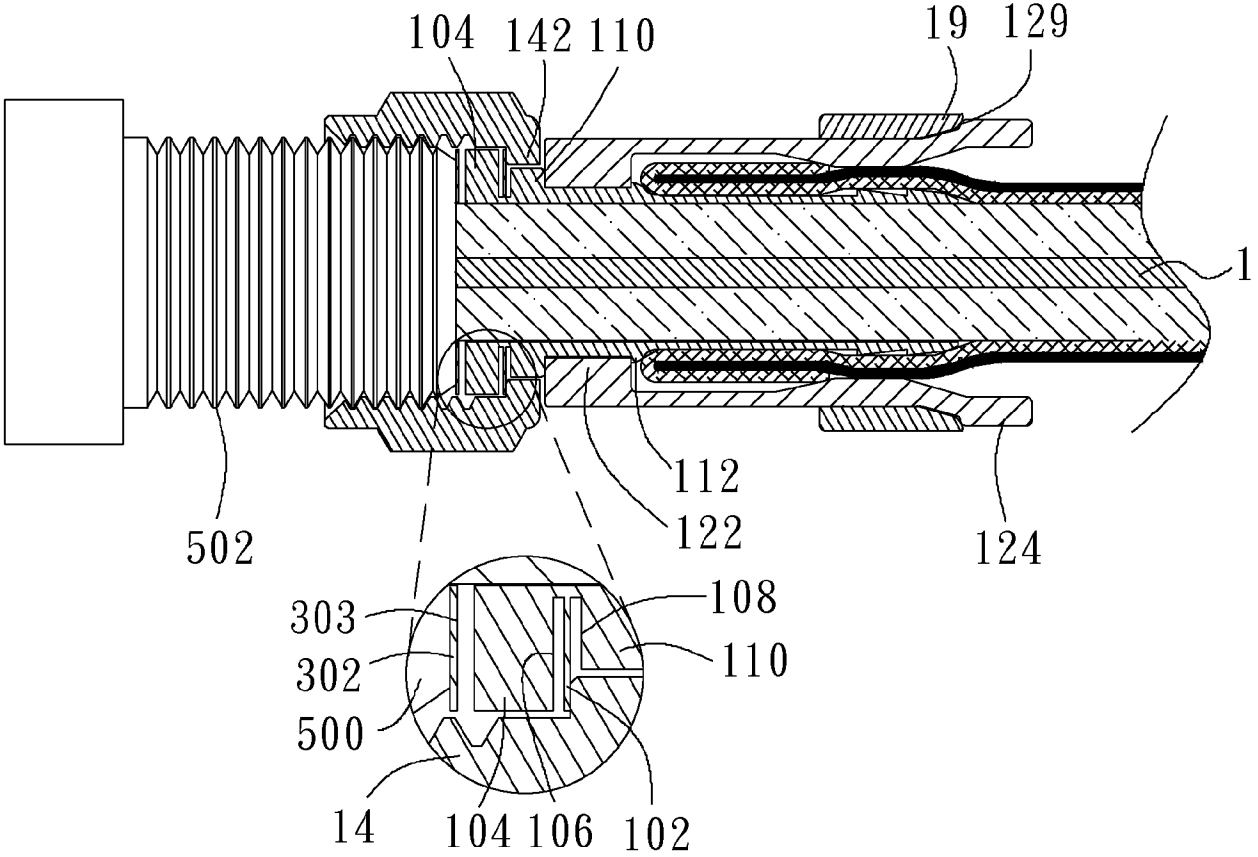

FIGS. 8*e* and 8*f* are cross-sectional views showing the coaxial cable connector before and after assembled with a thread connector in accordance with the seventh embodiment of the present invention. Referring to FIGS. 8*e* and 8*f*, the coaxial cable connector may be locked to the treaded connector 500 mounted on an electronic device or an adapter, such as a T-shaped or F-shaped adaptor, for connecting the coaxial cable to another coaxial cable. The coaxial cable fixed with the coaxial cable connector may have the metal wire 1 to be inserted into a hole in the threaded connector 500 and the nut 14 has the inner thread 144 engaging with the outer thread 502 of the threaded connector 500 so as to be screwed on the threaded connector 500.

When the nut 14 is being screwed on the threaded connector 500, the metal sheets 302 of the inner sleeve 10 may move to the threaded connector 500 in the axial direction and then may contact the threaded connector 500. Before the metal sheets 302 of the inner sleeve 10 contact the threaded connector 500, the metal sheets 102 may press the inner flange 142 of the nut 14 such that the nut 14 abuts against the outer sleeve 12. After the metal sheets 302 of the inner sleeve 10 contact the threaded connector 500, the nut 14 may continue to be screwed on the threaded connector 500 such that each of the metal sheets 102 may be bent by the inner flange 142 of the nut 14 with the angle a becoming gradually small and the nut 14 does not contact the outer sleeve 12 and each of the metal sheets 302 may be bent by the threaded connector 500 with the angle c becoming gradually small. When the nut 14 is fully locked to the threaded connector 500, the angle a may be substantially 0 degrees or each of the metal sheets 102 may even incline to the front portion of the first outer flange 104, the inner flange 142 of the nut 14 may abut against and contact the first outer flange 104 of the inner sleeve 10, the angle c may become substantially 0 degrees, each of the metal sheets 302 may have a front surface contacting the threaded connector 500 and the outer flange 104 of the inner sleeve 70 may contact the threaded connector 500. Thereby, the metal sheets 102 may always contact the inner flange 142 of the nut 14 so as to provide good electrical or ground connection between the inner sleeve 10 and the nut 14. When the nut 14 is not fully locked to the threaded connector 500, the metal sheets 302 may contact the threaded connector 500 so as to provide good electrical or ground connection between the inner sleeve 10 and the threaded connector 500. Even when the coaxial cable is casually pulled such that the nut 14 is not fully locked to the threaded connector 500, good electrical or ground connection between the inner sleeve 10 and the nut 14 and between the inner sleeve 10 and the threaded connector 500 may still be provided by the metal sheets 102 and 302. Accordingly, the coaxial cable connector may transmit signals with improved quality.

Eighth Embodiment

Figure 9A:
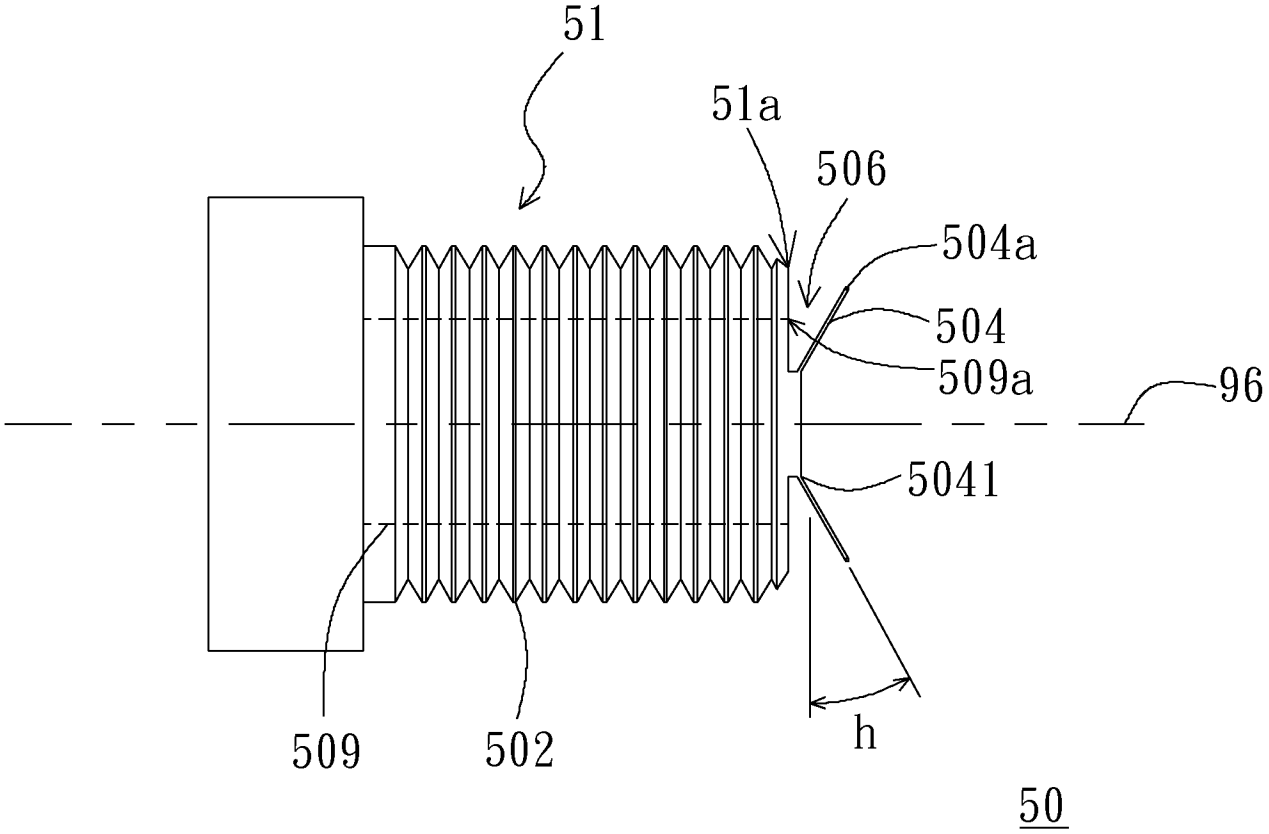
FIG. 9*a* is a side view showing a threaded connector in accordance with an eighth embodiment of the present invention.
Figure 9C:
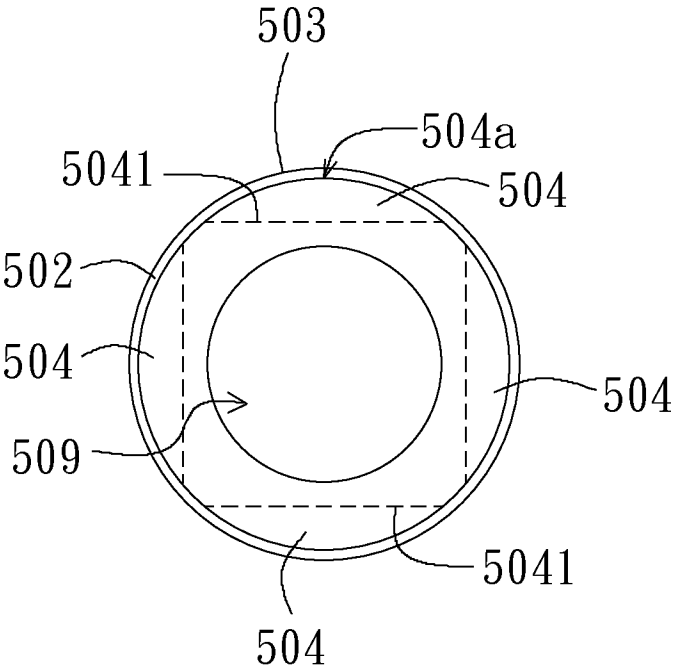
FIGS. 9*b* and 9*c* are back views showing positions of bending lines relative to threaded connectors with various numbers of metal sheets before bent along the bending lines in accordance with the eighth embodiment of the present invention.
Figure 9B:
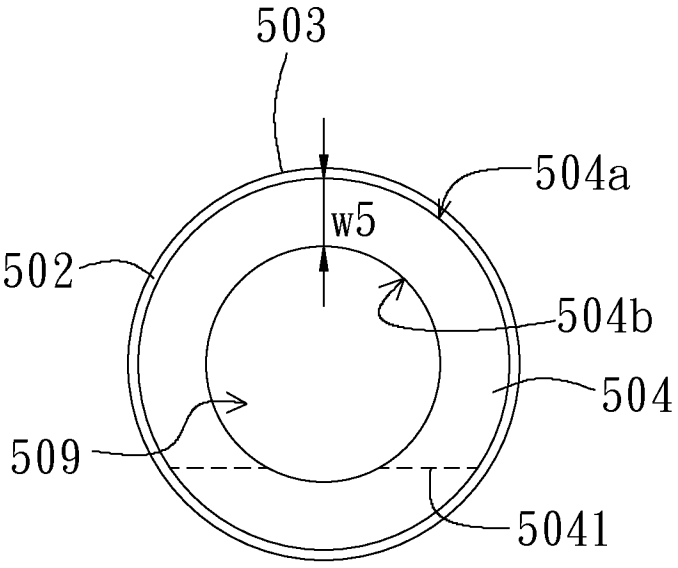

FIG. 9*a* is a side view showing a threaded connector in accordance with an eighth embodiment of the present invention. FIG. 9*f* is a back views showing positions of bending lines relative to the threaded connector with two metal sheets before bent along the bending lines in accordance with the eighth embodiment of the present invention. Elements in the eighth embodiment having the same reference number as those in the first embodiment may refer to those illustrated in the first embodiment. Referring to FIGS. 9*a* and 9*f*, a threaded connector 50 may be made of an electrically conductive material, such as copper, iron, silver, nickel, tin, gold, a copper-gold alloy, a copper-tin alloy, a copper-nickel alloy or an electrically conductive polymer or a non-metallic conductor. An antirust metal layer that is an electrically conductive material, such as copper, iron, silver, nickel, tin, gold, a copper-gold alloy, a copper-tin alloy, a copper-nickel alloy, an electrically conductive polymer or a non-metallic material, may be coated, electroplated or electroless plated on a surface of the threaded connector 50.

Referring to FIGS. 9*a* and 9*f*, the threaded connector 50 may include a main body 51 and two metal sheets 504 integral with the main body 51, wherein each of the two metal sheets 504 has two separate bottoms, which may extend in a corresponding longitudinal direction and may be collinear, joining a back of the main body 51. A blade may be used to cut into the threaded connector 50 so as to form two empty gaps 506 symmetrically at opposite sides of the threaded connector 50 with respect to an axis 96 of the threaded connector 50 and form the two metal sheets 504 at a back side of the main body 51. Each of the two empty gaps 506 is between the main body 51 and a corresponding one of the two metal sheets 504. Each of the two metal sheets 504 may have a thickness between 0.1 and 3 mm, and more particularly between 0.1 and 1.5 mm, between 0.3 and 2 mm, or between 0.5 and 3 mm, for example. Each of the two metal sheets 504 may have an arcuate outer periphery 504*a* with a radian ranging from 60 degrees to 180 degrees for example, and more particularly ranging from 120 degrees to 180 degrees, with respect to the axis 96 of the threaded connector 50. Each of the two metal sheets 504 may have an arcuate inner periphery 504*b* with a radian ranging from 60 degrees to 180 degrees for example, and more particularly ranging from 120 degrees to 180 degrees, with respect to the axis 96 of the threaded connector 50.

Referring to FIGS. 9*a* and 9*f*, each of the two metal sheets 504 may be bent along a corresponding bending line 5041, i.e. along the two separate bottoms of said each of the two metal sheets 504, to the side far away from the main body 51. Each empty gap 506 between a corresponding one of the metal sheets 504 and the back of the main body 51 may cut through an annular wall of the threaded connector 50, separating the arcuate inner periphery 504*b* of the corresponding metal sheet 504 from the main body 51 and separating the arcuate outer periphery 504*a* of the corresponding metal sheet 504 from the main body 51. Each of the two empty gaps 506 may have two separate bottoms connecting two opposite sidewalls of said each of the two empty gaps 506 and extending in the corresponding longitudinal direction. Each of the metal sheets 504 may have a radial width w5 between its arcuate inner and outer peripheries 504*b* and 504*a*, ranging from 0.1 to 3 mm, and more particularly ranging from 0.1 to 1.5 mm, ranging from 0.3 to 2 mm, or ranging from 0.5 to 3 mm.

Referring to FIGS. 9*a* and 9*f*, in an expanded position, each of the metal sheets 504 extends in a corresponding plane at an acute angle h, ranging from 20 degrees to 80 degrees and more particularly ranging from 20 degrees to 60 degrees, ranging from 30 degrees to 70 degrees, or ranging from 45 degrees to 80 degrees, for example, to a vertical plane normal to the axis 96 of the threaded connector 50. Cut by a plane having the axis 96 of the threaded connector 50 extending thereon and being normal to the corresponding longitudinal direction, each of the empty gaps 506 may have a first spacing distance between the arcuate outer periphery 504*a* of the corresponding metal sheet 504 and an arcuate outer periphery 51*a* of the main body 51 of the threaded connector 50 may be greater than a second spacing distance of said each of the empty gaps 506 between the arcuate inner periphery 504*b* of the corresponding metal sheet 504 and an arcuate inner periphery 509*a* of an hole 509 in the main body 51. Each of the two empty gaps 506 may become gradually wide from the two bottoms of said each of the two empty gaps 506 out away from a diameter of the threaded connector 50 parallel to the corresponding longitudinal direction.

In this embodiment, the number of the metal sheets 504 of the threaded connector 50 is two for illustration. Alternatively, the threaded connector 50 may include any number, such as one, three or four, of metal sheets 504 integral with the main body 51. FIGS. 9*b* and 9*c* are back views showing positions of bending lines relative to threaded connectors with various numbers of metal sheets before bent along the bending lines in accordance with the eighth embodiment of the present invention. For example, the threaded connector 50 may include one metal sheet 504 integral with the main body 51, as illustrated in FIGS. 9*b* and 9*g*. The threaded connector 50 may include four metal sheets 504 integral with the main body 51, as illustrated in FIGS. 9*c* and 9*h*. FIG. 9*g* is a side view showing the threaded connector of FIG. 9*b* in accordance with the eighth embodiment of the present invention. FIG. 9*h* is a side view showing the threaded connector of FIG. 9*c* in accordance with the eighth embodiment of the present invention.

Referring to FIGS. 9*c* and 9*h*, each of the four metal sheets 504 may have a bottom extending in a corresponding longitudinal direction and joining the back of the maim body 51. A blade may be used to cut into the threaded connector 50 so as to form four empty gaps 506, each pair of which are symmetrically at opposite sides of the threaded connector 50 with respect to the axis 96 of the threaded connector 50, and form the four metal sheets 504 at the back of the main body 51. Each of the four empty gaps 506 is between the main body 51 and the corresponding metal sheet 504. Each of the four metal sheets 504 may have a thickness between 0.1 and 3 mm, and more particularly between 0.1 and 1.5 mm, between 0.3 and 2 mm, or between 0.5 and 3 mm, for example. Each of the four empty gaps 506 may have a bottom connecting two opposite sidewalls of said each of the four empty gaps 506 and extending in the corresponding longitudinal direction. Each of the four metal sheets 504 may have an arcuate outer periphery 504*a* with a radian ranging from 30 degrees to 180 degrees for example, and more particularly ranging from 45 degrees to 90 degrees, with respect to the axis 96 of the threaded connector 50. Each of the four metal sheets 504 may be bent along a corresponding bending line 5041, i.e. along the bottom of said each of the four metal sheets 504, to the side far away from the main body 51. Each empty gap 506 between the corresponding metal sheet 504 and the back of the main body 51 may cut into an annular wall of the threaded connector 50 but not through the annular wall of the threaded connector 50, separating the arcuate outer periphery 504*a* of the corresponding metal sheet 504 from the main body 51. In an expanded position, each of the metal sheets 504 extends in a corresponding plane at an acute angle h, ranging from 20 degrees to 80 degrees and more particularly ranging from 20 degrees to 60 degrees, ranging from 30 degrees to 70 degrees, or ranging from 45 degrees to 80 degrees, for example, to a vertical plane normal to the axis 96 of the threaded connector 50. Each of the four empty gaps 506 may become gradually wide from the bottom of said each of the four empty gaps 506 out away from a diameter of the threaded connector 50 parallel to the corresponding longitudinal direction.

Referring to FIGS. 9*b* and 9*g*, the metal sheet 504 may have two separate bottoms, which may extend in a longitudinal direction and may be collinear, joining the back of the main body 51. A blade may be used to cut into the threaded connector 50 so as to form an empty gap 506 at the back of the main body 51. The empty gap 506 is between the main body 51 and the metal sheet 504. The metal sheet 504 may have a thickness between 0.1 and 3 mm, and more particularly between 0.1 and 1.5 mm, between 0.3 and 2 mm, or between 0.5 and 3 mm, for example. The empty gap 506 may have two separate bottoms connecting two opposite sidewalls of the empty gap 506 and extending in the longitudinal direction. The metal sheet 504 may have an arcuate outer periphery 504*a* with a radian ranging from 60 degrees to 300 degrees for example, and more particularly ranging from 150 degrees to 300 degrees, with respect to the axis 96 of the threaded connector 50. The metal sheet 504 may have an arcuate inner periphery 504*b* with a radian ranging from 60 degrees to 300 degrees for example, and more particularly ranging from 150 degrees to 300 degrees, with respect to the axis 96 of the threaded connector 50. The metal sheet 504 may be bent along a bending line 5041, i.e. along the two separate bottoms of the metal sheet 504, to the side far away from the main body 51. The empty gap 506 between the metal sheet 504 and the back of the main body 51 may cut through an annular wall of the threaded connector 50, separating the arcuate inner periphery 504*b* of the metal sheet 504 from the main body 51 and separating the arcuate outer periphery 504*a* of the metal sheet 504 from the main body 51. The metal sheet 504 may have a radial width w5 between its arcuate inner and outer peripheries 504*b* and 504*a*, ranging from 0.1 to 3 mm, and more particularly ranging from 0.1 to 1.5 mm, ranging from 0.3 to 2 mm, or ranging from 0.5 to 3 mm. In an expanded position, the metal sheet 504 extends in a plane at an acute angle h, ranging from 20 degrees to 80 degrees and more particularly ranging from 20 degrees to 60 degrees, ranging from 30 degrees to 70 degrees, or ranging from 45 degrees to 80 degrees, for example, to a vertical plane normal to the axis 96 of the threaded connector 50. Cut by a plane having the axis 96 of the threaded connector 50 extending thereon and being normal to the longitudinal direction, the empty gap 506 may have a first spacing distance between the arcuate outer periphery 504*a* of the metal sheet 504 and an arcuate outer periphery 51*a* of the main body 51 may be greater than a second spacing distance of the empty gap 506 between the arcuate inner periphery 504*b* of the metal sheet 504 and an arcuate inner periphery 509*a* of an hole 509 in the main body 51.

Referring to FIGS. 9*a*-9*c* and 9*f*-9*h*, each of the metal sheets 504 may be made of an electrically conductive material, such as copper, iron, silver, nickel, tin, gold, a copper-gold alloy, a copper-tin alloy, a copper-nickel alloy or an electrically conductive polymer or a non-metallic conductor. An antirust metal layer that is an electrically conductive material, such as copper, iron, silver, nickel, tin, gold, a copper-gold alloy, a copper-tin alloy, a copper-nickel alloy, an electrically conductive polymer or a non-metallic material, may be coated, electroplated or electroless plated on a surface of said each of the metal sheets 504.

Figure 9D:
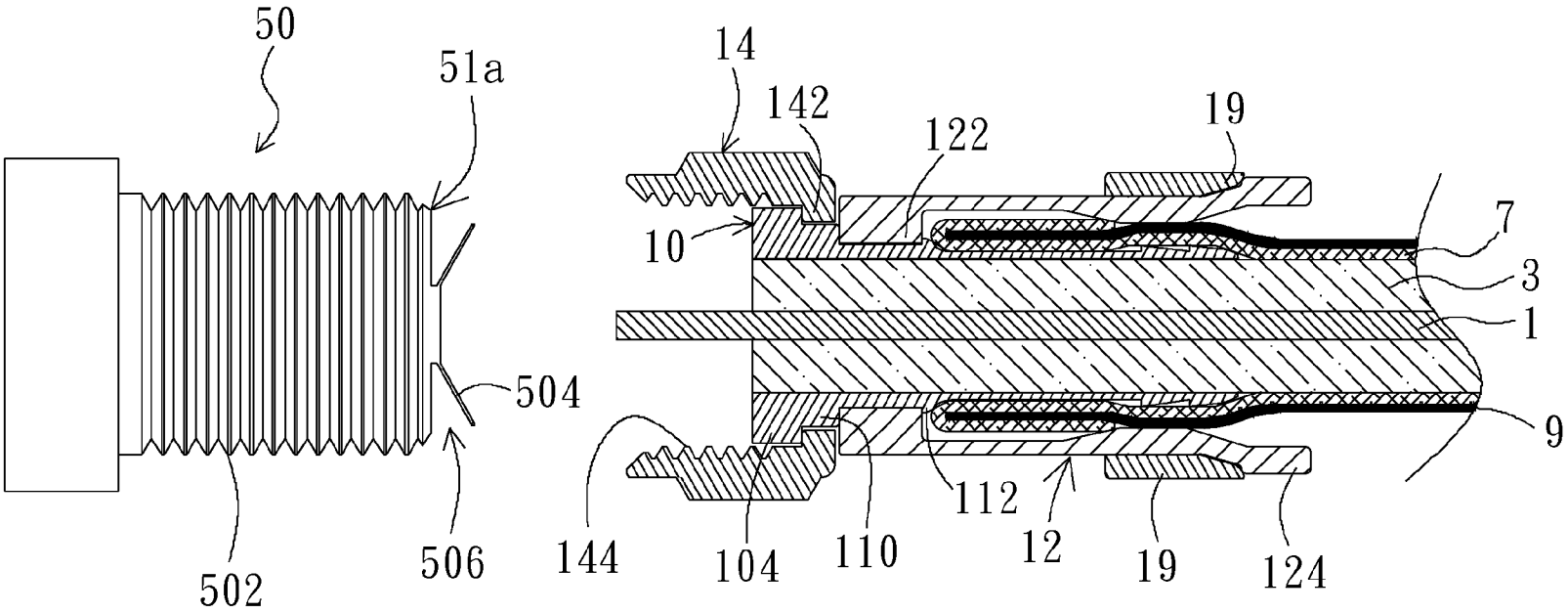
FIGS. 9*d* and 9*e* are cross-sectional views showing a coaxial cable connector before and after assembled with the threaded connector in accordance with the eighth embodiment of the present invention.
Figure 9E:
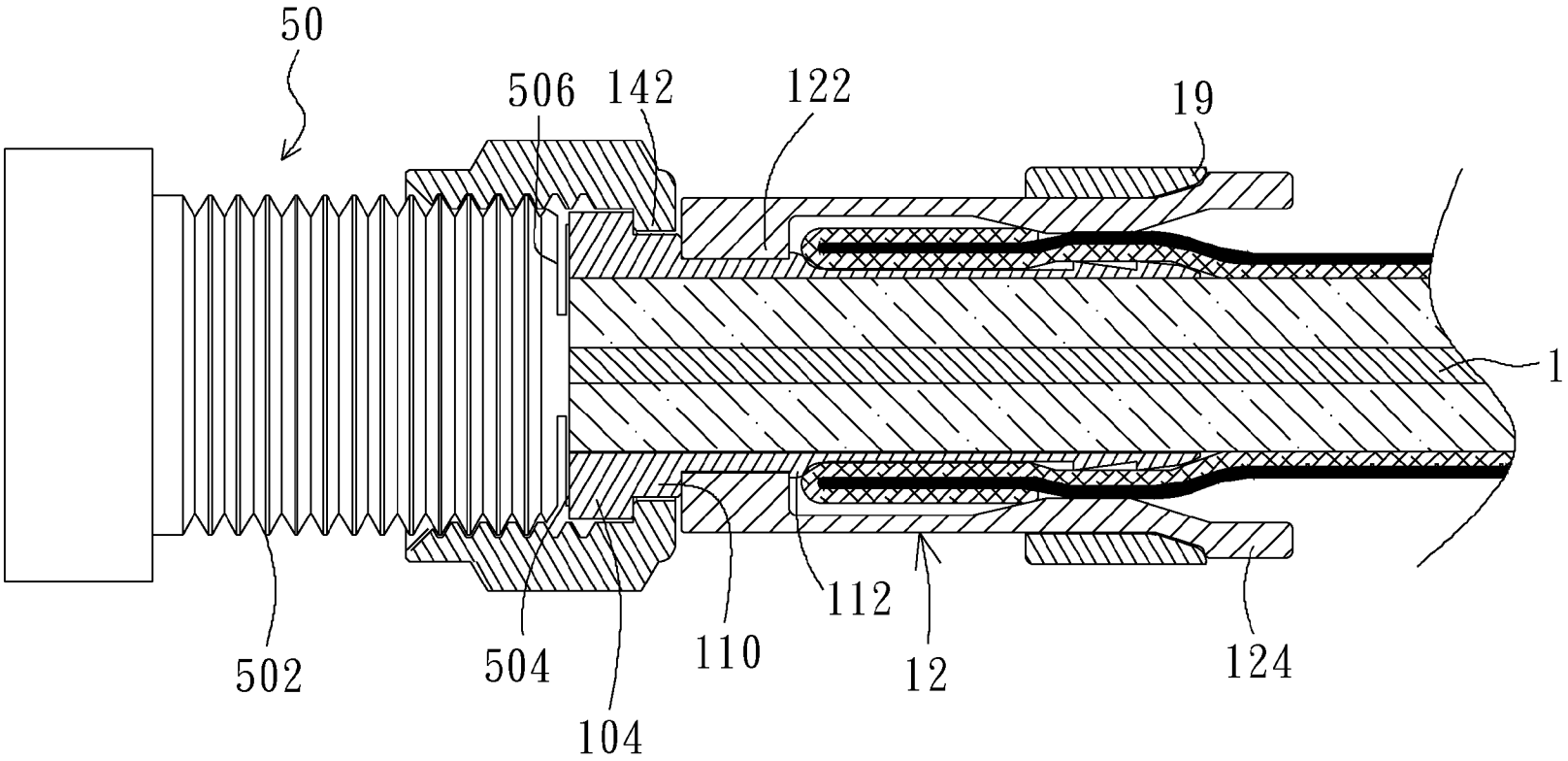
Figure 9F:
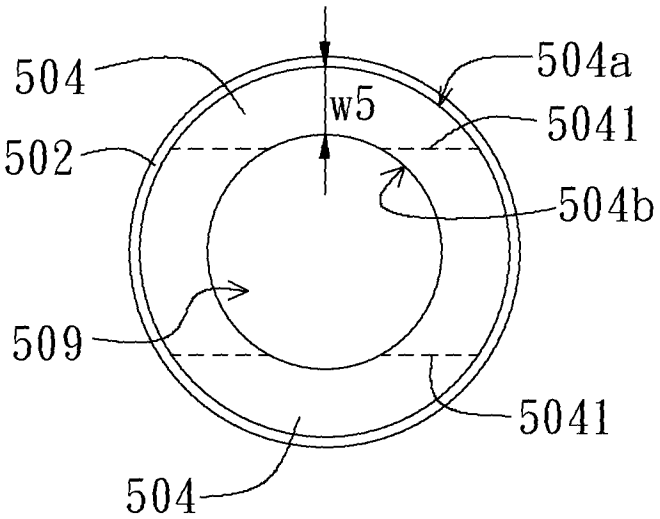
FIG. 9*f* is a back views showing positions of bending lines relative to the threaded connector with two metal sheets before bent along the bending lines in accordance with the eighth embodiment of the present invention; the eighth embodiment of the present invention.

FIGS. 9*d* and 9*e* are cross-sectional views showing a coaxial cable connector before and after assembled with the threaded connector in accordance with the eighth embodiment of the present invention. Referring to FIGS. 9*d* and 9*e*, a coaxial cable connector, which may be alternatively either one illustrated in the first through seventh embodiment, may be locked to the treaded connector 50 mounted on an electronic device or an adapter, such as a T-shaped or F-shaped adaptor, for connecting the coaxial cable to another coaxial cable. The coaxial cable fixed with the coaxial cable connector may have the metal wire 1 to be inserted into the hole 509 in the threaded connector 50 and the coaxial cable connector may have a nut 14 with an inner thread 144 engaging with an outer thread 502 of the threaded connector 50 so as to be screwed on the threaded connector 50. When the nut 14 is being screwed on the threaded connector 50, the inner sleeve 10 may have an outer flange 104 moving to the metal sheets 504 of the threaded connector 50 in the axial direction and then may contact the metal sheets 504 of the threaded connector 50. Next, the nut 14 may continue to be screwed on the threaded connector 50 such that each of the metal sheets 504 may be bent by the outer flange 104 of the inner sleeve 10 with the angle h becoming gradually small. When the nut 14 is fully locked to the threaded connector 50, the angle h may become substantially 0 degrees and each of the metal sheets 504 may have a back surface contacting the outer flange 104 of the inner sleeve 10. Thereby, when the nut 14 is not fully locked to the threaded connector 50, the metal sheets 504 may contact the outer flange 104 of the inner sleeve 10 so as to provide good electrical or ground connection between the inner sleeve 10 and the threaded connector 50. Even when the coaxial cable is casually pulled such that the nut 14 is not fully locked to the threaded connector 50, good electrical or ground connection between the inner sleeve 10 and the threaded connector 50 may still be provided by the metal sheets 504. Accordingly, the coaxial cable connector may transmit signals with improved quality.

Combination for the Above Embodiments

Figure 10A:
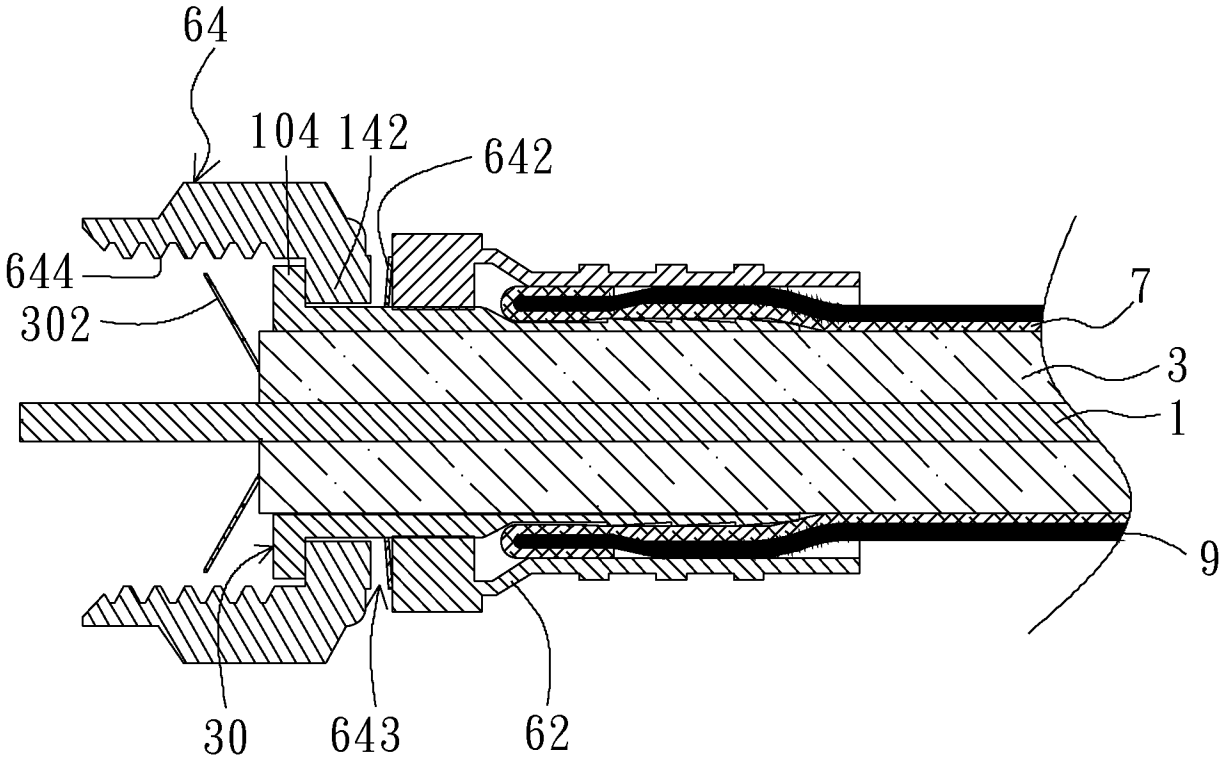
FIG. 10*a* is a cross-sectional view showing a coaxial cable connector in accordance with a first combination of the above embodiments of the present invention.

Various combination for the above embodiments could be employed for a coaxial cable connector. Elements having the same reference number as those in the first through eighth embodiments may refer to those illustrated in the first through eighth embodiments. For example, either of the inner sleeves 30 as illustrated in FIGS. 4*a*-4*e* and 4*i*-4*k* may be assembled with either of the nuts 64 as illustrated in FIGS. 6*a*-6*e* and 6*k*-6*m*, as seed in FIG. 10*a*. FIG. 10*a* is a cross-sectional view showing a coaxial cable connector in accordance with a first combination of the above embodiments of the present invention. Referring to FIG. 10*a*, the coaxial cable connector may include the inner sleeve 30 with the metal sheets 302 for improving ground connection between the inner sleeve 30 and the threaded connector 500 or 50 when being screwed with the nut 64 and include the nut 64 with the metal sheets 642 for improving ground connection between the nut 64 and the outer sleeve 62 and leading the inner flange 142 of the nut 64 always abutting against the outer flange 104 of the inner sleeve 30 to improve grounding connection between the nut 64 and the inner sleeve 30.

Figure 10B:
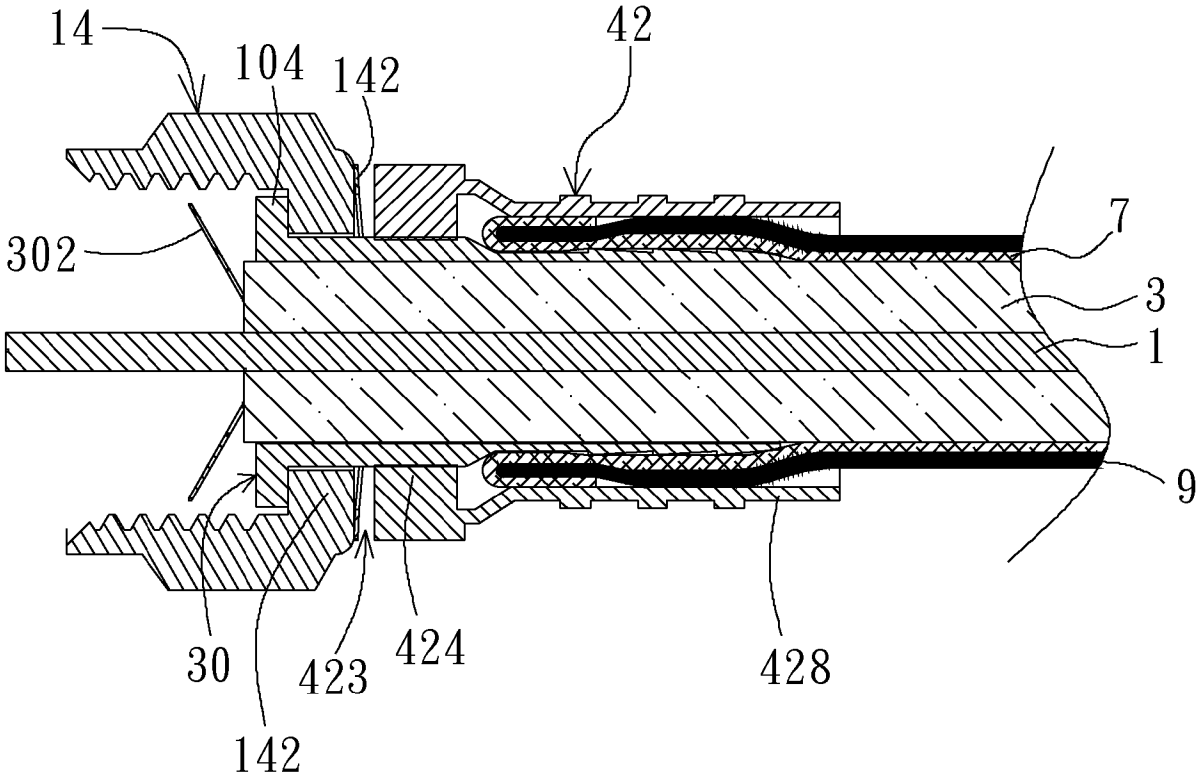
FIG. 10*b* is a cross-sectional view showing a coaxial cable connector in accordance with a second combination of the above embodiments of the present invention.

As another example, either of the inner sleeves 30 as illustrated in FIGS. 4*a*-4*e* and 4*i*-4*k* may be assembled with either of the outer sleeves 42 as illustrated in FIGS. 5*a*-5*e* and 5*i*-5*k*, as seed in FIG. 10*b*. FIG. 10*b* is a cross-sectional view showing a coaxial cable connector in accordance with a second combination of the above embodiments of the present invention. Referring to FIG. 10*b*, the coaxial cable connector may include the inner sleeve 30 with the metal sheets 302 for improving ground connection between the inner sleeve 30 and the threaded connector 500 or 50 when being screwed with the nut 64 and include the outer sleeve 42 with the metal sheets 422 for improving ground connection between the nut 14 and the outer sleeve 42 and leading the inner flange 142 of the nut 14 always abutting against the outer flange 104 of the inner sleeve 30 to improve grounding connection between the nut 14 and the inner sleeve 30.

Figure 10C:
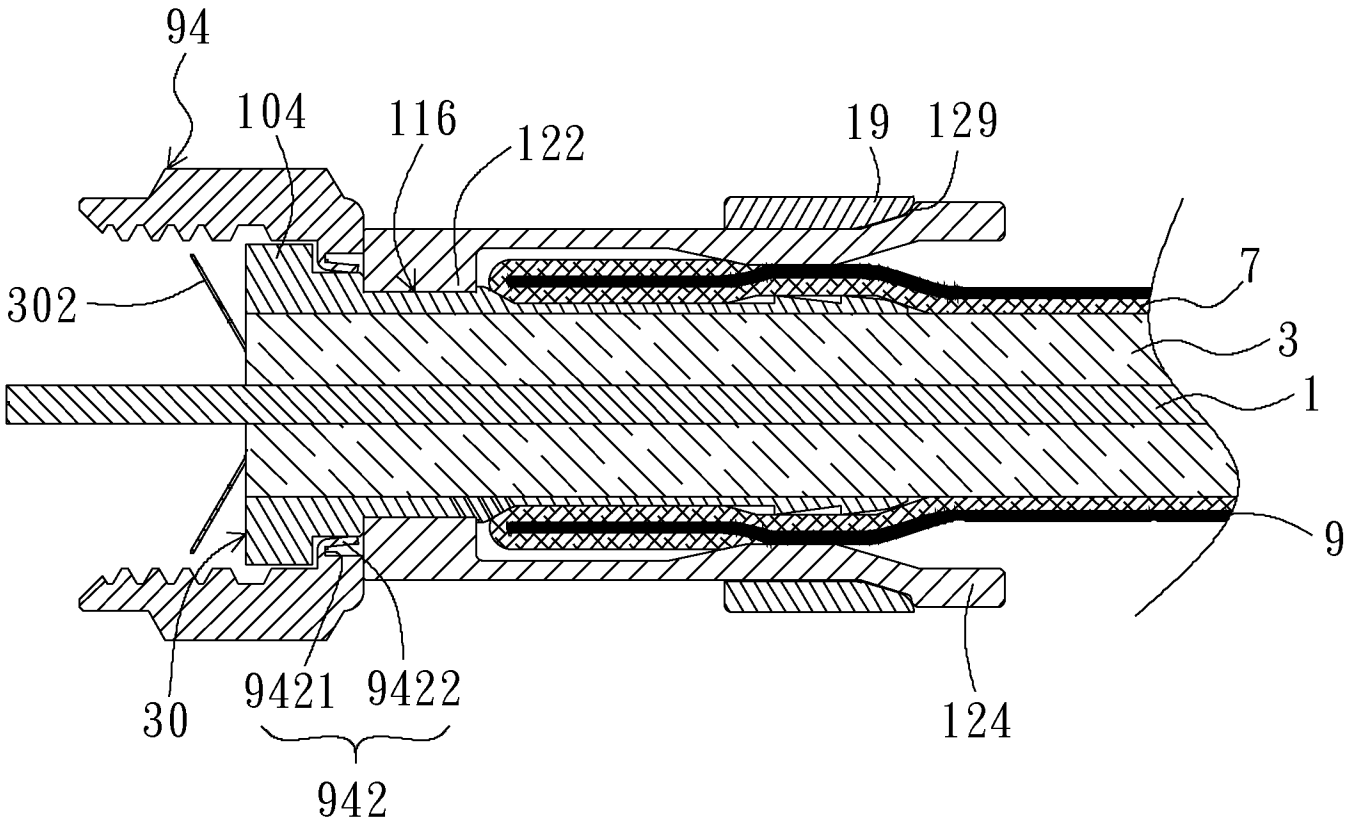
FIG. 10*c* is a cross-sectional view showing a coaxial cable connector in accordance with a third combination of the above embodiments of the present invention.

As another example, either of the inner sleeves 30 as illustrated in FIGS. 4*a*-4*e* and 4*i*-4*k* may be assembled with either of the nuts 94 as illustrated in FIGS. 7*a*-7*h* and 7*l*, as seed in FIG. 10*c*. FIG. 10*c* is a cross-sectional view showing a coaxial cable connector in accordance with a third combination of the above embodiments of the present invention. Referring to FIG. 10*c*, the coaxial cable connector may include the inner sleeve 30 with the metal sheets 302 for improving ground connection between the inner sleeve 30 and the threaded connector 500 or 50 when being screwed with the nut 64 and include the nut 94 with the metal sheets 942 for improving ground connection between the nut 94 and the inner sleeve 40.

The components, steps, features, benefits and advantages that have been discussed are merely illustrative. None of them, nor the discussions relating to them, are intended to limit the scope of protection in any way. Numerous other embodiments are also contemplated. These include embodiments that have fewer, additional, and/or different components, steps, features, benefits and advantages. These also include embodiments in which the components and/or steps are arranged and/or ordered differently.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain. Furthermore, unless stated otherwise, the numerical ranges provided are intended to be inclusive of the stated lower and upper values. Moreover, unless stated otherwise, all material selections and numerical values are representative of preferred embodiments and other ranges and/or materials may be used.

The scope of protection is limited solely by the claims, and such scope is intended and should be interpreted to be as broad as is consistent with the ordinary meaning of the language that is used in the claims when interpreted in light of this specification and the prosecution history that follows, and to encompass all structural and functional equivalents thereof.

What is claimed is:

1. A coaxial cable connector comprising:

an inner sleeve comprising a first metal sheet integral with a main body of said inner sleeve as a single part, wherein said first metal sheet expands by a first angle from a surface of said main body;

a nut arranged to be rotatable around said inner sleeve, wherein said inner sleeve comprises an outer flange engaging with an inner flange of said nut to restrict said nut from moving in an axial direction with respect to said inner sleeve; and an outer sleeve arranged around said inner sleeve.

2. The coaxial cable connector of claim 1, wherein said first metal sheet expands by said first angle, ranging from 20 degrees to 60 degrees, from said surface of said main body.

3. The coaxial cable connector of claim 1, wherein said first metal sheet extends in an arcuate shape with an arcuate outer periphery and an inner arcuate inner periphery.

4. The coaxial cable connector of claim 1, wherein said first metal sheet has a thickness between 0.1 mm and 3 mm.

5. The coaxial cable connector of claim 1, wherein said first metal sheet expands by said first angle from said surface, radially extending, of said main body.

6. The coaxial cable connector of claim 1, wherein said first metal sheet comprises copper.

7. The coaxial cable connector of claim 1, wherein said inner sleeve comprises a second metal sheet integral with said main body as said single part, wherein said second metal sheet expands by a second angle from said surface of said main body.

8. A coaxial cable connector comprising:

an inner sleeve;

a nut arranged to be rotatable around said inner sleeve, wherein said inner sleeve comprises an outer flange engaging with an inner flange of said nut to restrict said nut from moving in an axial direction, wherein said nut comprises a first metal sheet integral with said inner flange as a first single part, wherein said first metal sheet extends from an inner periphery of said inner flange and comprises a tab extending by a first angle from a plane normal to an axis of said nut to be radially between said inner flange and a cylindrical surface of said inner sleeve, wherein said first metal sheet abuts against said cylindrical surface; and an outer sleeve arranged around said inner sleeve.

9. The coaxial cable connector of claim 8, wherein said tab extends by said first angle, ranging from 30 degrees to 90 degrees, from said plane normal to said axis of said nut.

10. The coaxial cable connector of claim 8, wherein said first metal sheet comprises a ring portion radially extending from said inner periphery of said inner flange, wherein said tab extends from said ring portion by said first angle.

11. The coaxial cable connector of claim 8, wherein said first metal sheet has a thickness between 0.1 mm and 3 mm.

12. The coaxial cable connector of claim 8, wherein said first metal sheet comprises copper.

13. The coaxial cable connector of claim 8, wherein said inner sleeve comprises a second metal sheet integral with a main body of said inner sleeve as a second single part, wherein said second metal sheet expands by a second angle from a surface of said main body.

14. The coaxial cable connector of claim 13, wherein said second metal sheet expands by said second angle, ranging from 20 degrees to 60degrees, from said surface of said main body.

15. The coaxial cable connector of claim 13, wherein said second metal sheet extends in an arcuate shape with an arcuate outer periphery and an inner arcuate inner periphery.

16. The coaxial cable connector of claim 13, wherein said second metal sheet has a thickness between 0.1 mm and 3 mm.

17. The coaxial cable connector of claim 13, wherein said second metal sheet comprises copper.

18. The coaxial cable connector of claim 13, wherein said inner sleeve comprises a third metal sheet integral with said main body as said second single part, wherein said third metal sheet expands by a third angle from said surface of said main body.

19. The coaxial cable connector of claim 18, wherein said third metal sheet expands by said third angle, ranging from 20 degrees to 60 degrees, from said surface of said main body.

20. The coaxial cable connector of claim 13, wherein said second metal sheet expands by said second angle from said surface, radially extending, of said main body.

* * * * *